US007296830B2

(12) United States Patent
Koveal et al.

(10) Patent No.: US 7,296,830 B2
(45) Date of Patent: Nov. 20, 2007

(54) ROTARY PAWL LATCH

(75) Inventors: Stefan M. Koveal, Glen Mills, PA (US); Robert Speers, West Chester, PA (US); Hitesh Cherry, Harrisburg, PA (US); Jeffrey Antonucci, West Chester, PA (US); Richard B. Langkamp, Hemlock, NY (US); D. Dale Turner, Honeoye Falls, NY (US); Richard John Horton, Stourbridge (GB); Phil Kempson, Bristol (GB); Alan Simchayoff, Warrington, PA (US)

(73) Assignee: Southco, Inc., Concordville, PA (US)

( * ) Notice: Subject to any disclaimer, the term of this patent is extended or adjusted under 35 U.S.C. 154(b) by 244 days.

(21) Appl. No.: 10/888,168

(22) Filed: Jul. 9, 2004

(65) Prior Publication Data

US 2005/0067840 A1 Mar. 31, 2005

Related U.S. Application Data

(60) Provisional application No. 60/562,808, filed on Apr. 16, 2004, provisional application No. 60/487,042, filed on Jul. 10, 2003.

(51) Int. Cl.
*E05C 3/06* (2006.01)

(52) U.S. Cl. ..... 292/201; 292/216; 70/279.1

(58) Field of Classification Search ..... 292/216, 292/201; 70/279.1
See application file for complete search history.

(56) References Cited

U.S. PATENT DOCUMENTS

| | | | | |
|---|---|---|---|---|
| 2,943,880 A | | 7/1960 | Joachim et al. | 292/201 |
| 3,378,291 A | | 4/1968 | Brian | 292/68 |
| 4,135,377 A | * | 1/1979 | Kleefeldt et al. | 70/264 |
| 4,262,830 A | | 4/1981 | Haves | 224/505 |
| 4,268,076 A | | 5/1981 | Itoi | |
| 4,667,991 A | | 5/1987 | Pebre | 292/201 |
| 4,796,932 A | | 1/1989 | Tame | 292/112 |
| 4,861,089 A | | 8/1989 | Compeau et al. | 296/76 |
| 4,867,496 A | | 9/1989 | Thomas | |
| 4,892,340 A | | 1/1990 | Matumoto | 292/201 |
| 4,976,478 A | | 12/1990 | Acciacca et al. | 292/201 |
| 5,007,261 A | | 4/1991 | Quantz | 70/240 |

(Continued)

FOREIGN PATENT DOCUMENTS

DE 100 09 370 A1 9/2001

OTHER PUBLICATIONS

Tech-Train Bulletin—Steven E. Young, Issue #16, 2002, 3 pages.

(Continued)

*Primary Examiner*—Gary Estremsky
(74) *Attorney, Agent, or Firm*—Paul & Paul

(57) ABSTRACT

Latches including a housing, a rotary pawl, catch means for releasably holding the pawl in a closed configuration, and means for operating the catch means are disclosed. The pawl is pivotally attached to the housing and is rotationally movable between a closed or engaged configuration and an open or disengaged configuration. The pawl is provided with a torsion spring member that biases the pawl toward the open or disengaged configuration. In some embodiments the catch means includes a locking member. In other embodiments the catch means includes a pivotally movable trigger. The means for operating the catch means may be electrically powered.

11 Claims, 63 Drawing Sheets

U.S. PATENT DOCUMENTS

| | | | | |
|---|---|---|---|---|
| 5,020,838 | A | 6/1991 | Fukumoto | 292/201 |
| 5,180,198 | A | 1/1993 | Nakamura et al. | 292/201 |
| 5,222,775 | A | 6/1993 | Kato | 292/201 |
| 5,411,302 | A | 5/1995 | Shimada | 292/201 |
| 5,927,772 | A | 7/1999 | Antonucci et al. | |
| 6,048,006 | A | 4/2000 | Antonucci et al. | |
| 6,139,073 | A * | 10/2000 | Heffner et al. | 292/201 |
| 6,375,577 | B1 * | 4/2002 | Smith et al. | 464/136 |
| 6,463,773 | B1 | 10/2002 | Dimig | |
| 6,659,515 | B2 * | 12/2003 | Raymond et al. | 292/201 |
| 6,705,140 | B1 | 3/2004 | Dimig et al. | |
| 6,730,867 | B2 | 5/2004 | Hyp | |
| 6,948,745 | B2 * | 9/2005 | Chevalier | 292/201 |
| 2003/0094024 | A1 | 5/2003 | Dimig | |

OTHER PUBLICATIONS

TriMark Website print out—www.trimarkcorp.com, 050-0410 Floating Striker Single Rotor Latch Single Position, 19 pages, printed out on Apr. 13, 2004.

Photographs showing a TriMark latch similiar to those shown in TriMark's Website.

* cited by examiner

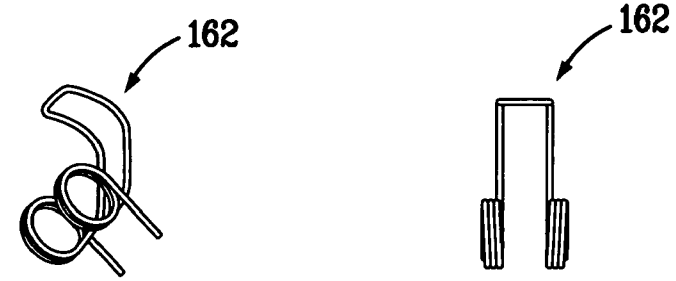
FIG. 40
FIG. 41
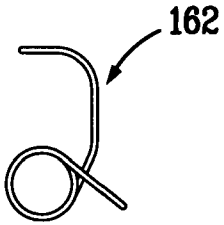
FIG. 42
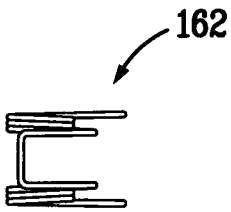
FIG. 43
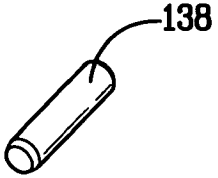
FIG. 44
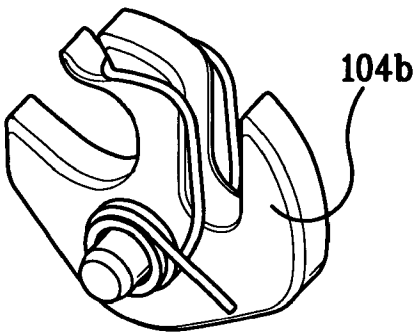
FIG. 45
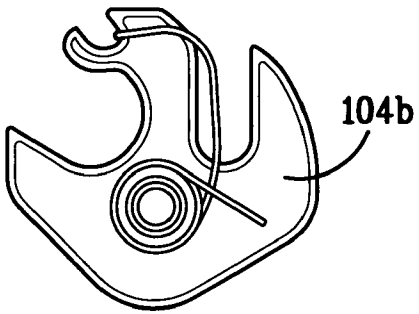
FIG. 46

ROTARY PAWL LATCH

CROSS-REFERENCE TO RELATED APPLICATIONS

This application claims the benefit of the priority of U.S. Provisional Patent Application No. 60/487,042, filed on Jul. 10, 2003, and U.S. Provisional Patent Application No. 60/562,808, filed on Apr. 16, 2004, all of which are incorporated in their entirety herein by reference.

BACKGROUND OF THE INVENTION

1. Field of Invention

The present invention relates to the field of latch assemblies.

2. Brief Description of the Related Art

Latch assemblies are relied on in many applications for securing items, such as panels, doors, and doorframes together. For example, containers, cabinets, closets, compartments and the like may be secured with a latch. An important use for latches is in the automotive field, where there is a desire and need to access automotive compartments, such as, for example, the trunk or passenger compartments of vehicles, as well as interior compartments such as a glove box. Furthermore, in many applications an electrically operated latch is desirable due to the need for remote or push-button entry, coded access, key-less access, or monitoring of access. Various latches for panel closures have been employed where one of the panels such as a swinging door or the like is to be fastened or secured to a stationary panel, doorframe, or compartment body. Although many latch assemblies are known in the prior art, none are seen to teach or suggest the unique features of the present invention or to achieve the advantages of the present invention.

SUMMARY OF THE INVENTION

The present invention is directed to a latching system for securing two members together. The present invention includes a housing, a rotary pawl, catch means for releasably holding the pawl in a closed configuration, and means for operating the catch means. The pawl is pivotally attached to the housing and is rotationally movable between a closed or engaged configuration and an open or disengaged configuration. The pawl is provided with a torsion spring member that biases the pawl toward the open or disengaged configuration. The catch means includes a locking member that is movable between an extended position and a retracted position and is spring biased toward the extended position. The locking member can be retracted by the action of the means for operating the catch means, which in the illustrated examples is an electrically powered solenoid. When the pawl strikes a keeper during closing, the pawl is moved to the closed configuration. A lug projecting from the pawl is engaged by the locking member once the pawl is in the closed configuration in order to keep the pawl in the closed configuration. At this time the pawl and a portion of the housing cooperatively capture the keeper to secure the latch to the keeper. Energizing the solenoid retracts the locking member, which allows the pawl to rotate under the force of the torsion spring to the open configuration. Thus, the latch can be disengaged from the keeper and a compartment, for example, can be opened.

A further embodiment of the present invention includes a housing, a rotary pawl, catch means for releasably holding the pawl in a closed configuration, and actuation means for operating the catch means. The pawl is pivotally attached to the housing and is rotationally movable between a closed or latched configuration and an open or unlatched configuration. The pawl is provided with a torsion spring member that biases the pawl toward the open or disengaged configuration. The catch means includes a trigger that is pivotally movable between an engaged position and a disengaged position and is spring biased toward the engaged position. The trigger can be moved to the disengaged position by the action of the actuation means, which in the illustrated examples is an electrically powered actuator. When the pawl strikes a striker (also known as a keeper) during closing, the pawl is moved to the closed configuration. A notch in the pawl is engaged by the trigger once the pawl is in the closed configuration in order to keep the pawl in the closed configuration. At this time the striker is captured in a slot in the pawl to thereby secure the latch and the striker together. Energizing the actuator pivotally moves the trigger to the disengaged position, which allows the pawl to rotate under the force of the torsion spring to the open configuration. The striker can then be disengaged from the latch and a compartment, for example, can be opened.

BRIEF DESCRIPTION OF THE DRAWINGS

FIGS. 29-48 are views of a third embodiment of a latch assembly according to the present invention having a solid support for the locking member to bear against at all times within the locking member's range of motion between retracted and extended positions.

DETAILED DESCRIPTION OF THE INVENTION

Figure 3:
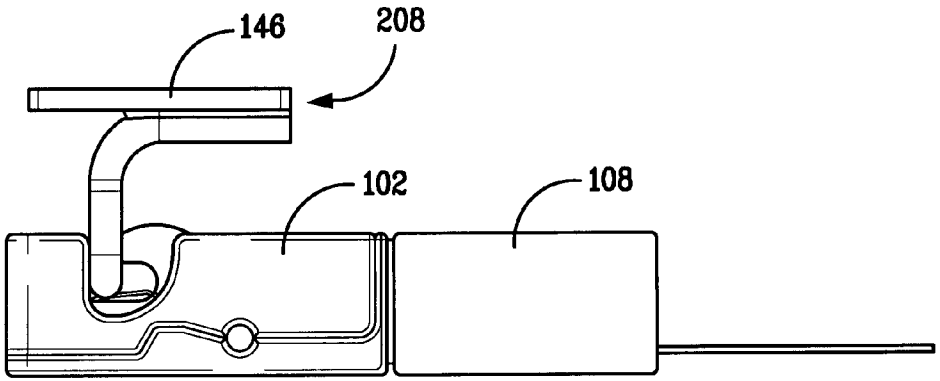
FIGS. 1-18 are views of a first embodiment of a latch assembly according to the present invention having two rollers.
Figure 4:
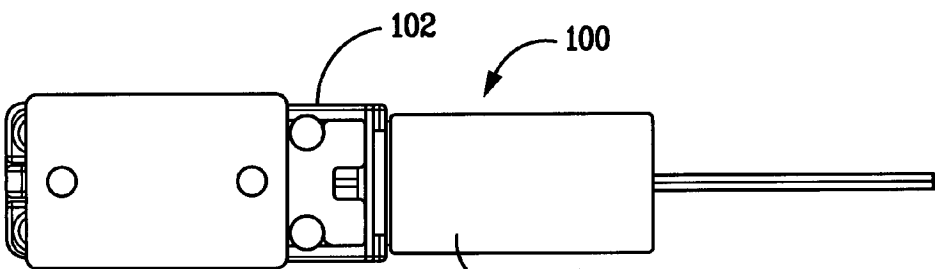
Figure 1:
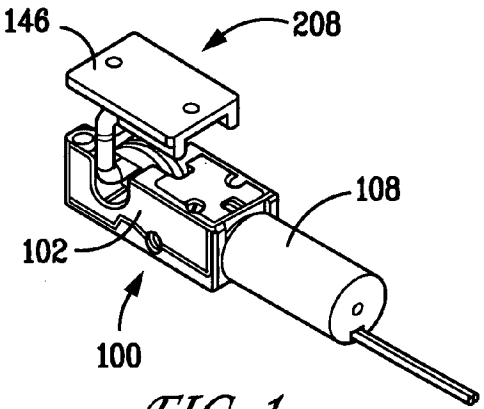
Figure 2:
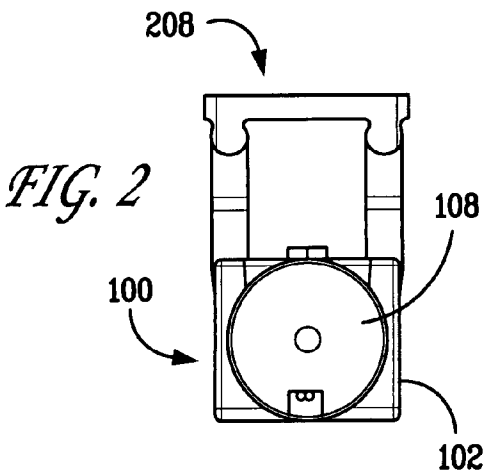
Figure 7:
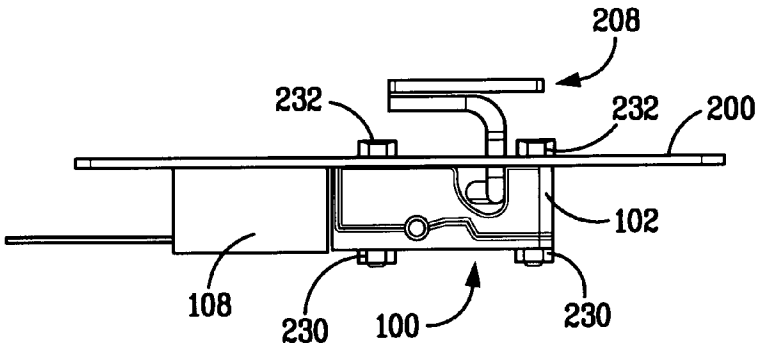
Figure 8:
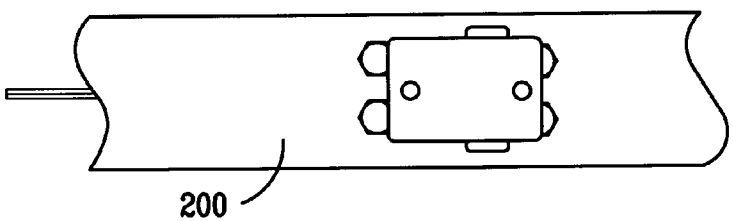
Figure 5:
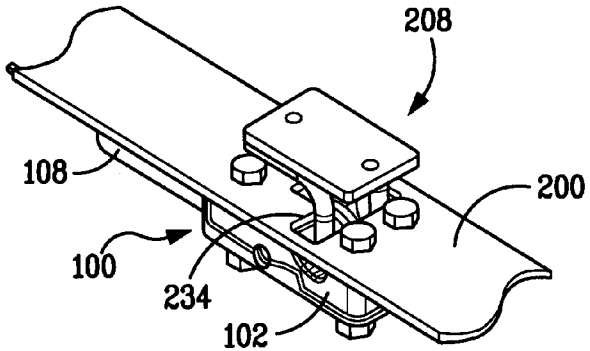
Figure 6:
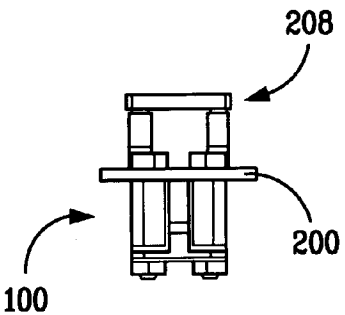
Figure 9:
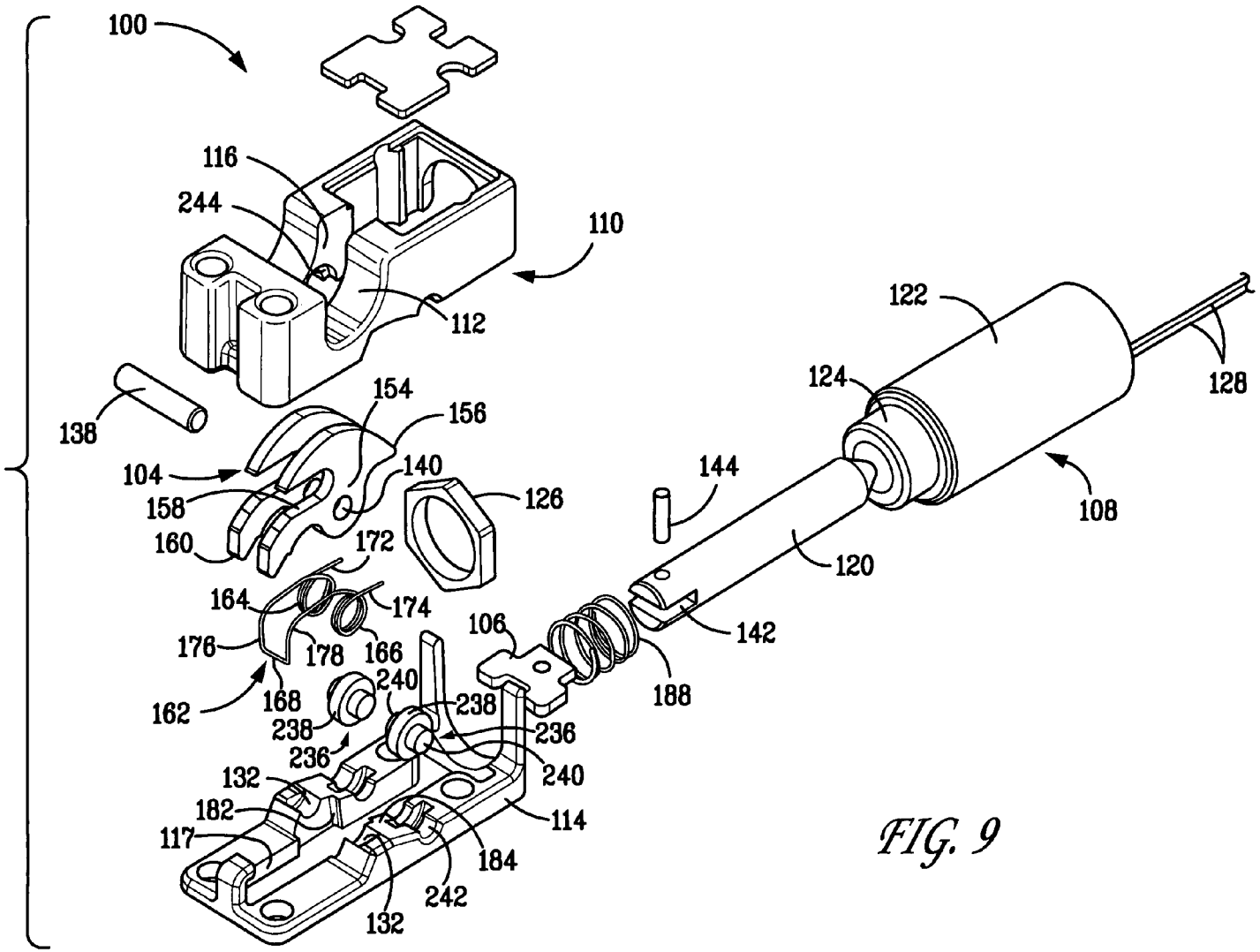
Figure 10:
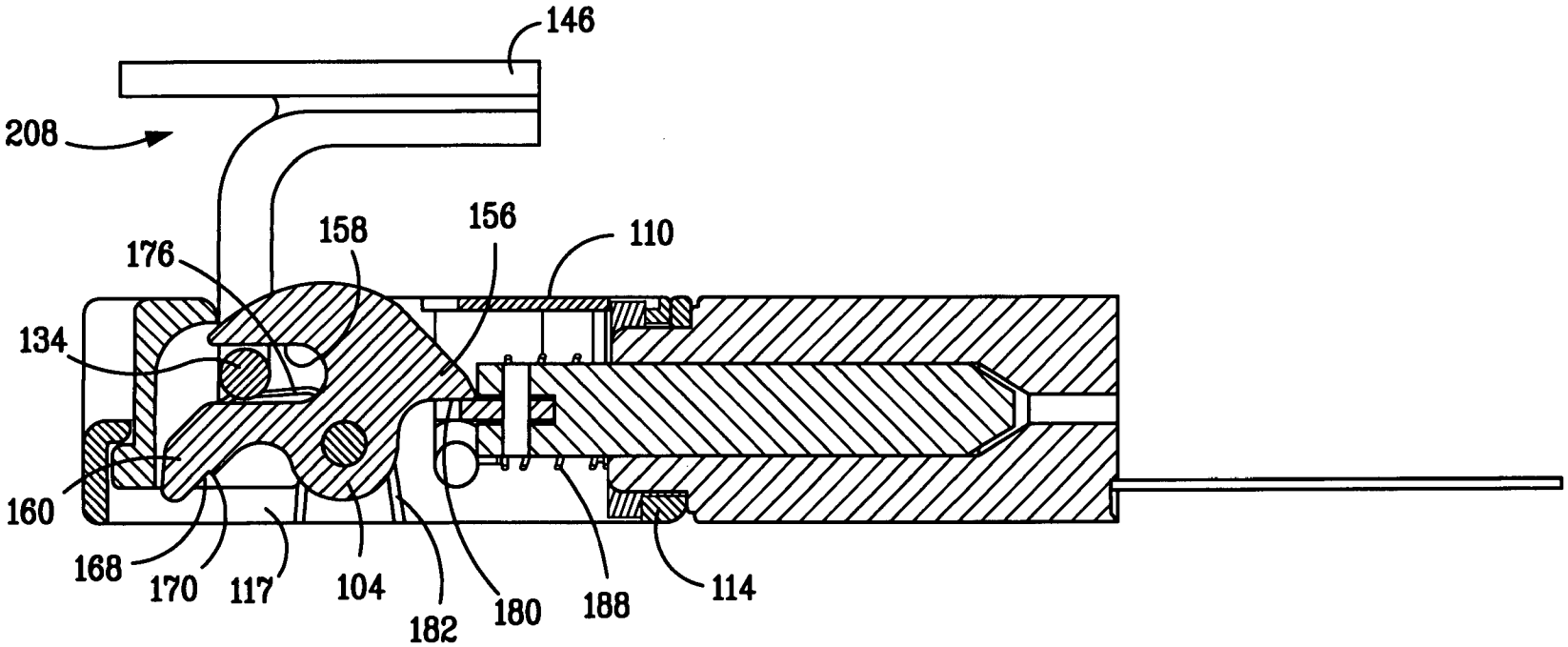
Figure 13:
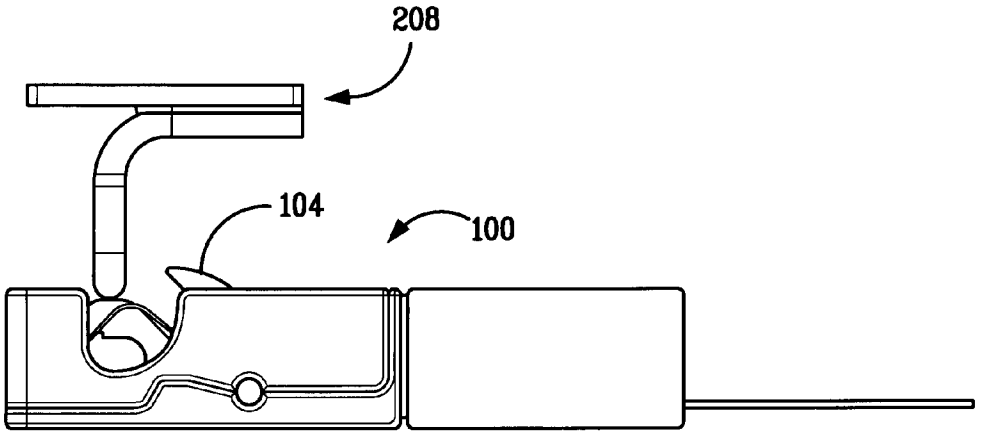
Figure 14:
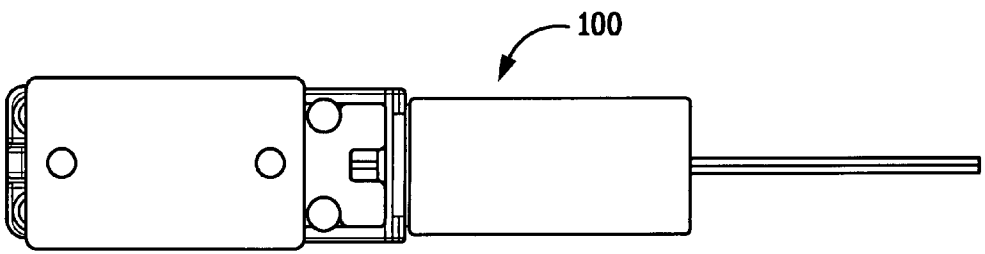
Figure 11:
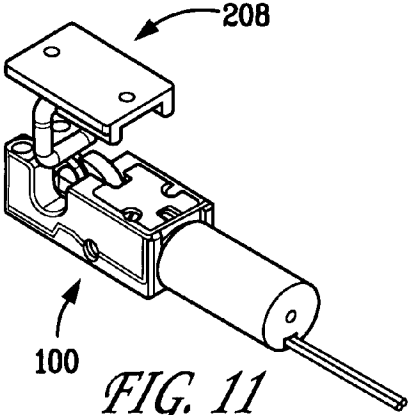
Figure 12:
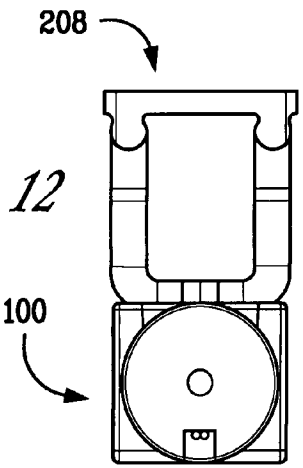
Figure 17:
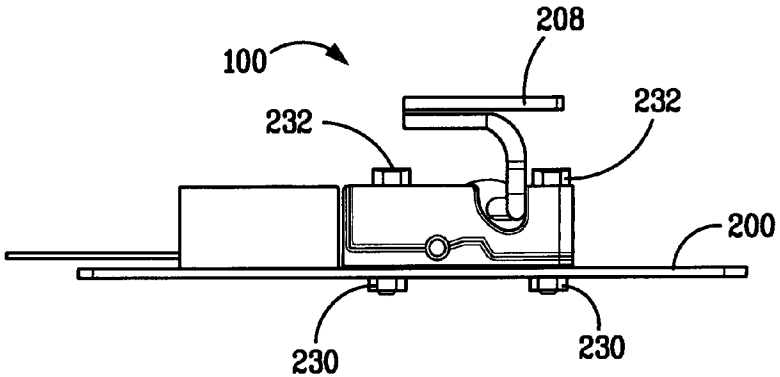
Figure 18:
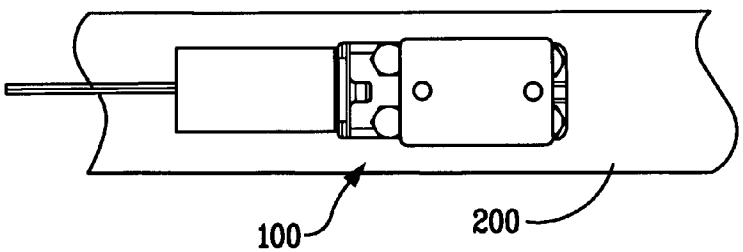
Figure 15:
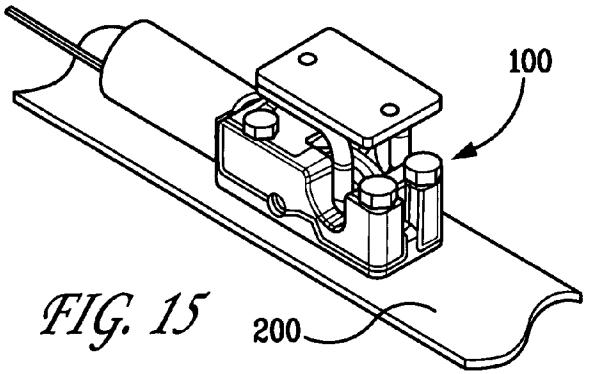
Figure 16:
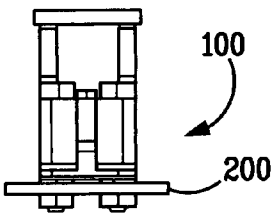
Figure 21:
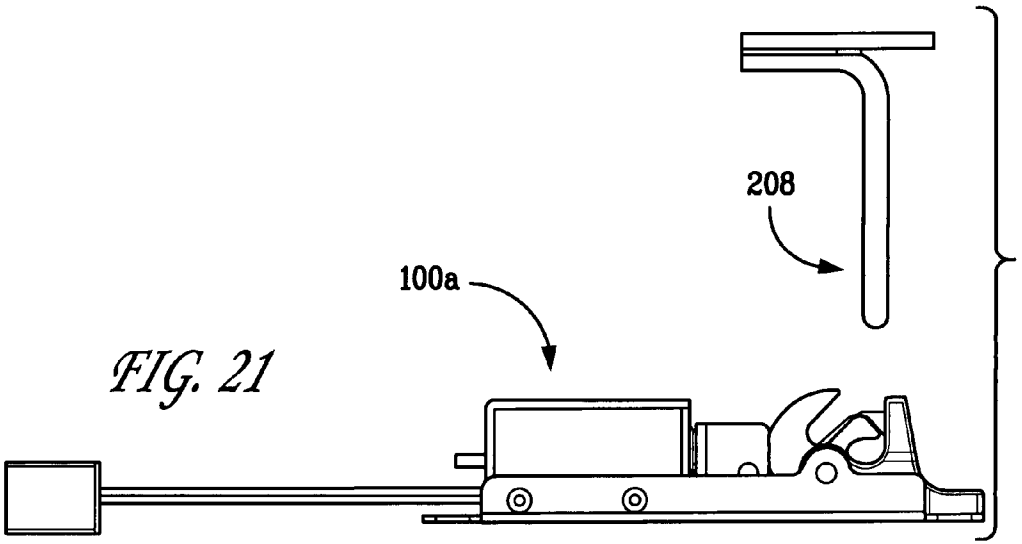
FIGS. 19-28 are views of a second embodiment of a latch assembly according to the present invention having three rollers.
Figure 22:
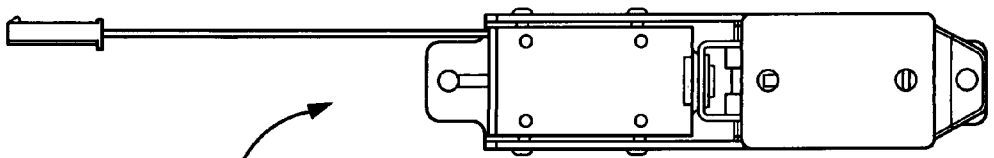
Figure 19:
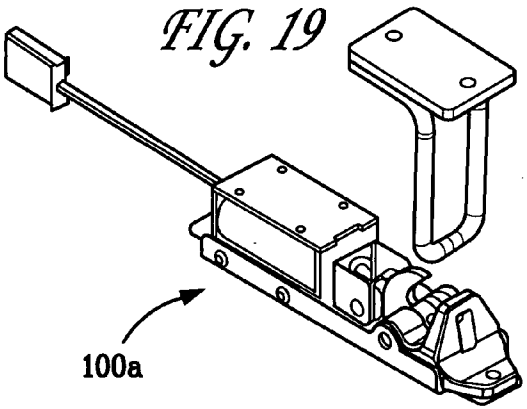
Figure 20:
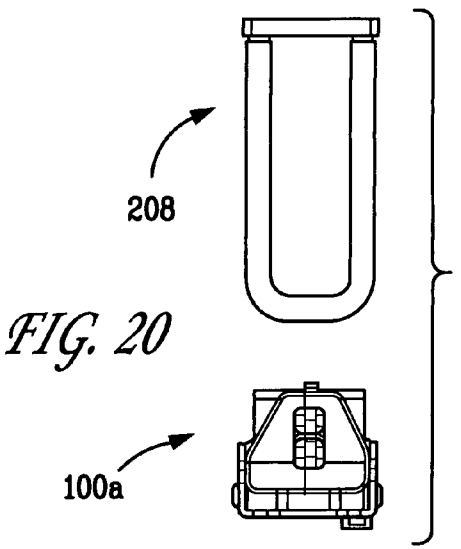
Figure 23:
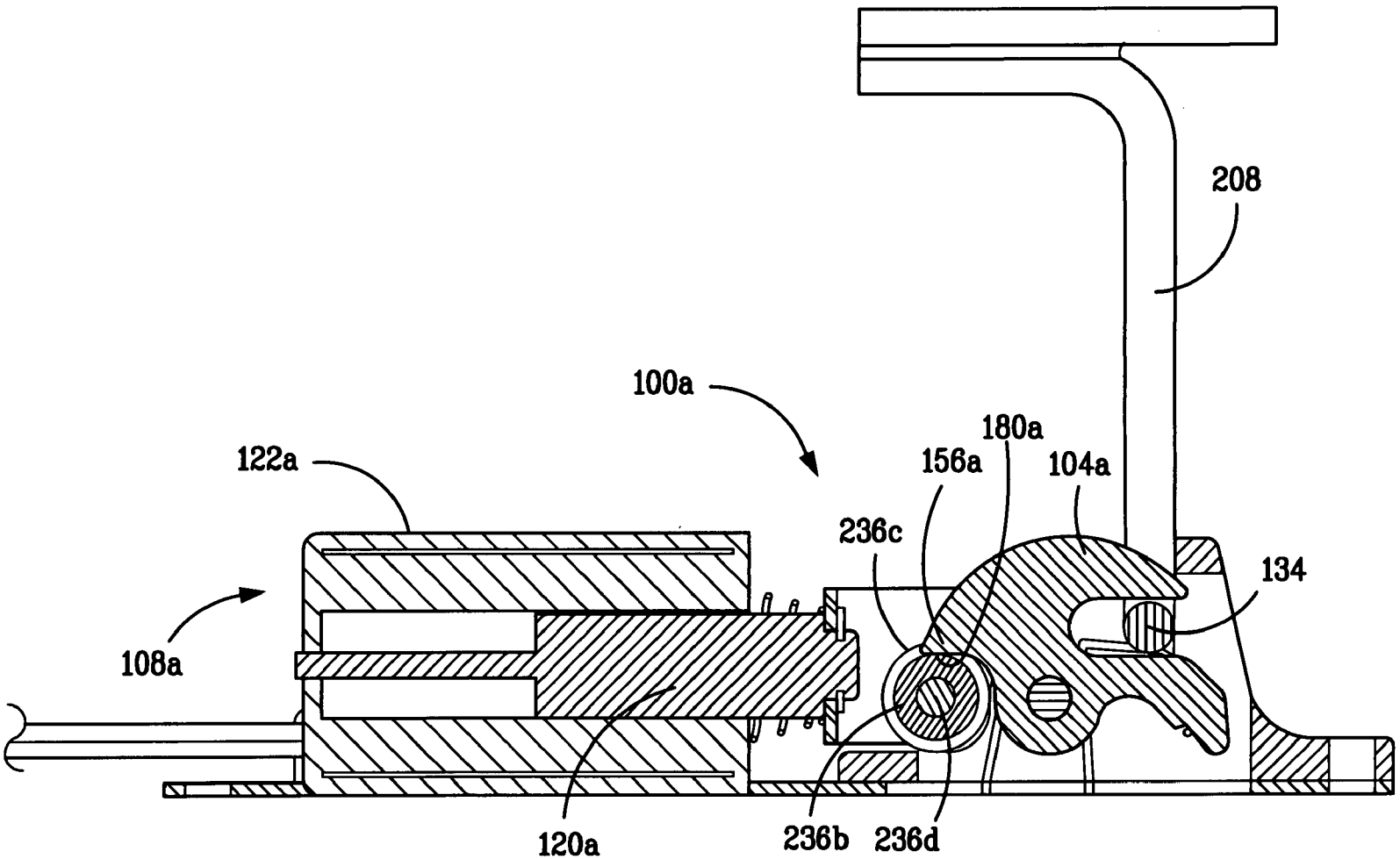
Figure 26:
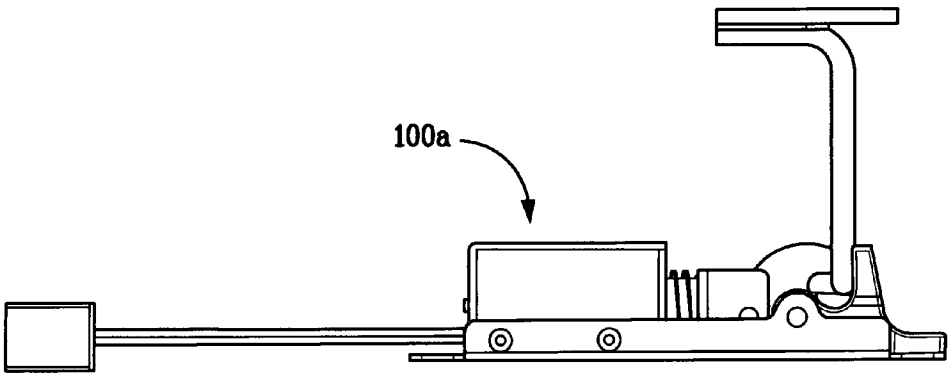
Figure 27:
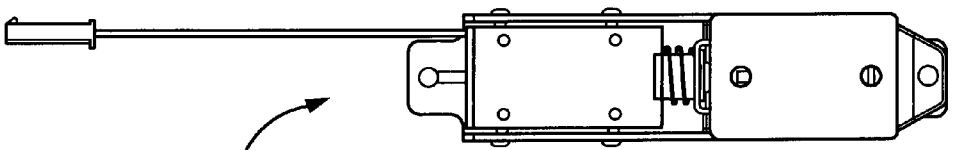
Figure 24:
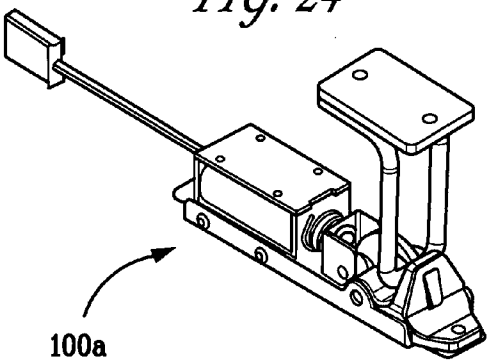
Figure 25:
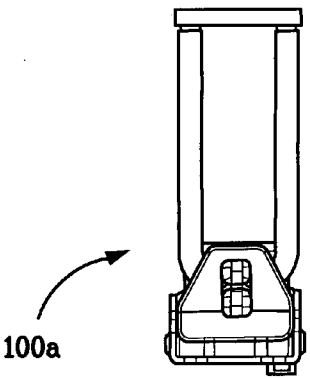
Figure 28:
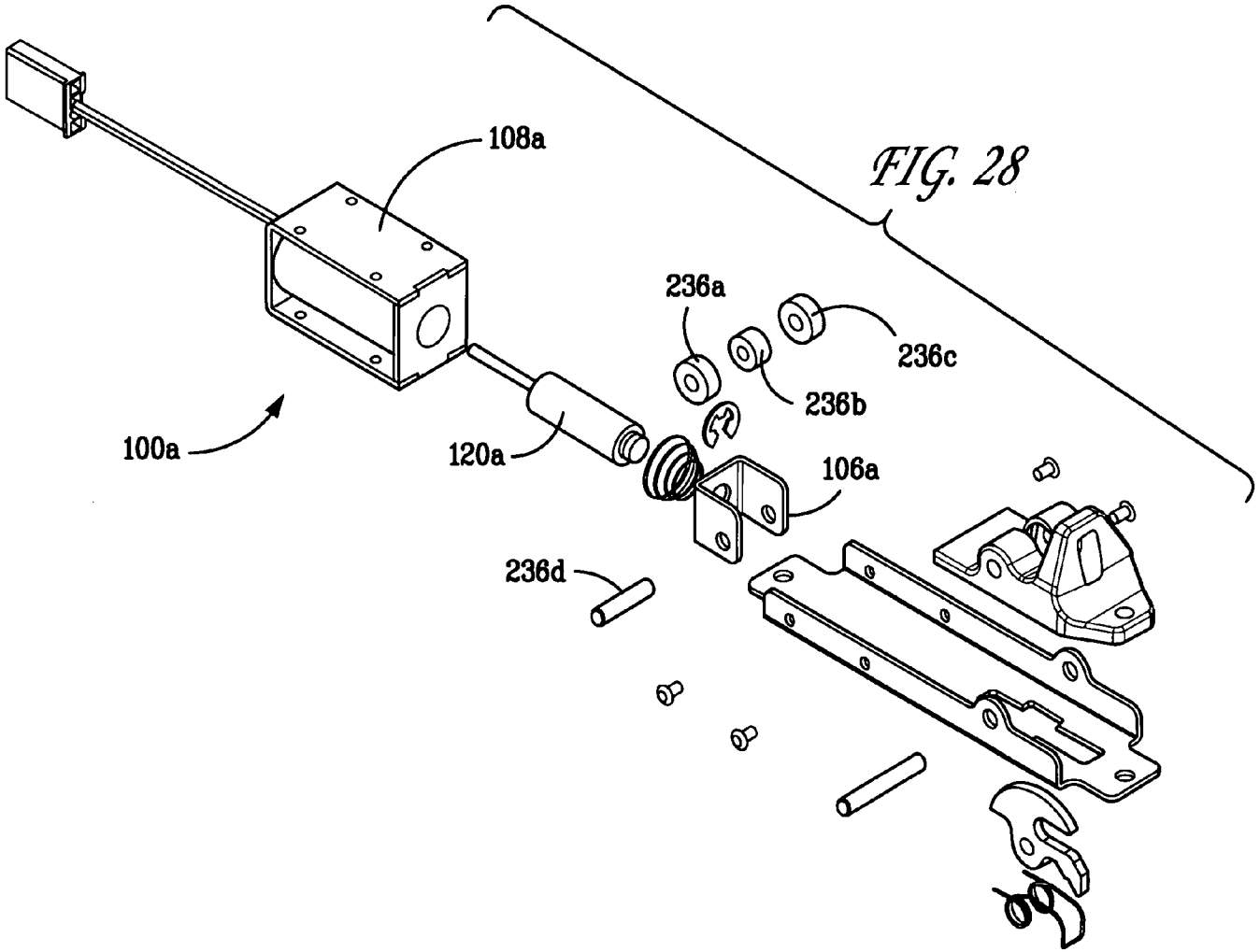
Figure 30:
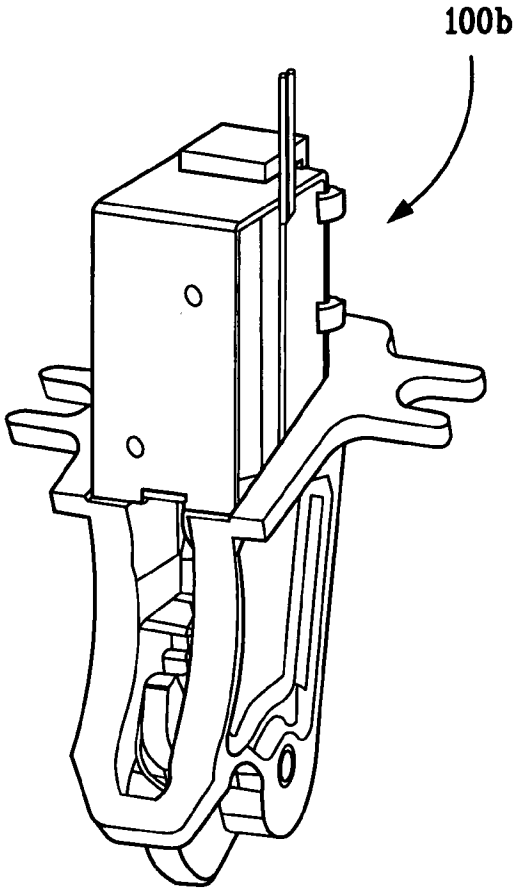
Figure 29:
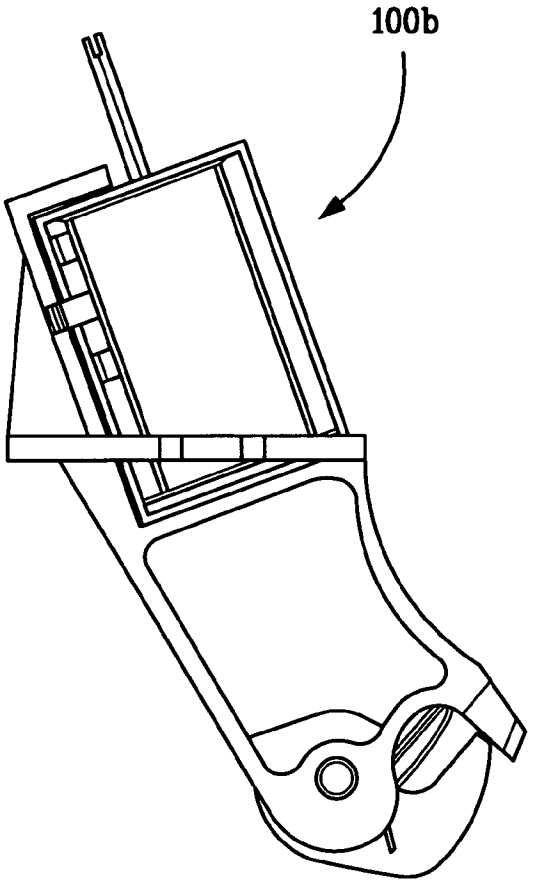
Figure 32:
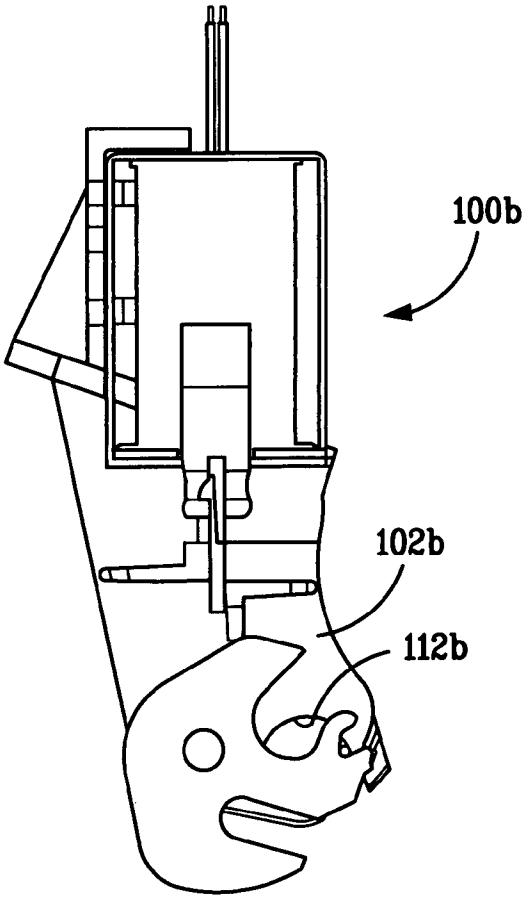
Figure 31:
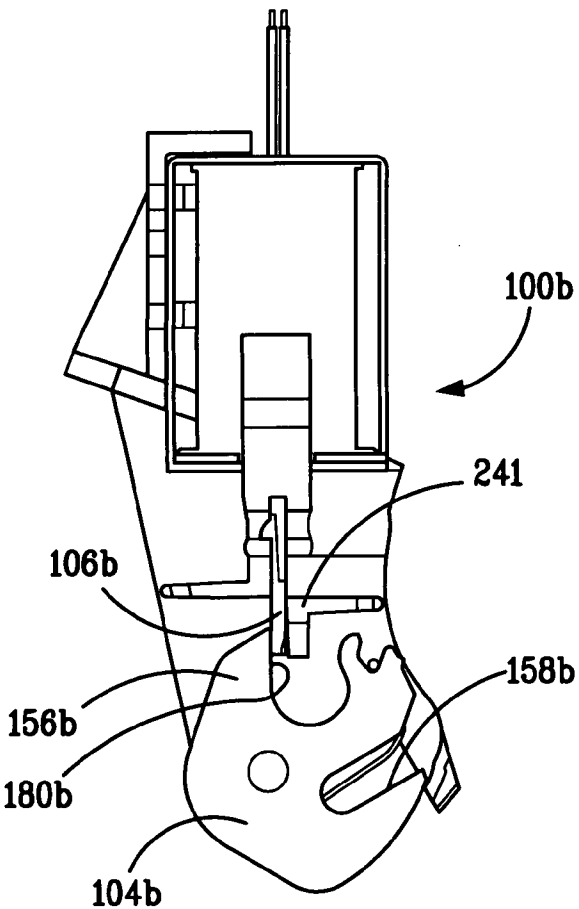
Figure 35:
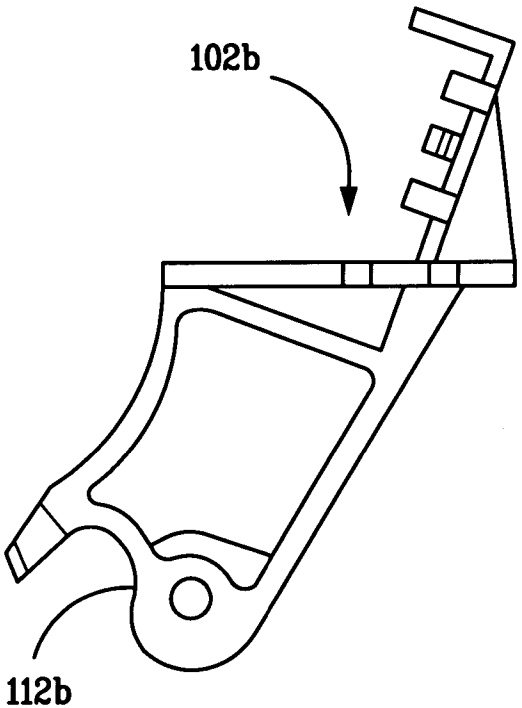
Figure 34:
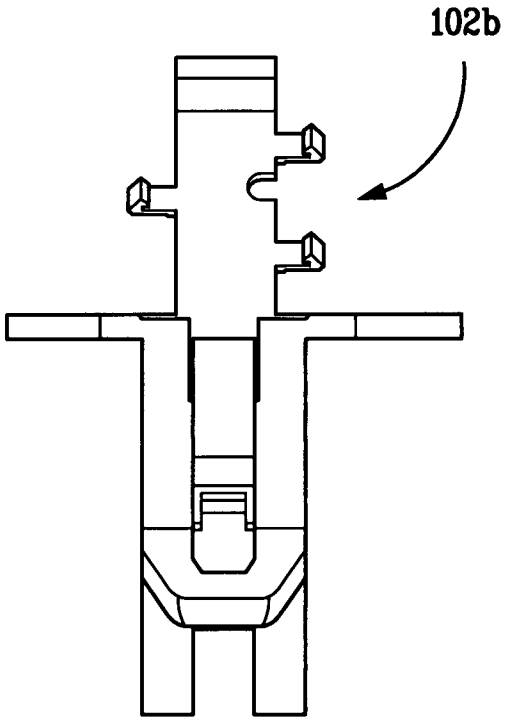
Figure 33:
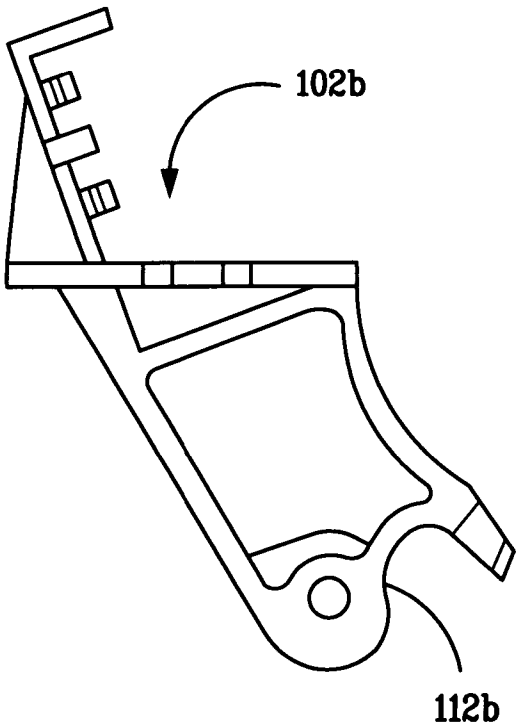
Figure 38:
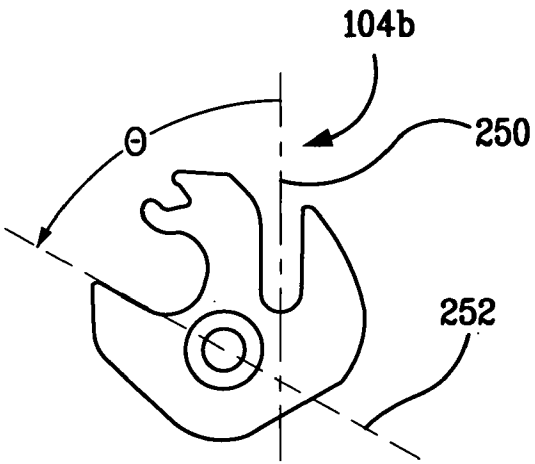
Figure 37:
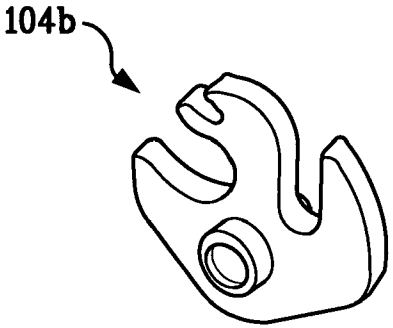
Figure 39:
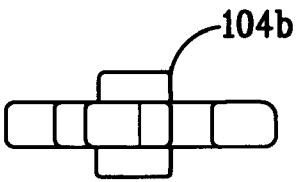
Figure 36:
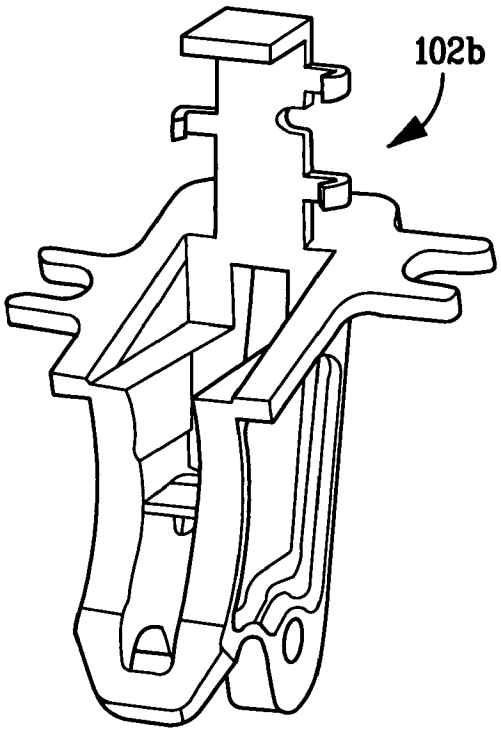
Figure 47:
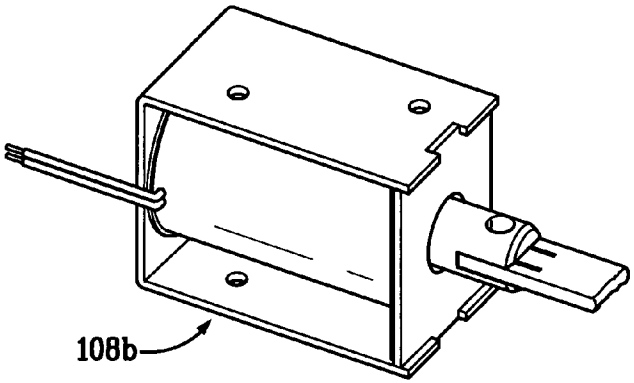
Figure 48:
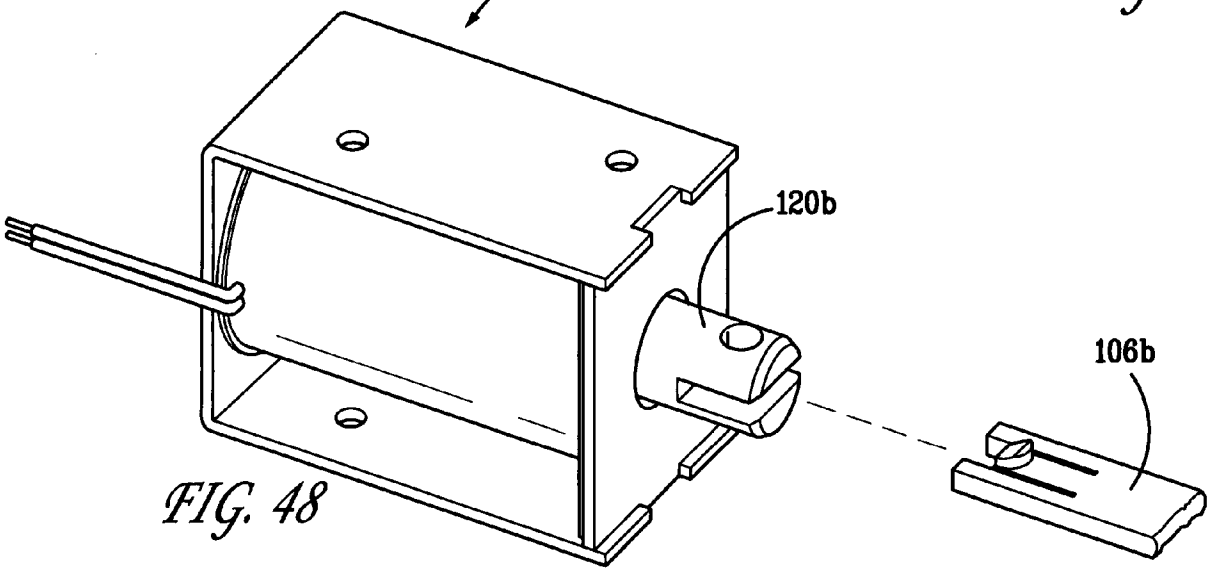

Some embodiments of the latches disclosed herein have some features in common with the latches disclosed in U.S. Pat. No. 5,927,772, issued on Jul. 27, 1999, U.S. Non-provisional Utility patent application Ser. No. 10/001,479, filed on Nov. 1, 2001, U.S. Provisional Patent Application No. 60/245,089, filed on Nov. 1, 2000, U.S. Provisional Patent Application No. 60/254,605, filed on Dec. 10, 2000, U.S. Provisional Patent Application No. 60/273,944, filed on Mar. 7, 2001, U.S. Provisional Patent Application No. 60/318,839, filed on Sep. 13, 2001, and U.S. Provisional Patent Application No. 60/312,677, filed on Aug. 15, 2001, all of which are incorporated in their entirety herein by reference.

Referring to FIGS. 1-18, a latch 100 in accordance with a first embodiment of the present invention can be seen. The latch 100 includes a latch housing 102, a pawl 104, a locking member 106, and means for selectively moving the locking member in and out of engagement with the pawl. In the illustrated embodiment, a solenoid assembly 108 serves as the means for selectively moving the locking member in and out of engagement with the pawl.

In the illustrated example, the latch 100 is shown being used for securing a member 200 relative to a keeper 208. The latch 100 is generally applicable wherever one or more closure members need to be secured in a certain position. Further, the member 200 can be movable or stationary. In addition, the latch 100 may be mounted in any orientation depending upon the particular application.

Preferably, the housing 102 has a portion that closes off the open end of the pawl slot 158 when the pawl 104 is in the closed configuration. Furthermore, the housing must be adapted to allow an unobstructed path to the pawl slot 158 when the pawl 104 is in the open configuration. In the first embodiment, the housing 102 has an upper portion 110 that is provided with an open U-shaped indentation or recess 112 as viewed in profile. The lateral side of the U-shaped indentation located farthest from the solenoid assembly 108 acts to close off the open end of the pawl slot 158 when the pawl 104 is in the closed configuration. The open end of the U-shaped indentation 112 allows an unobstructed path to the pawl slot 158 when the pawl 104 is in the open configuration. The U-shaped indentation is sized such that the housing 102 will not interfere with the movement of the keeper 208 relative to the housing 102 as the pawl 104 is moved from the open configuration to the closed configuration by contact with the keeper 208. The housing 102 has a lower portion 114 that mates with the upper portion 110 in a clam-shell fashion. A first slot 116 is provided within the portion of the upper housing portion 110 that has the U-shaped indentation 112. The slot 116 receives a portion of the pawl 104 and allows for the pawl 104 to be rotationally supported by the housing 102 while portions of the pawl 104 project into and overlap the U-shaped indentation 112, all without interference with the rotational movement of the pawl. The lower housing portion 114 has a corresponding slot that provides clearance for the pawl 104 to move rotationally relative to the housing 102 over its operational range of motion without interference from any part of the lower housing portion 114.

The U-shaped indentation 112 is oriented such that the open end of the U-shaped indentation 112 is directed in a direction that is substantially perpendicular to the longitudinal axis of the shaft or plunger 120 of the solenoid 108. In the illustrated embodiment, the longitudinal axis of the shaft or plunger 120 of the solenoid 108 essentially lies in the plane of rotation of the pawl 104. The plane of rotation of the pawl 104 is defined as a plane to which the axis of rotation of the pawl 104 is perpendicular and that passes through the center of the pawl 104.

The solenoid body 122 is provided with a threaded portion 124 that passes into the housing 102. A solenoid nut 126 located inside the housing 102 engages the threaded portion 124 to secure the solenoid 108 to the housing 102. Electrical energy is supplied to the solenoid 108 through the wires 128.

The latch assembly 100 also includes a pawl 104 shown pivotally connected to the latch housing 102 with suitable attachment means such as the pawl pivot pin 138 that passes through the hole 140 in the pawl 104. The upper housing portion 110 and the lower housing portion 114 are each provided with a pair of semi-cylindrical cavities 132 that form cylindrical cavities for receiving the ends of the pivot pin 138 as the upper housing portion 110 and the lower housing portion 114 are assembled together in clam-shell fashion. Thus the pawl 104 is rotationally supported by the housing 102.

The pawl 104 has a body portion 154 through which the hole 140 passes. The pawl 104 has a lug or projection 156 and is provided with a pawl slot 158 to retain the keeper member 208 when the pawl 104 is in the latched position. In the illustrated example, the keeper member 208 has a rod-shaped portion 134 that engages the pawl slot 158 as the panel 200 is moved to the closed position relative to the keeper 208. When the panel 200 is closed, the rod-shaped portion 134 of the keeper member 208 will be positioned or caught in the pawl slot 158 that is closed off by a lateral side of the U-shaped indentation 112. The pawl 104 is also provided with an arm portion 160 extending from the pawl body 154.

A pawl torsion spring 162 is installed on the pawl 104 with the coiled portions 164 and 166 surrounding the pivot pin 138 on either side of the pawl 104. The cross bar 168 of the torsion spring 162 engages the notch 170 in the arm portion 160. In the illustrated example the notch 170 is enlarged to more positively retain the cross bar 168 in position relative to the pawl 104. The torsion spring 162 also has tail portions 172,174 and arms 176,178. The vertical spring arms 176,178 extend from the respective coiled portions 164 and 166 of the torsion spring 162 and connect to cross bar 168. The pawl arm 160 is positioned intermediate the spring arms 176 and 178. The projection or lug 156 has a flat surface 180 that extends roughly in a radial direction relative to the pivot axis of the pawl 104.

The tails 172, 174 of the torsion spring 162 fit into and lie along the steps 182, 184, respectively, formed by a wider portion of the slot 117 in the area of the pivot pin. With the tails 172, 174 of the torsion spring 162 positioned along the steps 182,184, the cross bar 168 of the torsion spring 162 exerts a force on the arm portion 160 of the pawl 104 that biases the pawl 104 toward the open or unlatched configuration.

The solenoid body 122 receives a portion of the solenoid shaft 120. The locking member 106 is in the form of a plate that is positioned in a slot 142 in the outer end of the solenoid shaft 120 and is pinned to the outer end of the solenoid shaft 120 by the pin 144. The locking member 106 is positioned within the housing 102 and moves as a unit with the solenoid shaft. A spring 188 is provided intermediate the locking member 106 and the solenoid body 122. The spring 188 biases the locking member 106 and the solenoid shaft 120 into the extended position. When the locking member 106 is in the extended position and the pawl 104 is in the closed or latched position, the locking member 106 is positioned behind the lug 156 and prevents the pawl 104 from rotating to the open or unlatched position.

The latch assembly 100 is actuated by energizing the solenoid 108. The solenoid 108 may be energized using a remotely located switch (not shown). When the solenoid 108 is energized, the locking member 106 is retracted such that the locking member 106 is moved out of engagement with the projection or lug 156 thereby freeing up the pawl 104 for pivoting. The bias provided by the pawl torsion spring 162 rotates the pawl 104 from its latched position illustrated in FIGS. 1-8 and 10, where the rod-shaped portion 134 of the keeper 208 is cooperatively captured by the pawl slot 158 and the U-shaped indentation 112, toward its open configuration illustrated in FIGS. 11-14. The rotation of the pawl 104 brings the opening of the pawl slot 158 out from the portion of the slot 116 formed in the lateral side of the U-shaped indentation 112, such that the opening of the pawl slot 158 faces roughly toward the base 146 of the keeper member 208, thus allowing the keeper member 208 to be disengaged from the pawl 104. The panel 200 can then be opened by moving it to the open position.

Suitable mounting means are provided to retain the latch assembly 100 on a panel or mounting surface. For example, installation of the latch assembly 100 to a panel may be accomplished with nuts 230 and bolts 232 that pass through the housing 102 and the panel 200. In FIGS. 5-8 the latch 100 is attached to the side of the panel 200 facing away from the keeper 208. In this arrangement the rod-shaped portion 134 of the keeper 208 passes through the slot 234 to engage the latch 100. In FIGS. 15-18 the latch 100 is attached to the side of the panel 200 facing toward the keeper 208. In this arrangement the slot 234 is not necessary.

When the panel 200 is being closed, the opening of the pawl slot 158 faces toward the keeper 208 and is unobstructed by the lateral sides of the U-shaped indentation 112. As the panel 200 is slammed shut, the keeper 208 is received in the slot 158 and impacts the pawl 104 causing the rotation of the pawl 104 toward the closed configuration shown in FIGS. 1-8 and 10. At this time, even though the solenoid 122 may not be energized, the locking member 106 is partially retracted because the lug 156 and/or the pawl body 154 prevent movement of the locking member 106 to the fully extended position. As the pawl 104 rotates to the closed position, the lug 156 clears the locking member 106 allowing the locking member 106 to extend under the bias of spring 188 and move behind the lug 156. Once the locking member 106 is in the extended position it catches the flat side 180 of the projection 156 to keep the pawl 104 in the closed position illustrated in FIGS. 1-8 and 10, thus securing the panel 200 in the closed position.

If there is a strong load tending to force the panel 200 open, high lateral forces may cause the locking member 106 and the solenoid shaft 120 to bind due to excessive friction and the bending of the solenoid shaft 120, thus preventing the retraction of locking member 106 by the power available from the solenoid 108. To alleviate this means to support the locking member 106 close to its point of engagement with the pawl 104 have been provided. In addition, means for reducing the frictional resistance to the retraction of the locking member 106 have also been provided. In the embodiment of FIGS. 1-18, the rollers 236 provide both these functions. Each roller 236 has a large diameter portion 238 having small diameter portions 240 projecting from either side thereof. The lower housing portion 114 has two cavities 242 each shaped to matingly receive a portion of a respective roller 236. The upper housing portion 110 and is provided with a pair of cavities 244. Each cavity is shaped to receive a portion of at least the outer small-diameter roller portion 240 of a respective one of the rollers 236. As the upper housing portion 110 and the lower housing portion 114 are assembled together in clam-shell fashion, they cooperatively support the rollers 236 for rotational movement while leaving at least a portion of the outer surface of the large-diameter roller portions 238 unobstructed. The rollers 236 are position directly under the locking member 106, and the locking member 106 bears against the outer surface of the large-diameter roller portions 238. Thus the rollers 236 reduce friction between the locking member 106 and the housing 102 by providing for rolling friction therebetween. Also by supporting the locking member 106 near its load point, they reduce bending moments on the solenoid shaft 120.

As an alternative to the two rollers 236, a solid block made of a low friction material such as Dupont's DELRIN™ (an acetal homopolymer) or an acetal copolymer (e.g. CELCON®)) can be placed under the locking member 106 in a geometry similar to that illustrated for the embodiment of FIGS. 29-48 to both reduce friction and to support the locking member near its load point.

In addition to the solenoid 108, the latch 100 may be provided with a handle to manually operate the latch in the event the solenoid fails or there is no power to operate the solenoid. As an alternative or in addition to the handle, a mechanical key-operated lock plug can be incorporated into the design whereby rotation of the lock plug pushes the locking member 106, for example using some form of cam arrangement, out of engagement with the lug 156 to thereby allow the panel 200 to be opened in the event of an electrical power failure.

Referring to FIGS. 19-28, a second embodiment 100*a* of a latch assembly according to the present invention having three rollers can be seen. In operation the latch 100*a* is similar to the latch 100, except for the differences that are noted below. The latch 100*a* does not have a clamshell-type housing. Instead, the housing of the latch 100*a* is two-piece version of the housing of the latch disclosed in U.S. Provisional Patent Application No. 60/318,639, and the operation is virtually identical to that latch. In the latch 100*a*, the locking member or locking plate 106 is replaced with a U-shaped bracket 106*a* provided at the outer end of the solenoid shaft 120*a*. The bracket 106*a* rotationally supports three rollers 236*a*, 236*b* and 236*c*. Rollers 236*a* and 236*c* are large diameter rollers and roller 236*b* is a small diameter roller. Roller 236*b* is positioned between rollers 236*a* and 236*c* on a cylindrical shaft 236*d* that is supported by the bracket 106*a*. The rollers 236*a* and 236*c* are spaced far enough apart such that the flat surface 180*a* of the lug 156*a* of pawl 104*a* can bear against the outer surface of the roller 236*b*, in the closed configuration. The rollers 236*a* and 236*c* bear against the portion of the housing below the bracket 106*a*. The pawl 104*a* is released from the latched configuration when the solenoid is energized to withdraw the bracket 106*a* and consequently the roller 236*b* out of engagement with the lug 156*a* of the pawl 104*a*. Thus, the rollers 236*a*, 236*b*, 236*c* reduce friction between the locking member 106 and the housing 102 and between the locking member and the pawl, by providing for rolling friction between the locking member and both the housing and the pawl. Also by supporting the bracket 106*a* and shaft 236*d* near their load point, they reduce bending moments on the solenoid shaft 120*a*.

Referring to FIGS. 29-48 a third embodiment 100*b* of a latch assembly according to the present invention can be seen. In operation the latch 100*b* is similar to the latch 100, except for the differences that are noted below. The latch 100*b* has a solid support 241 for the locking member 106*b* to bear against at all times within the locking member's range of motion between retracted and extended positions. The solid support 241 is positioned on the side of the locking member 106*b* that is opposite the side that is in contact with the surface 180*b* of the pawl 104*b* in the closed configuration. Thus, the solid support 241 supports the locking member 106*b* near its load point and it thus reduces bending moments on the solenoid shaft 120*b* of the solenoid 108*b*. The solid support 241 may be integral with the housing 102*b* or it may be a separate piece that is attached to the housing 102*b*. The solid support 241 can be made from the same low friction materials mentioned previously herein.

In addition, the geometry of the embodiment of FIGS. 29-48, is different from the previous embodiments. In latch 100*b* the pawl has a pawl slot 158*b* and a lug 156*b* that defines a flat surface 180*b* for engagement with the locking member 106*b*. The pawl slot 156*b* has an imaginary centerline 250 that extends to intersect an imaginary plane 252 defined by the flat surface 180*b* of the lug 156*b* at an angle θ that is less than 180 degrees. Preferably, the angle θ is less than or equal to 120 degrees and more preferably the angle θ is less than or equal to 90 degrees. This pawl geometry allows the orientation of the U-shaped indentation 112*b* of the housing 102*b* to be changed such that the open end of the U-shaped indentation 112*b* is directed in a direction that is substantially less than 90 degrees from the longitudinal axis of the shaft or plunger 120*b* of the solenoid 108*b*. In the illustrated embodiment of FIGS. 29-48, the U-shaped indentation 112*b* is oriented such that the open end of the U-shaped indentation 112*b* is directed in a direction that is substantially the same as the longitudinal axis of the shaft or plunger 120*b* of the solenoid 108*b*.

As yet another alternative embodiment or in combination with some of the features disclosed above, it is also possible to provide a roller rotatably supported by the lug 156 for contact with the locking member 106.

Figure 49:
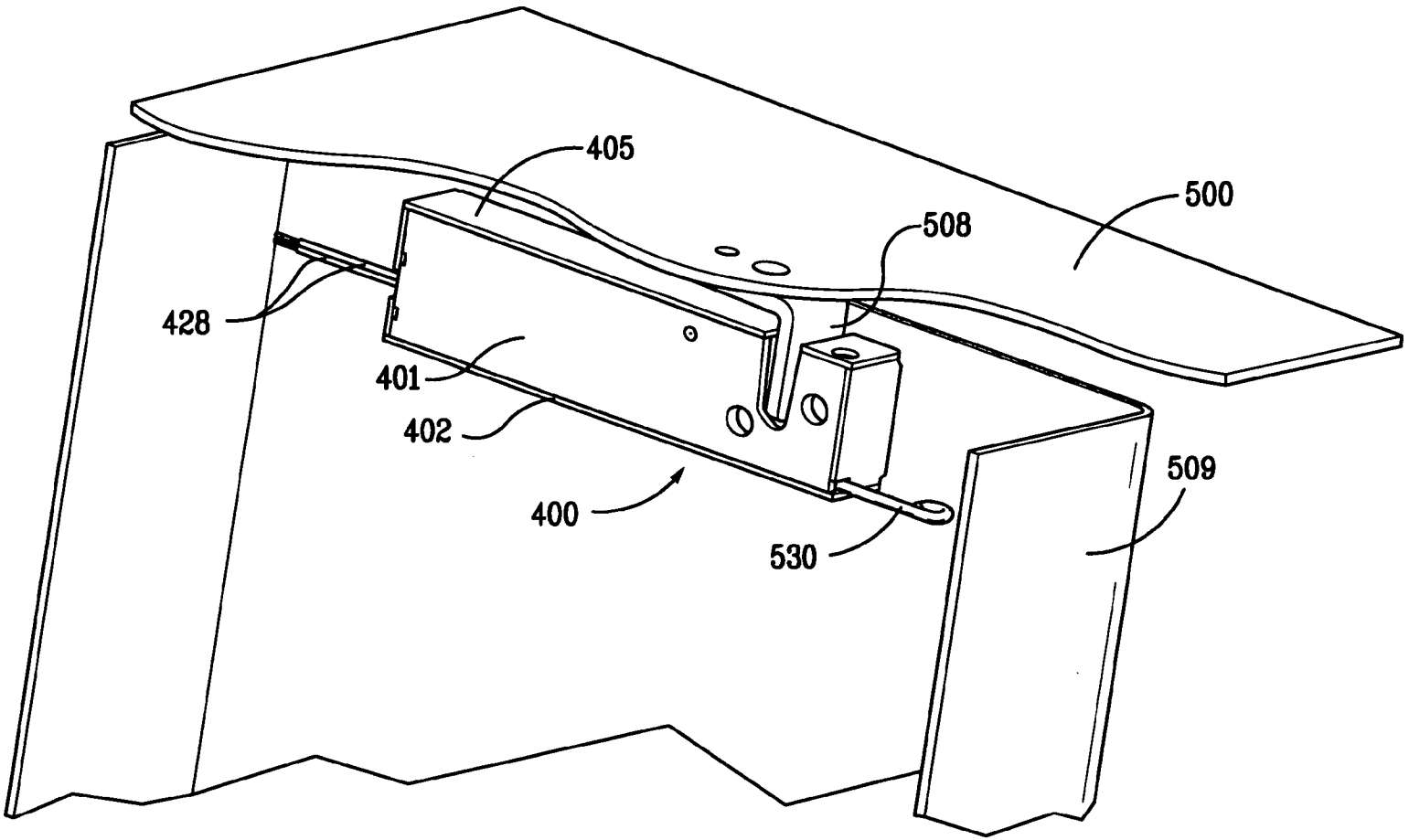
FIG. 49 is an environmental view of a fourth embodiment of a latch assembly according to the present invention shown in the latched configuration.
Figure 105:
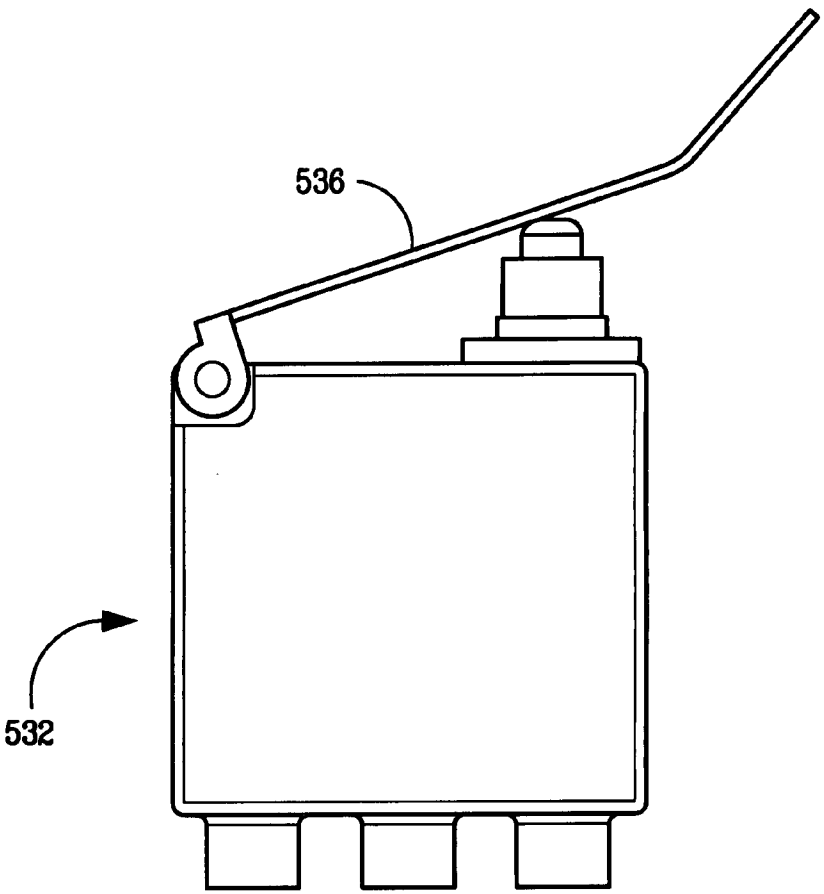
FIGS. 104-105 are views of the micro switch used with the fourth embodiment of a latch assembly according to the present invention.
Figure 104:
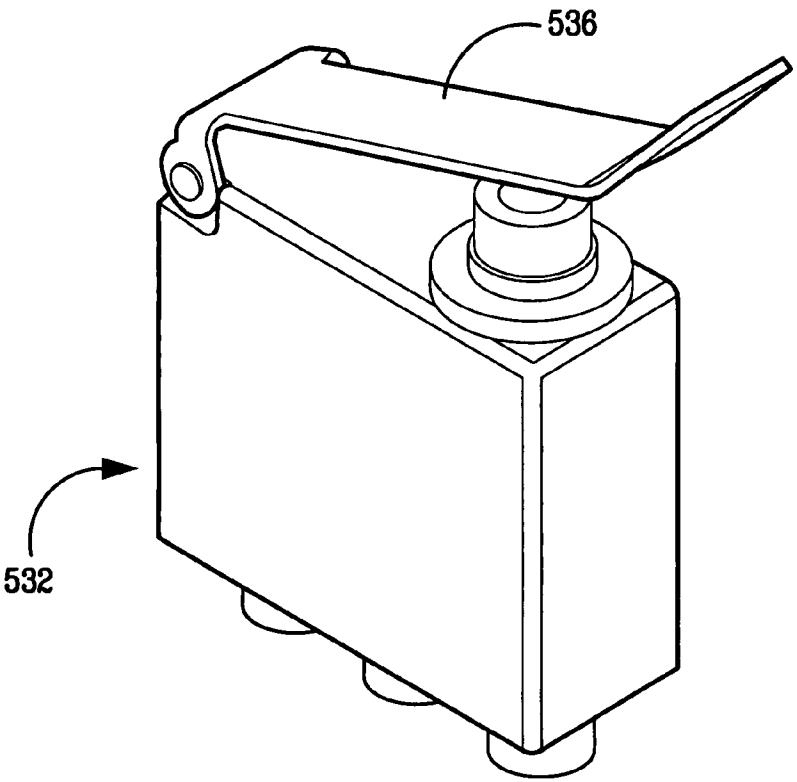

Referring to FIGS. 49-105, a latch 400 in accordance with a first embodiment of the present invention can be seen. The latch 400 includes a latch housing 402, a pawl 404, a trigger 406, and actuation means for selectively moving the trigger out of engagement with the pawl. In the illustrated embodiment, an electrically operated actuator assembly 408 serves as the actuation means for selectively moving the trigger out of engagement with the pawl.

The latch 400 is generally applicable wherever one or more closure members need to be secured in a certain position. The latch 400 can be used together with the striker 508 to secure any two closure members together. In the illustrated example, the latch 400 is shown being used for securing a panel 500 relative to a compartment 509. Further, the latch 500 can be mounted to either the movable member or the stationary member. In addition, the latch 400 may be mounted in any orientation depending upon the particular application.

Preferably, the housing 402 is in the form of a box that receives the various components of latch 400. The latch 400 may also be provided with spacers 411 and 413, and the multi-compartment tray 415 that help to properly support and position the various components of the latch within the housing 402, as well as adding greater overall strength to the latch 400. The tray 415 has a channel 417 that guides the linear movement of the slide 418 and a compartment 419 that houses the motor 410. A portion of the screw 416 is positioned in channel 417 and another portion is positioned in compartment 419. The partition 421 separating the channel 417 from compartment 419 has a slot 423 through which a portion 425 of the screw 416 extends. The screw 416 includes annular collars 511 and 513 on either side of the portion 425. The collars 511 and 513 cooperate with the partition 421 to essentially prevent linear axial displacement of the screw 416 in the direction of its longitudinal axis.

The housing 402 has a cover plate 401 that allows the housing 402 to be opened for the installation of the various components of the latch 400. Furthermore, the housing must be adapted to allow an unobstructed path to the pawl slot 458 when the pawl 404 is in the open configuration. The housing 402 has an opening that allows at least a portion of the striker 508 to enter the housing 402 for engagement by the pawl 404. In the illustrated example, the opening is in the form of a slot 412 that passes through the cover plate 401, the bottom 403 of the housing, and one of the walls 405 of the housing that extends between the cover plate 401 and the bottom 403. The slot 412 forms an open, approximately U-shaped indentation or recess in the housing 402 as viewed in profile. The slot 412 allows at least a portion of the striker 508 to enter the housing 402 for engagement by the pawl 404. The slot 412 allows an unobstructed path to the pawl slot 458 when the pawl 404 is in the open configuration. The slot 412 is sized such that the housing 402 will not interfere with the movement of the striker 508 relative to the housing 402 as the pawl 404 is moved from the open configuration to the closed configuration by contact with the striker 508.

The electrically operated actuator assembly 408 includes a motor 410, a bow-tie coupler 414, a screw 416, and a slide 418. In the illustrated embodiment the motor 410 is a direct current (DC) motor that has an output shaft 420 that normally rotates in response to the motor being energized. Reversing the polarity of the current supplied to the DC motor 410 causes the direction of rotation of the output shaft 420 to be reversed. The motor 410 is received in the housing 402 and is installed at a fixed location therein. The bow-tie coupler 414 is attached to the output shaft 420 such that the bow-tie coupler 414 rotates with the shaft 420 as a unit during normal operation of the latch 400. The bow-tie coupler 414 is located near the end of the output shaft 420. The screw 416 has a threaded portion 424 and a coupling portion 422. The coupling portion 422 forms the end of the screw 416 that is closest to the motor 410. The coupling portion 422 includes a pair of finger-like projections 426 that are offset from the central longitudinal axis of the screw 416 and extend in parallel to the central longitudinal axis of the screw 416 toward the motor 410. The bow-tie coupler 414 has a hub 429. In the assembled latch 400, the hub 429 of the bow-tie coupler 414 fits between the projections 426 with the hub's axis of rotation being coaxial with the central longitudinal axis of the screw 416. The bow-tie coupler 414 also has wings 427 that extend radially outward from the hub 429. The wings 427 are positioned between the projections 426 in terms of their angular position about the axis of rotation of the bow-tie coupler 414 and the central longitudinal axis of the screw 416, which are coincident. Thus, rotation of the bow-tie coupler 414 brings the wings 427 into engagement with the projections 426 to thereby cause the rotation of the screw 416 about its longitudinal axis. Because the bow-tie coupler 414 rotates with the shaft 420 as a unit, the rotation of the shaft 420 being transmitted to the screw 416 via the engagement between the bow-tie coupler 414 and the coupling portion 422 of the screw 416. Thus, rotation of the shaft 420 causes rotation of the screw 416 in the same direction as the shaft 420. The longitudinal axis of the motor 410, the axis of rotation of the shaft 420, the longitudinal axis of the shaft 420, the axis of rotation of the bow-tie coupler 414, the axis of rotation of the screw 416, and the central longitudinal axis of the screw 416 are all coincident in the illustrative embodiment represented by the latch 400.

The threaded portion 424 of the screw 416 is in the form of a threaded shaft extending from the coupling portion 422 in a direction away from the motor 410. The threaded portion 424 of the screw 416 is provided with male, triple-lead, helical thread of relatively large lead. The slide 418 has a bore 431 extending at least part way through its length in the direction of the longitudinal axis of the screw 416. In the illustrated example, the bore 431 passes completely through the slide 418. The bore 431 is provided with female, triple-lead, helical thread of relatively large lead that matches the thread of the threaded portion 424 of the screw 416. The slide 418 is installed in the housing 402 with the bore 431 coaxial with the screw 416. In the assembled latch 400 the threaded portion 424 of the screw 416 extends at least in part into the bore 431 of the slide 418 with the thread of the screw 416 in engagement with the thread of the bore 431 at all times. Thus, rotation of the screw 416 causes linear displacement of the slide 418 in a direction parallel to the central longitudinal axis of the screw 416. Helical thread of large lead is preferred so that the desired linear displacement of the slide 418 can be obtained with only a few rotations or a fraction of a rotation of the screw 416.

The slide 418 is linearly movable between retracted and extended positions in response to the rotation of the screw 416. In the retracted position the slide 418 is closest to the coupling portion of the screw 416 and in the extended portion the slide 418 is farthest from the coupling portion of the screw 416. In the illustrated embodiment, the threaded portion of the screw 416 does not extend completely through the bore 431, although it is possible that in other operable embodiments of the invention the screw 416 could extend completely through the bore 431. In the illustrated embodiment, the threaded portion 424 of the screw 416 extends into the bore 431 to a first extent when the slide 418 is in the retracted position, and the threaded portion 424 of the screw 416 extends into the bore 431 to a second extent when the slide 418 is in the extended position. The extent to which the threaded portion 424 of the screw 416 extends into the bore 431 is greater when the slide 418 is in the retracted position as compared to when the slide is in the extended position. In other words, the first extent is greater than the second extent. The difference between the first extent and the second extent is equal to the linear displacement of the slide 418. Electrical energy is supplied to the motor 410 through the wires 428.

The latch assembly 400 also includes a pawl 404 shown pivotally connected to the latch housing 402 with suitable attachment means such as the pawl pivot pin 438 that passes through the hole 440 in the pawl 404. The cover plate 401 and the bottom 403 of the housing 402 are each provided with a hole 432 and 433 for receiving the ends of the pivot pin 438 as the cover plate 401 and the open-box-like portion of the housing 402 are assembled together. Thus, the pawl 404 is rotationally supported by the housing 402.

The pawl 404 has a surface 454 near a corner of the pawl 404 provided for engagement by the trigger 406. This trigger engaging surface 454 is part of a notch 456 located at the same corner of the pawl 404. The pawl 404 is provided with a pawl slot 458 to retain the striker 508 when the pawl 404 is in the latched position. In the illustrated example, the striker 508 has a rod-shaped portion 434 that engages the pawl slot 458 as the panel 500 is moved to the closed position relative to the compartment 509. When the panel 500 is closed, the rod-shaped portion 434 of the striker 508 will be positioned or caught in the pawl slot 458 with the pawl 404 in the latched position. The pawl 404 is also provided with a second notch 460 the function of which is explained later.

A pawl torsion spring 462 is installed in the housing 402 with the coiled portion 464 of the torsion spring 462 surrounding the pivot pin 438. An arm 468 of the torsion spring 462 engages the notch 460 in the pawl 404. The torsion spring 462 also has a second arm 472 that engages a wall 466 of the housing 402.

With the arm 472 of the torsion spring 462 in engagement with the wall 466 of the housing 402, the arm 468 of the torsion spring 462 exerts a force on the pawl 404 that biases the pawl 404 toward the open or unlatched position.

The trigger 406 is in the form of an L-shaped member that is pivotally supported in the housing 402. The pivot axis of the trigger 406, as defined by the trigger pivot pin 470, is parallel to the pivot axis or axis of rotation of the pawl 404. Furthermore, the pivot axis of the trigger 406, as defined by the trigger pivot pin 470, is spaced apart from the pivot axis or axis of rotation of the pawl 404. The trigger 406 is pivotally movable between an engaged position and a disengaged position and is spring biased toward the engaged position. A trigger spring 488 is provided for biasing the trigger 406 toward the engaged position. The trigger spring 488 is a torsion spring and has a coiled portion 474, a first arm 476, and a second arm 478. The trigger spring 488 is installed in the housing 402 with the coiled portion 474 of the torsion spring 488 surrounding the trigger pivot pin 470. The arm 476 of the torsion spring 488 engages the slot 482 in the trigger 406. The second arm 478 of the torsion spring 488 engages the wall 405 of the housing 402.

The trigger 406 has a first lever arm 484 and a second lever arm 486 joined together at approximately a right angle to form an "L" shape. In the illustrated embodiment, the second lever arm 486 is longer than the first lever arm 484. The trigger pivot pin 470 passes through a hole in the trigger 406 near the joint between the second lever arm 486 and the first lever arm 484. The second lever arm 486 is positioned intermediate the slide 418 and the pawl 404. The first lever arm 484 has a distal end 490 located distally from the pivot axis of the trigger 406 and/or from the second lever arm 486. The distal end 490 of the first lever arm 484 engages the surface 454 to hold the pawl 404 in the latched position when the trigger 406 is in the engaged position. As the slide 418 moves from the retracted to the extended position, the slide 418 engages the second lever arm 486 and causes the trigger 406 to pivotally move to the disengaged position where the trigger 406 no longer engages the pawl 404. When the trigger 406 is in the disengaged position, the distal end 490 of the first lever arm 484 is disengaged from the surface 454 and the pawl 404 is free to rotate under spring bias to the unlatched position. The rod-shaped portion of the striker 508 can now be withdrawn from the pawl slot 458 and the panel 500 can be moved to the open position. As the trigger 406 is pivotally moved to the disengaged position, the end of the second lever arm 486 distal from the first lever arm 484 is moved toward the pawl 404.

The trigger spring 488 biases the trigger 406 toward the engaged position, such that when the slide is moved to the retracted position, the trigger 406 will tend to reengage the pawl 404 if the pawl 404 is rotated to the latched position. If the panel 500 is again moved to the closed position relative to the compartment 509, the rod-shaped portion of the striker 508 will impact the pawl slot 458 and cause the rotation of IS the pawl 404 to the latched position. Once the pawl 404 is in the latched position, the pawl can again be engaged by the trigger 406 to thereby retain the pawl in the latched position and secure the panel 500 in the closed position.

Figure 56:
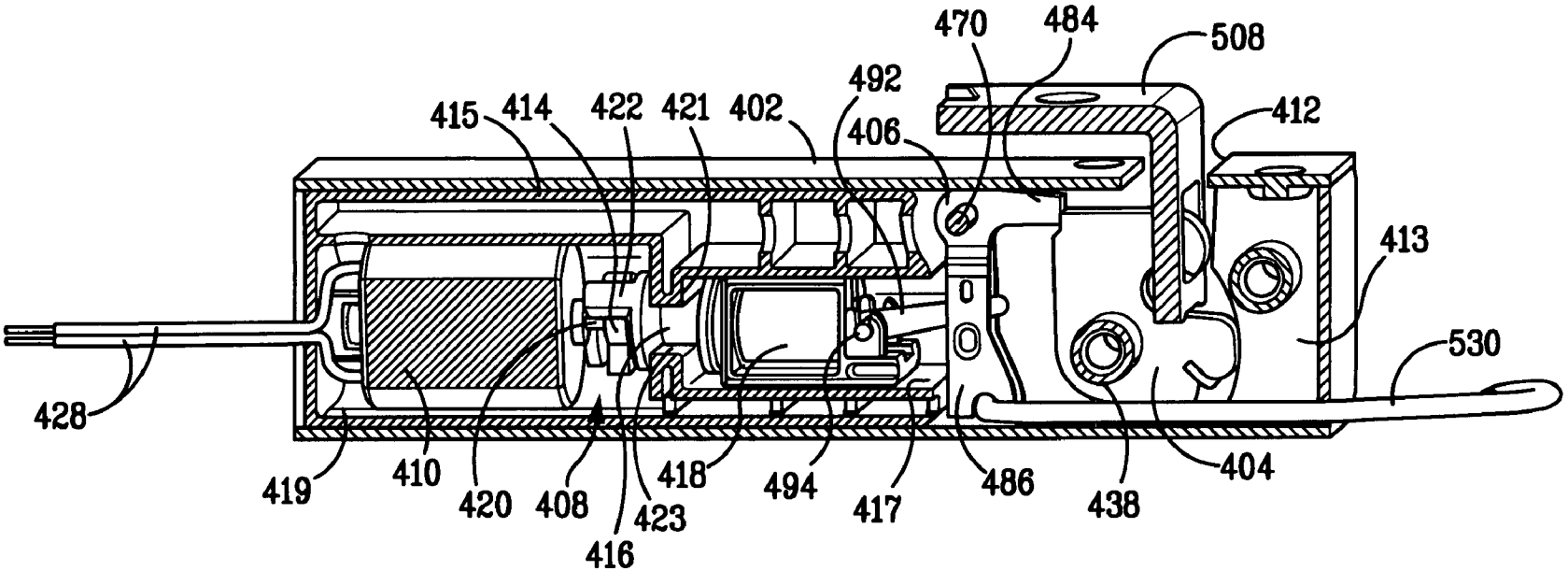
FIGS. 56-60 are cross sectional views of the fourth embodiment of a latch assembly according to the present invention shown in various stages of operation starting with the latched configuration and ending with the unlatched configuration.
Figure 57:
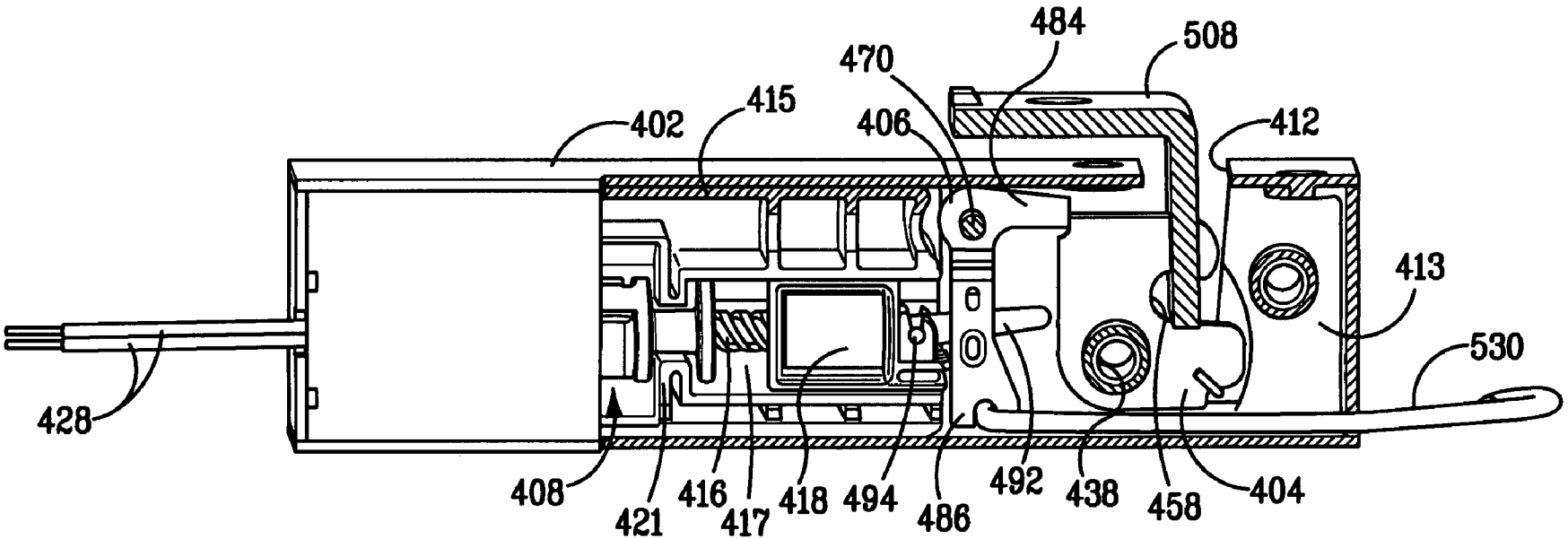
Figure 58:
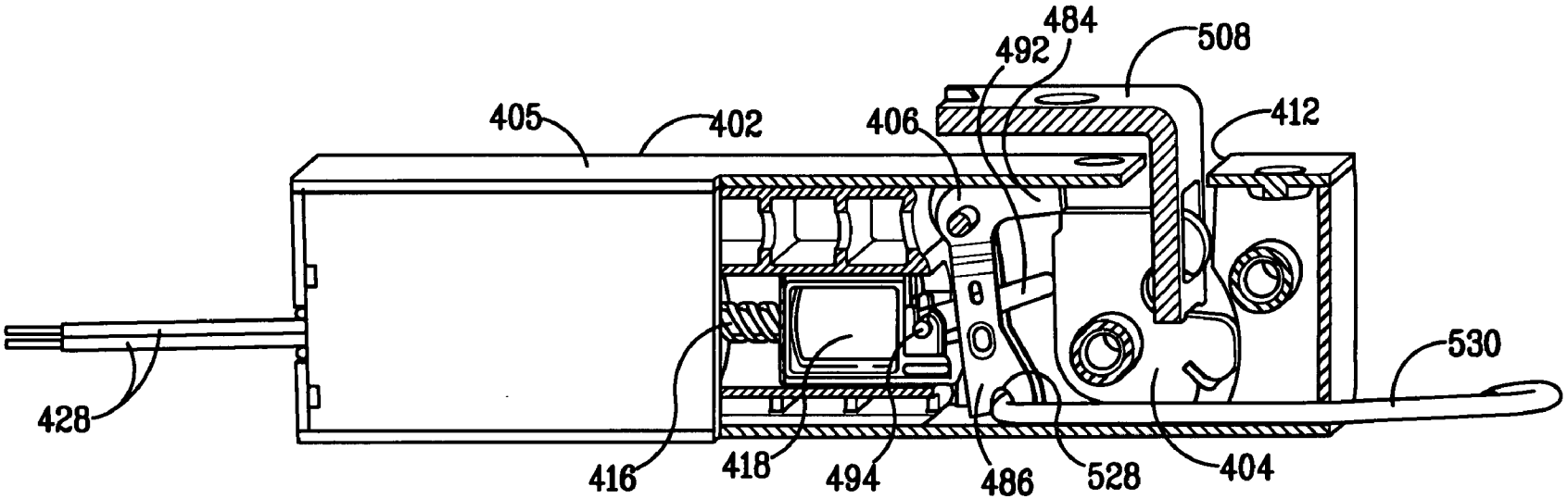
Figure 59:
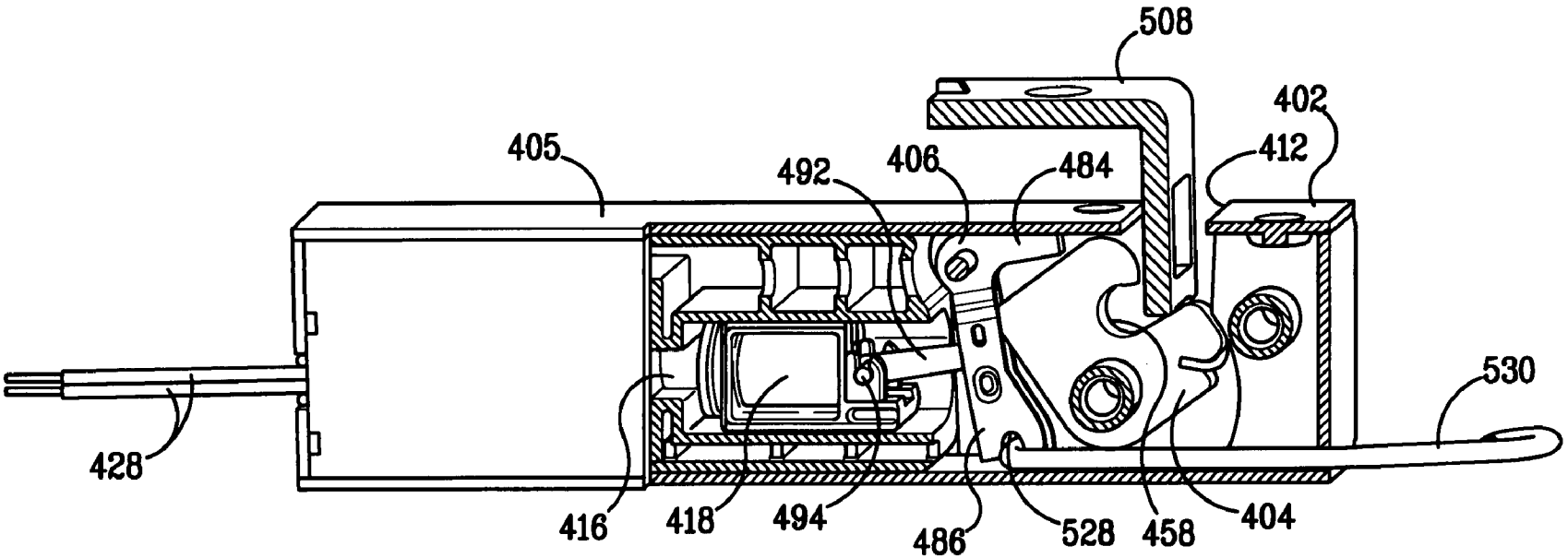
Figure 60:
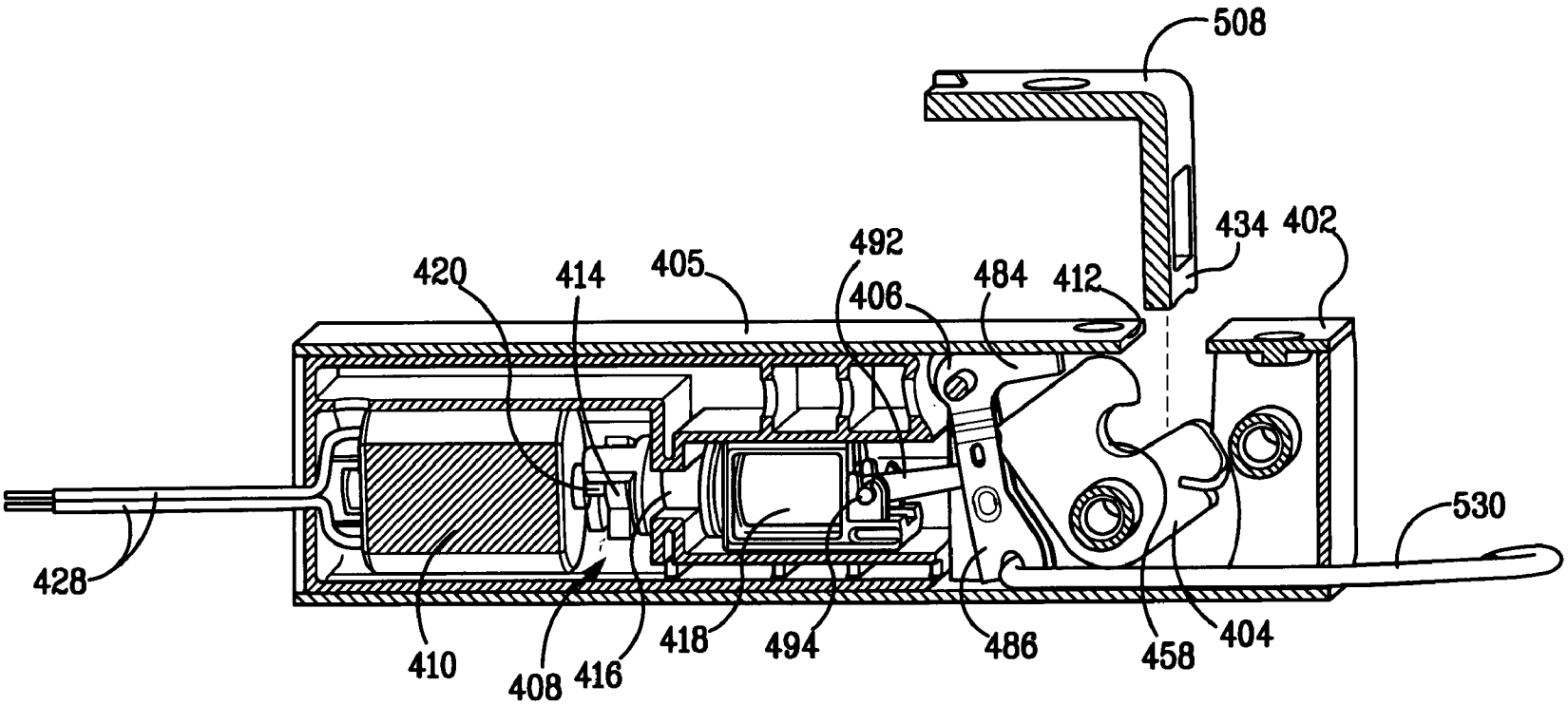
Figure 62:
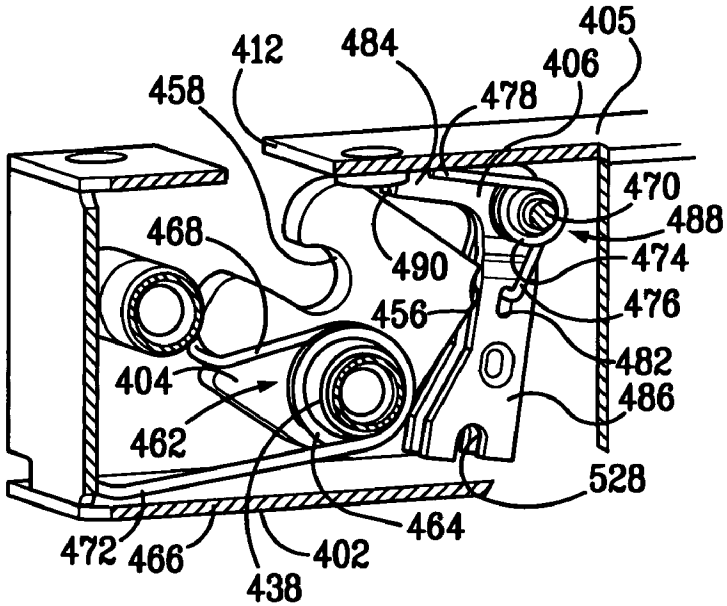
FIGS. 61-62 are fragmentary views of the fourth embodiment of a latch assembly according to the present invention showing the geometry of the pawl and trigger springs in the latched configuration and in the unlatched configuration.

The latch assembly 400 is actuated by energizing the motor 410. The motor 410 may be energized using a remotely located switch (not shown). The slide 418 is normally in the retracted position when the panel 500 is secured in the closed position. When the motor 410 is energized, the screw 416 is rotated counter clockwise causing the slide 418 to be linearly displaced to the extended position. As the slide 418 moves to the extended position, the slide impacts the second lever arm 486 of the trigger 406 and causes the trigger 406 to move to the disengaged position thereby freeing up the pawl 404 for pivoting. The bias provided by the pawl torsion spring 462 rotates the pawl 404 from its latched position illustrated in FIG. 56, where the rod-shaped portion 434 of the striker 508 is captured by the pawl slot 458, toward its unlatched position illustrated in FIG. 60. The rotation of the pawl 404 moves the opening of the pawl slot 458 such that the opening of the pawl slot 458 substantially registers with the slot 412 of the housing 402, thus allowing the striker 508 to be disengaged from the pawl 404. The panel 500 can then be opened by moving it to the open position.

Figure 50:
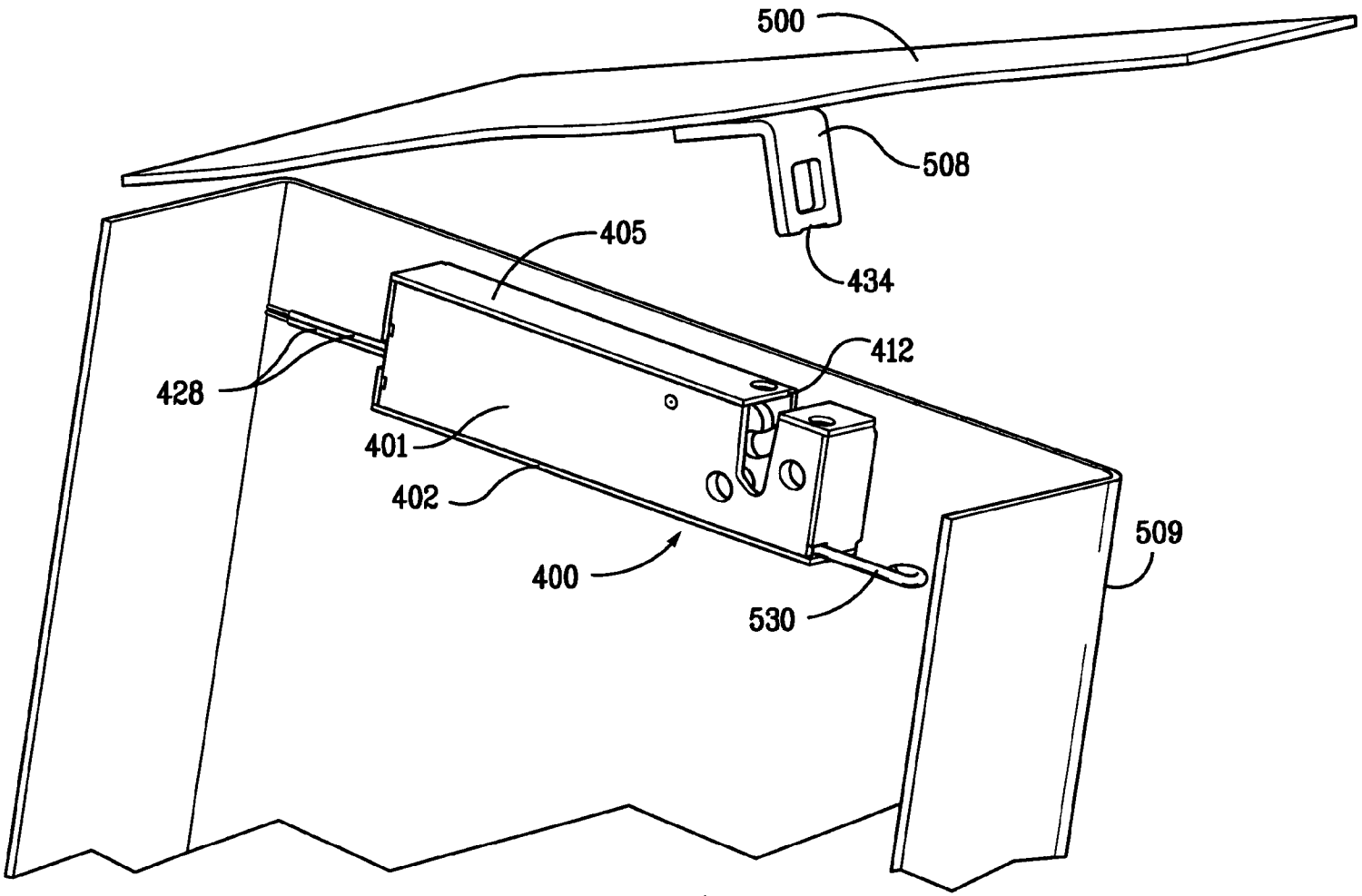
FIG. 50 is an environmental view of a fourth embodiment of a latch assembly according to the present invention shown in the unlatched configuration.
Figure 51:
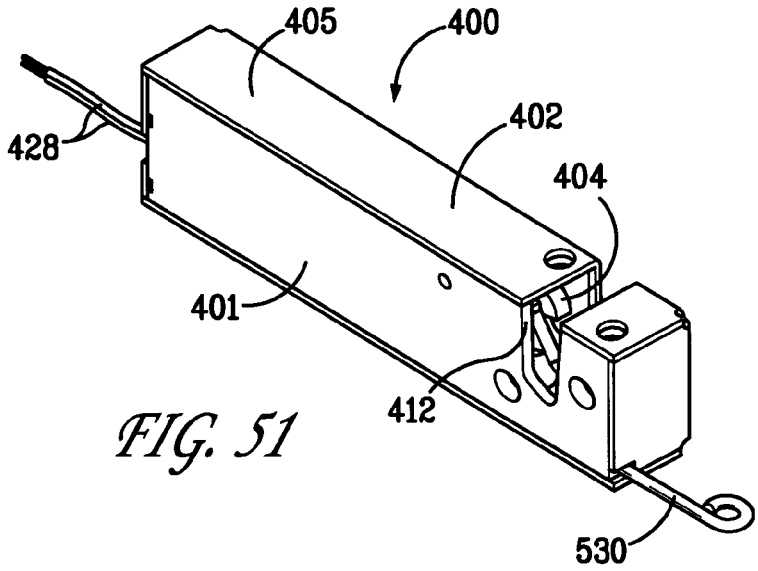
FIGS. 51-52 are views of a fourth embodiment of a latch assembly according to the present invention shown in the unlatched configuration.
Figure 52:
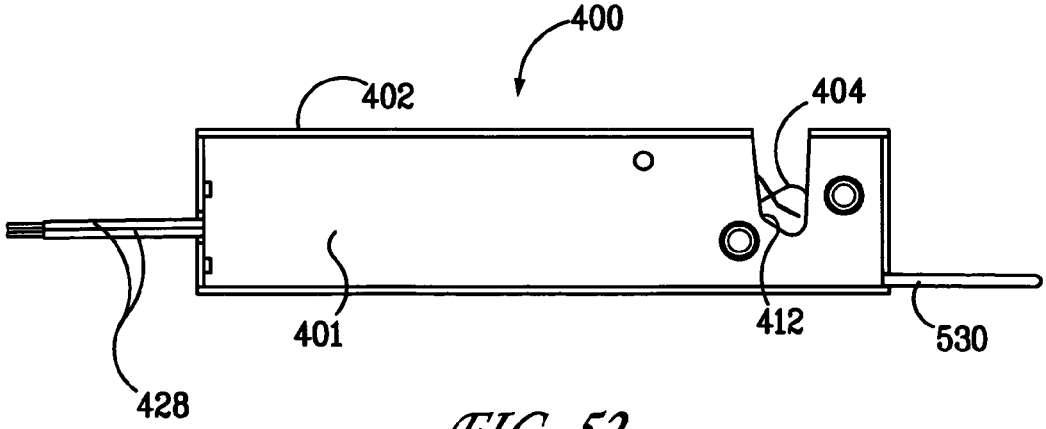
Figure 53:
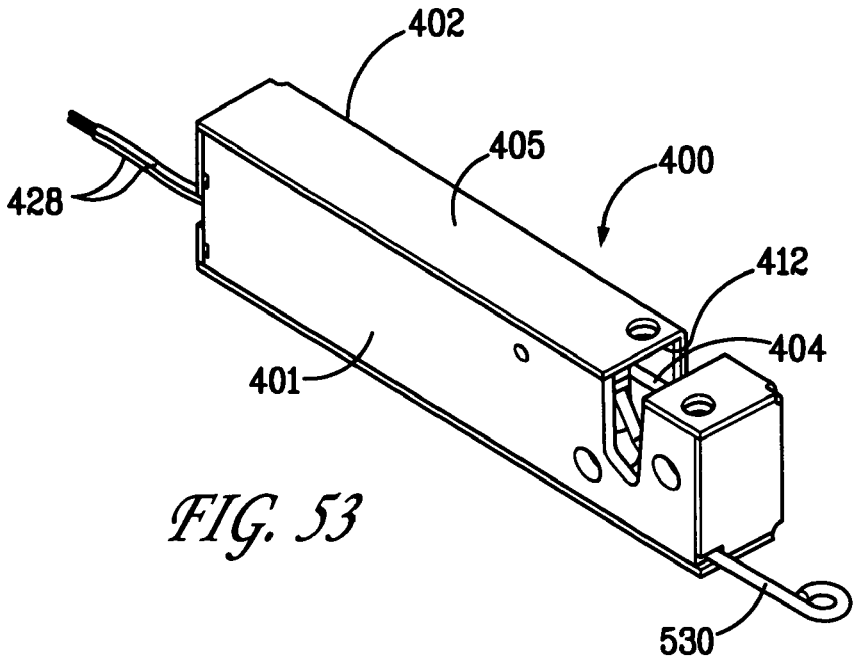
FIGS. 53-54 are views of a fourth embodiment of a latch assembly according to the present invention shown in the latched configuration.
Figure 54:
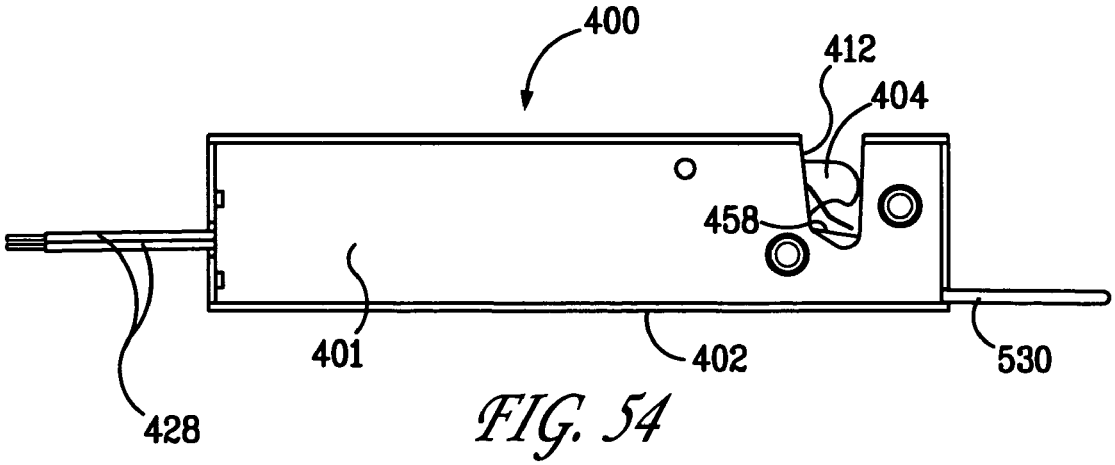
Figure 55:
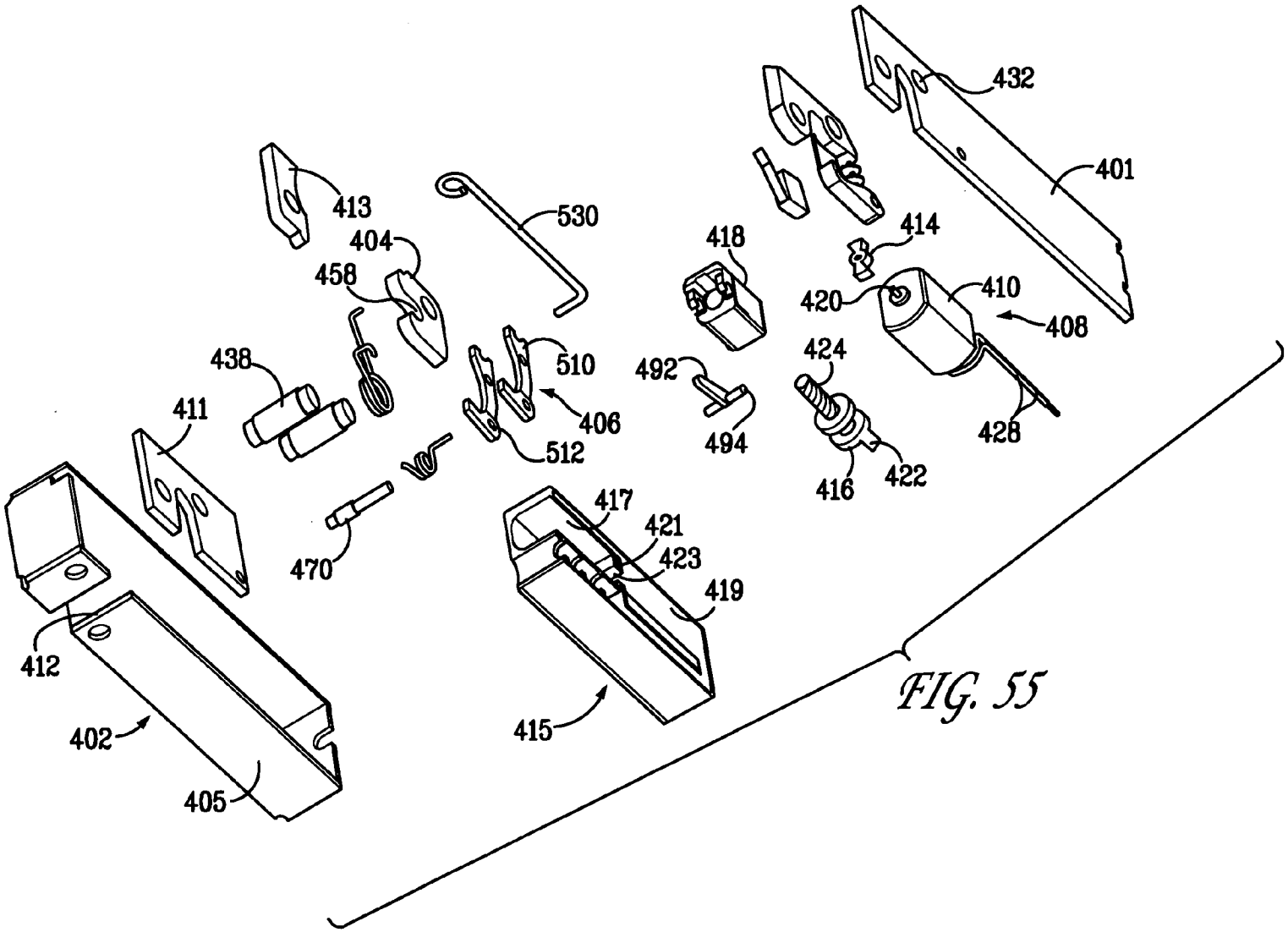
FIG. 55 is an exploded view of the fourth embodiment of a latch assembly according to the present invention.

The latch assembly 400 can be mounted on a panel or mounting surface, such as the frame surrounding the opening of the compartment 509, using a variety of well-known fasteners. For example, installation of the latch assembly 400 to a supporting surface may be accomplished with screws that pass through holes in the bottom of the housing 402 and engage threaded holes in the supporting surface. In FIGS. 49-50 the latch 400 is attached to the frame surrounding the opening of the compartment 509. In this arrangement the striker 508 is mounted to the panel 500 such that, as the panel 500 is closed over the opening of the compartment 509, the rod-shaped portion 434 of the striker 508 passes through the slot 412 to engage the pawl slot 458.

Figure 61:
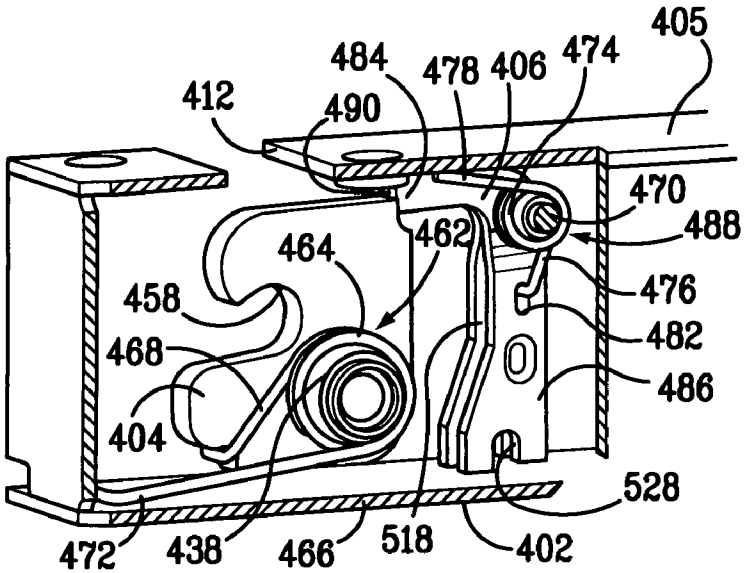
Figure 63:
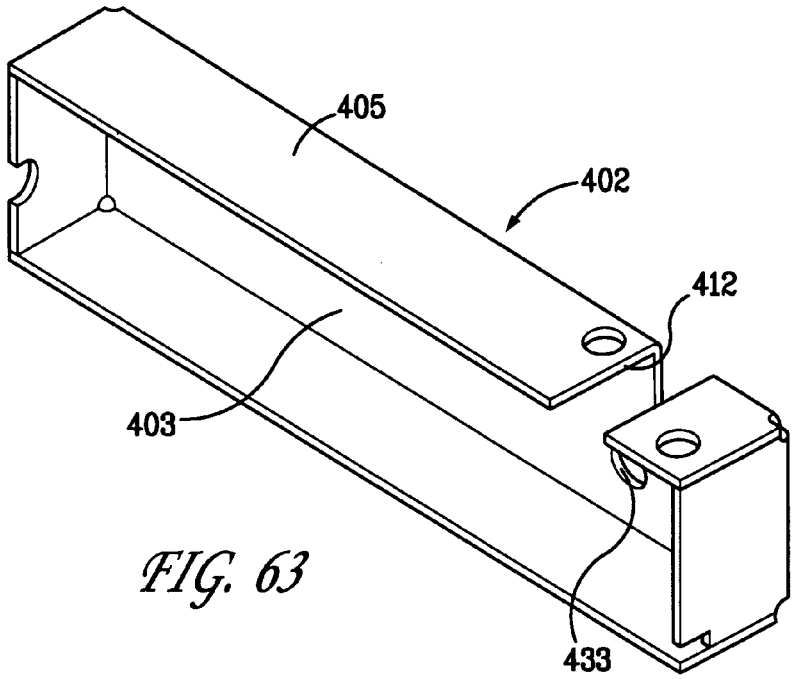
FIGS. 63-64 are views of the housing of the fourth embodiment of a latch assembly according to the present invention.
Figure 64:
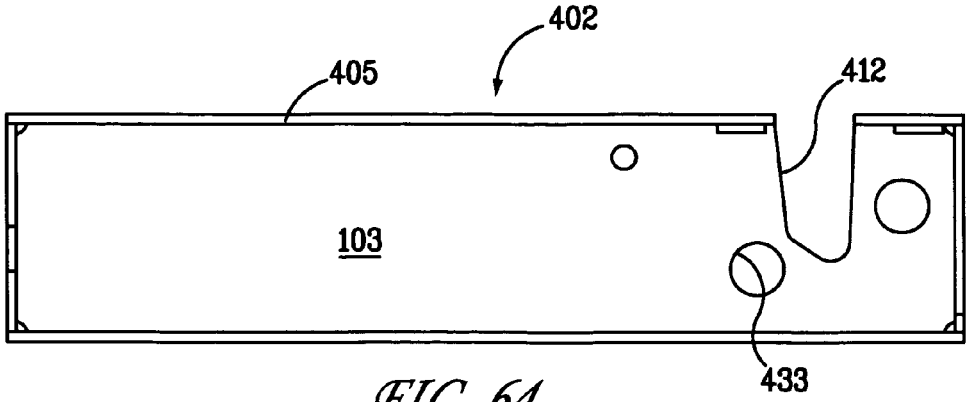
Figure 65:
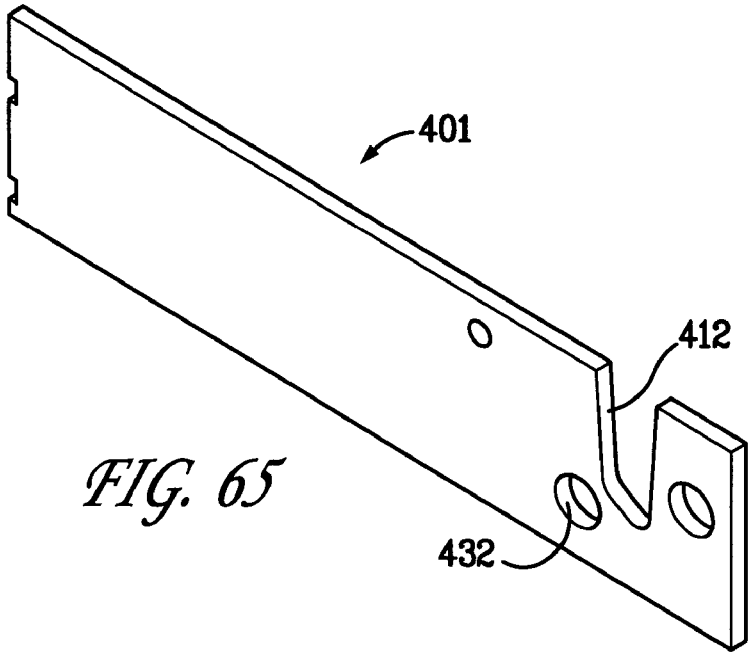
FIGS. 65-66 are views of the housing cover plate of the fourth embodiment of a latch assembly according to the present invention.
Figure 66:
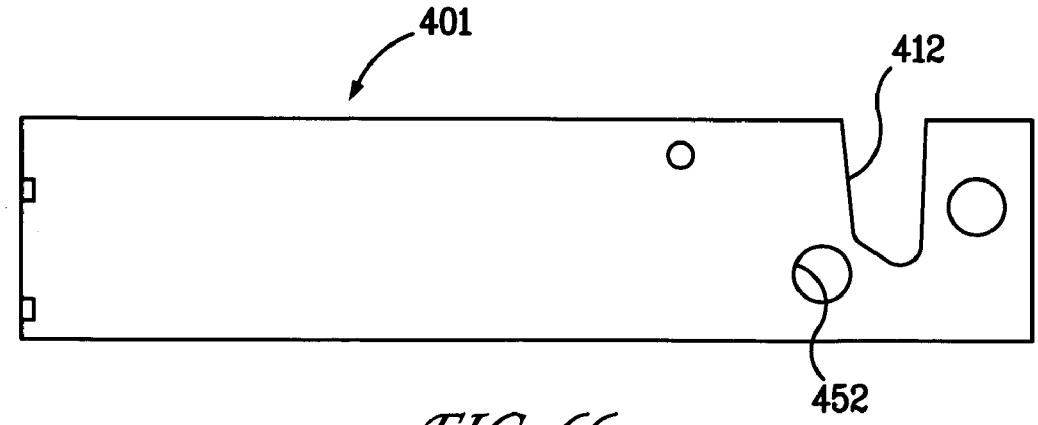
Figure 67:
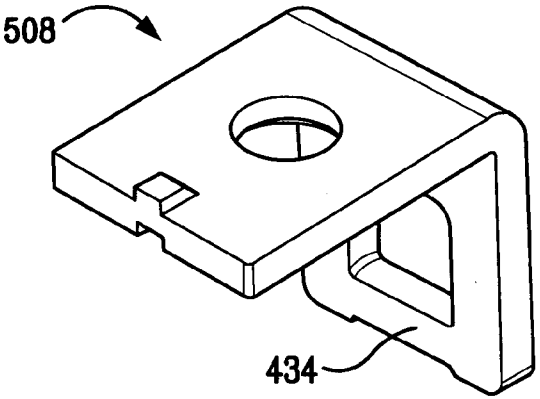
FIGS. 67-69 are views of a striker for use with a latch assembly according to the present invention.
Figure 69:
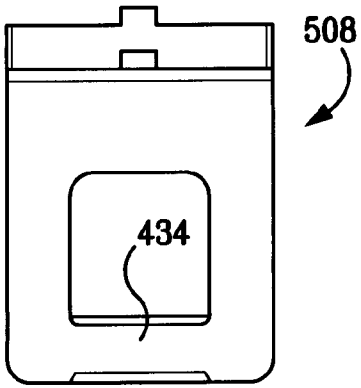
Figure 68:
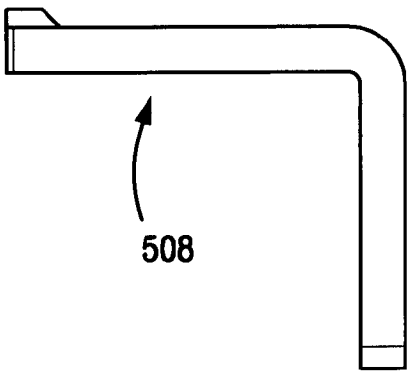
Figure 71:
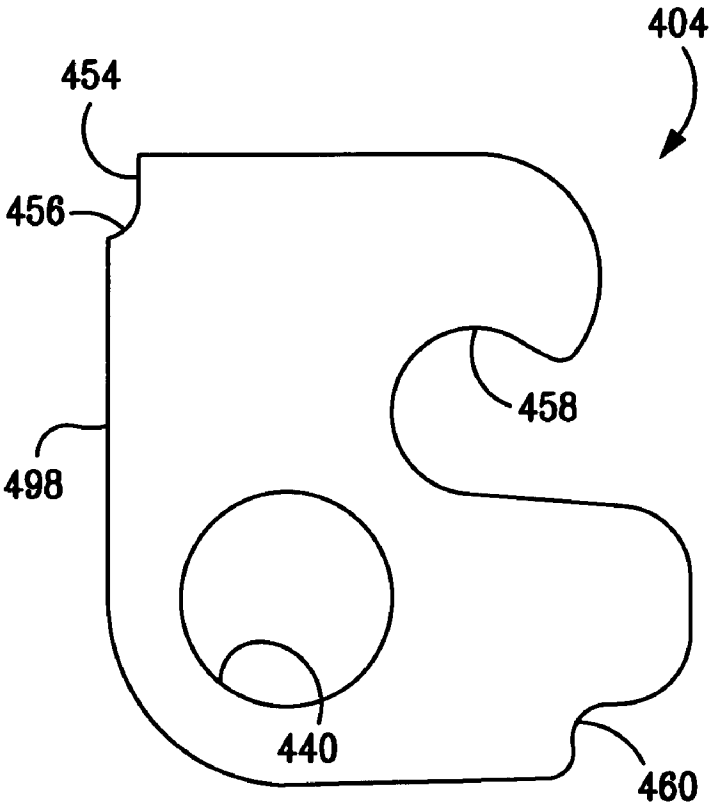
FIGS. 70-71 are views of the pawl of the fourth embodiment of a latch assembly according to the present invention.
Figure 70:
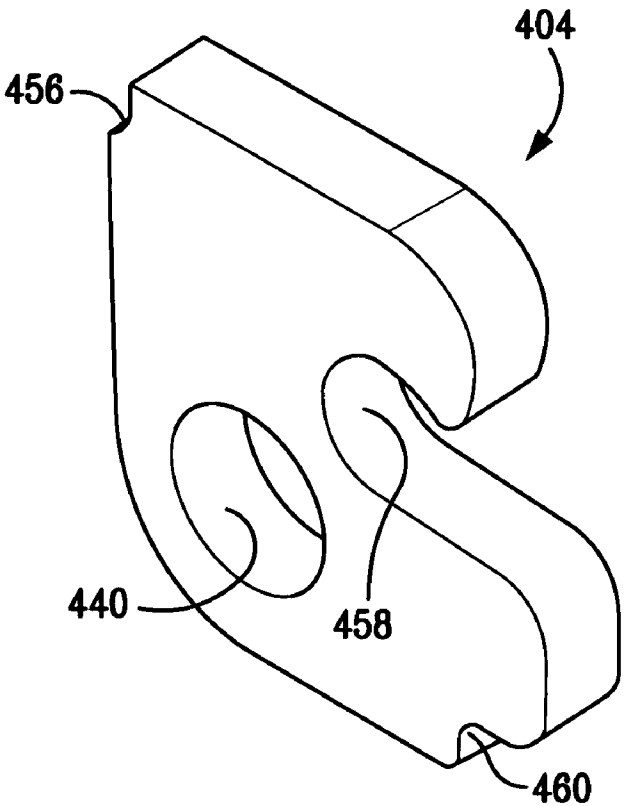
Figure 72:
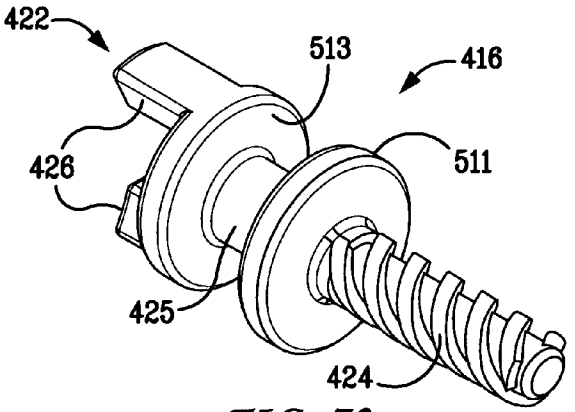
FIGS. 72-76 are views of the screw of the electrically operated actuator assembly of the fourth embodiment of a latch assembly according to the present invention.
Figure 73:
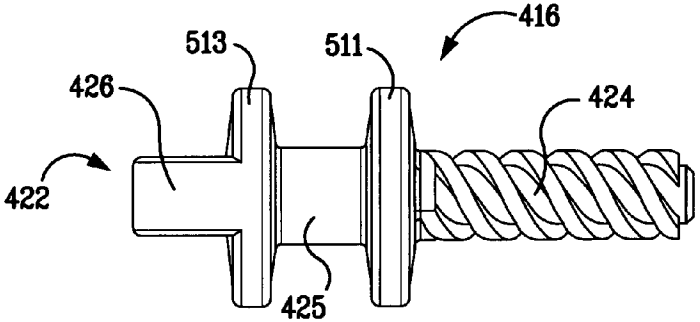
Figure 74:
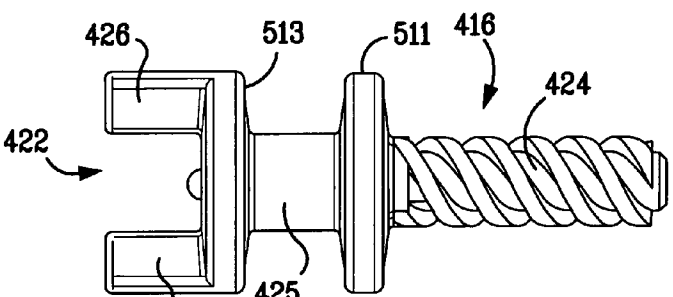
Figure 75:
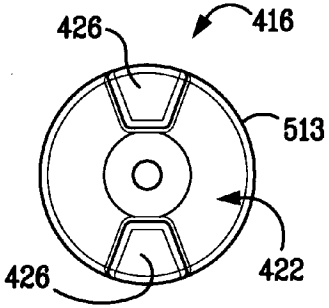
Figure 76:
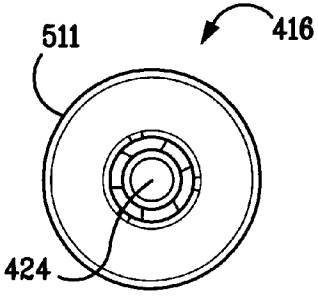
Figure 100:
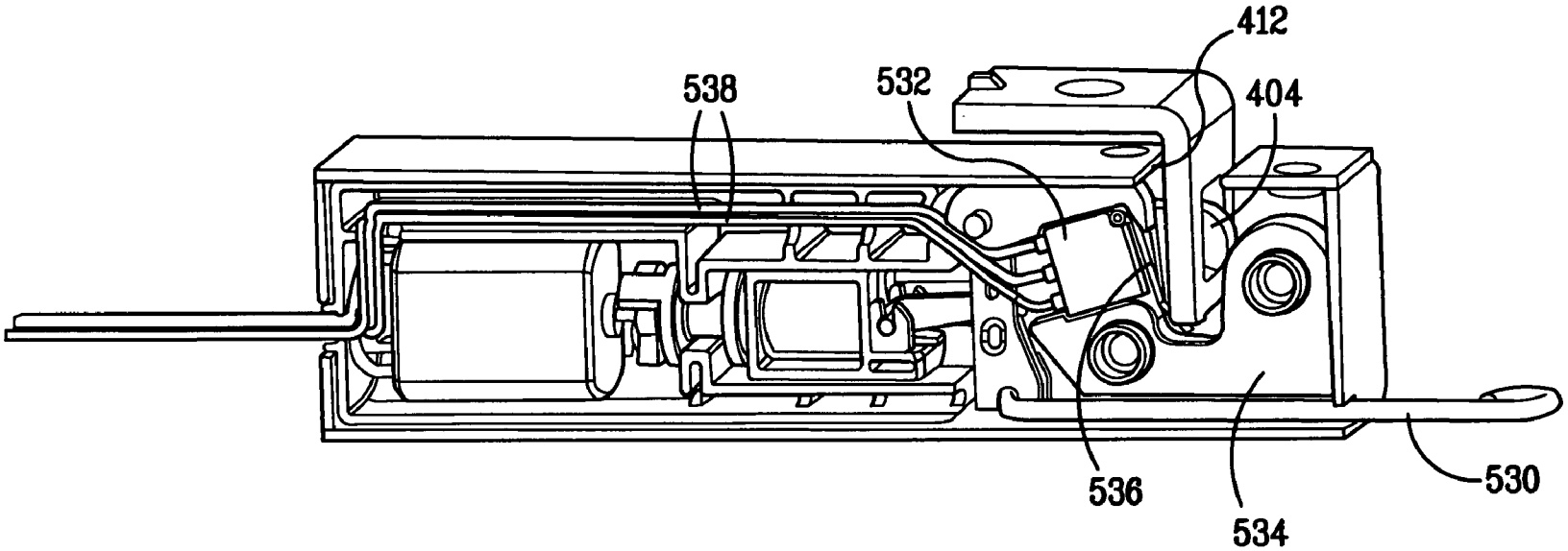
FIG. 100 is an environmental view of a fourth embodiment of a latch assembly Is according to the present invention shown in the latched configuration with the housing cover removed to show the micro switch.
Figure 101:
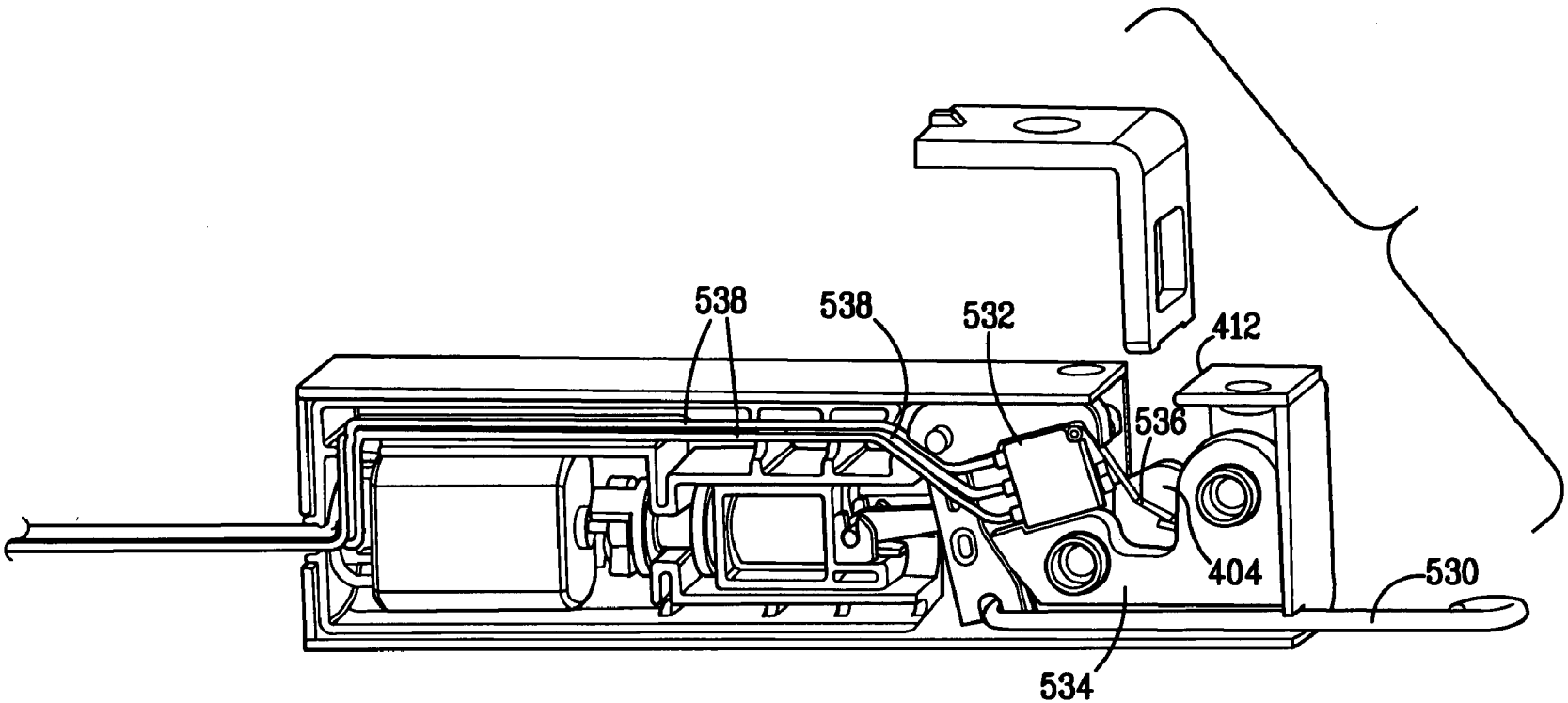
FIG. 101 is an environmental view of a fourth embodiment of a latch assembly according to the present invention shown in the unlatched configuration with the housing cover removed to show the micro switch.
Figure 103:
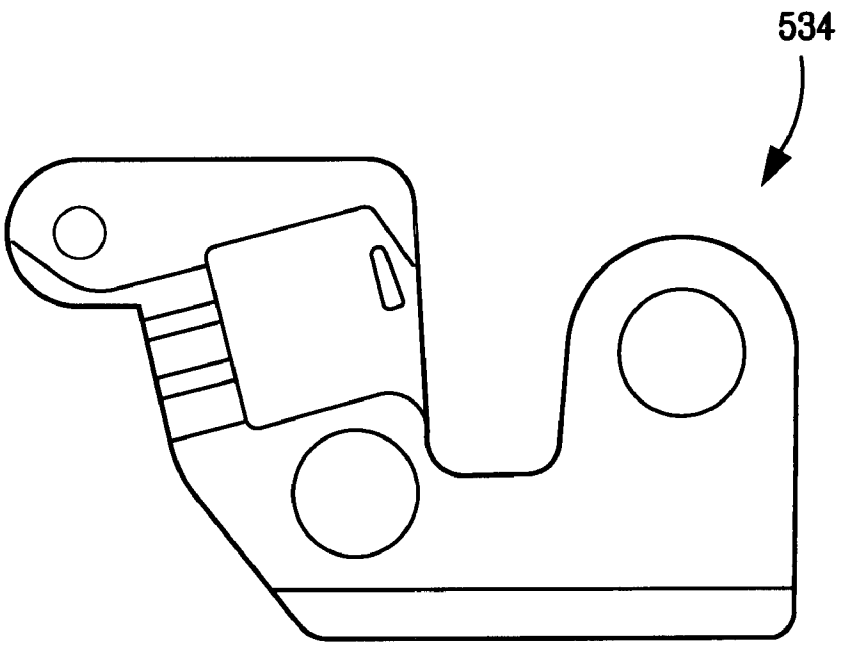
FIGS. 102-103 are views of the micro switch housing of the fourth embodiment of a latch assembly according to the present invention.
Figure 102:
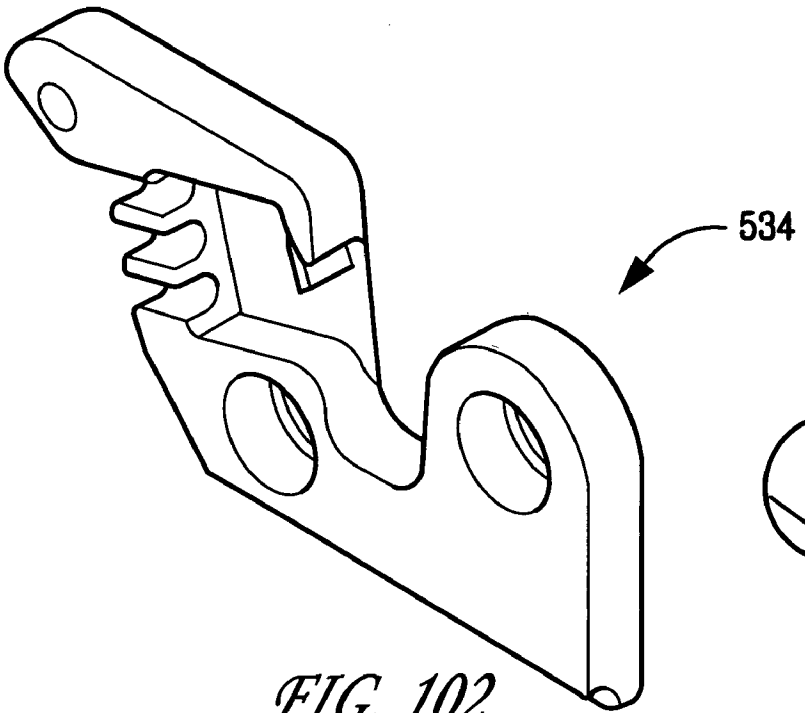

Before the panel 500 can be secured in the closed position once again, the slide 418 must be returned to its retracted position so that the trigger 406 will be free to reengage the pawl 404 and retain the pawl 404 in the latched position when the pawl is driven to the latched position by the impact of the rod-shaped portion 434 of the striker 508. To accomplish the resetting of the slide 418 to the retracted position, an electronic control circuit (not shown) must be provided that controls the current supplied to the motor 410 in response to the remotely located switch being pressed. The control circuit would be programmed to supply electrical current to the motor 410 with a first polarity for a first predetermined duration and then with a second polarity that is the reverse of the first polarity for a second predetermined duration. The first polarity would be selected to rotate the screw 416 in the counter clockwise direction to thereby move the slide 418 from the retracted to the extended position, and the second polarity would be selected to rotate the screw 416 in the clockwise direction to move the slide 418 from the extended to the retracted position and thus reset the slide 418. When the panel 500 is being closed, the opening of the pawl slot 458 substantially registers with the slot 412 and is essentially unobstructed by the sides of the housing 402 such that the pawl slot 458 can receive the rod-shaped portion 434 of the striker 508 via the slot 412. As the panel 500 is slammed shut, the rod-shaped portion 434 of the striker 508 is received in the slot 458 and impacts the pawl 404 causing the rotation of the pawl 404 toward the latched position shown in FIGS. 56, 61, and 100. As the pawl 404 rotates to the latched position, the distal end 490 of the first lever arm 484 of the trigger 406 will move to the engaged position and reengage the surface 454 of the notch 456 to keep the pawl 404 in the latched position illustrated in FIGS. 56, 61, and 100, thus securing the panel 500 in the closed position. The notch 456 keeps the trigger 406 from over rotating and overshooting the surface 454.

The slot 412 is oriented such that the open end of the U-shaped profile of the slot 412 is directed (i.e. faces) in a direction that is substantially perpendicular to the longitudinal axis of the output shaft 420 of the motor 410. In the illustrated embodiment, the longitudinal axis of the output shaft 420 of the motor 410 essentially lies in the plane of rotation of the pawl 404. The plane of rotation of the pawl 404 is defined as a plane to which the axis of rotation of the pawl 404 is perpendicular and which passes through the center of the pawl 404.

If there is a strong load tending to force the panel 500 open, a high torque will be applied to the pawl 404. This in turn causes large forces, both normal to the surface 454 and frictional, to be exerted between the surface 454 and the-distal end 490 of the first lever arm 484 of the trigger 406. However, because of the mechanical advantage provided by the second lever arm 486 of the trigger 406, the size of the motor 410 and the energy consumption of the motor 410 can be kept within reasonable limits even as the latch 400 remains operable under a significant applied load.

As an alternative to reversing the polarity of the electrical current supplied to the motor 410, the latch 400 can be provided with a mechanical means for resetting the slide 418. One such mechanical means for resetting the slide can be seen in the illustrated embodiment and includes a kicker lever 492 that is pivotally connected to the slide 418. The Kicker lever 492 is provided with a pivot shaft 494 that passes through a hole in the Kicker lever 492 proximate the end of the Kicker lever 492 closest to the slide 418 (also referred to herein as the proximal end of the kicker lever). The pivot shaft 494 is rotationally supported in the bearings 496 that are provided as part of the slide 418. The material surrounding and defining the bearings 496 is resilient and is transected by a radial gap 499 such that the pivot shaft 494 can be snapped into the bearings 496. At about the time the trigger 406 is disengaged from the pawl 404, i.e. within the period beginning shortly before disengagement of the trigger and ending shortly thereafter, the slide 418 will be at or near its extended position and the pawl 404 will be at or near its latched position. Also, at some point during this time period, the end of the Kicker lever 492 farthest from the slide 418 (also referred to herein as the distal end of the kicker lever) contacts a cam surface 498 provided on the pawl 404. As the pawl 404 rotates toward its unlatched position, the pawl 404 pushes on the kicker lo lever 492 and thereby drives the slide 418 back to its retracted position. As the pawl 404 rotates toward its unlatched position, the distance between the point at which the kicker lever 492 contacts the cam surface 498 and the rotational axis of the pawl 404, as measured along a line directed along the longitudinal axis of the screw 416, increases. Because the rotational axis of the pawl 404 is fixed in location relative to the housing 402, the kicker lever 492 and the slide 418 are moved back toward the retracted position of the slide 418. Thus the driving of the slide 418 back to its retracted position is effected as the pawl 404 rotates toward its unlatched position.

The mechanical means for resetting the slide 418 greatly simplifies the design of the electronic circuits controlling the latch 400. With such a mechanical resetting 20 means, the electronic control circuit is only required to supply electrical current to the motor 410 with a first polarity for a first predetermined duration to effect unlatching of the latch 400. Again, the first polarity would be selected to rotate the screw 416 in the counter clockwise direction to thereby move the slide 418 from the retracted to the extended position.

In the illustrated embodiment, the trigger 406 is made up of two L-shaped halves 510 and 512 that are superimposed and brought into contact with one another to form the trigger 406. Each arm 514, 516 of the L-shaped halves 510 and 512 that forms part of the second lever arm 486 of the trigger 406 has a bowed-out portion that is bowed outward away from the central plane of the trigger 406 defined by the interface between the two L-shaped halves 510 and 512. The bowed-out portions form an opening 518 in the second lever arm 486 of the trigger 406 through which the kicker lever 492 is positioned. The opening 518 allows the kicker lever 492 to pass through the second lever arm 486 of the trigger 406 and contact the cam surface 498 of the pawl 404. Each arm 514, 516 of the L-shaped halves 510 and 512 also has a slot 520, 522 that define the slot 482 of the second lever arm 486 that is engaged by the trigger spring 488. Furthermore, each bowed-out portion of the arms 514, 516 has a projection 524, 526, respectively. The projections 524, 526 contact each other when they are assembled to form the trigger 406. The portion of the trigger spring 488 that passes through the slots 520, 522 and the projections 524, 526 limit the range of angular positions that the kicker lever 492 can assume relative to the slide 418. Accordingly, the portion of the trigger spring 488 that passes through the slots 520, 522 and the projections 524, 526 guide the kicker lever 492 to ensure that the kicker lever 492 is always properly positioned relative to the slide 418 and the pawl 404 to provide for the resetting of the slide 418 back to its retracted position as the pawl 404 rotates to its unlatched position.

The end of the second lever arm 486 distal from the first lever arm 484 is provided with a groove 528 that engages a linkage rod 530. The linkage rod 530 passes to the exterior of the housing 402 and extends in a direction parallel to the longitudinal axis of the screw 416 away from the motor 410 and the slide 418. Pulling the linkage rod 530 outward from the housing 402 moves the trigger 406 to the disengaged position to thereby release the pawl 404 from the latched position and effect the unlatching of the latch 400. The linkage rod 530 can be connected by cable to a remotely located pulley. It can be arranged for the rotation of the pulley to be controlled by a cylinder lock. This provides a secure mechanical override that allows the operation of the latch 400 in the event of motor or electrical power failure.

The latch 400 may also include a micro switch 532 and a micro switch holder 534. The micro switch holder 534 holds and positions the micro switch 532 in registry with the slot 412 where the micro switch can be engaged by the striker 508 when the striker 508 is captured by the pawl 404. The striker 508 pushes on the micro switch lever 536 to close the micro switch when the striker 508 rotates the pawl 404 to the latched position thus generating a signal that the latch 400 is closed. This signal can be conducted to the outside of the housing 402 by wires 538 and can be used to control the current supply to the motor 410, generate alarms, and/or to monitor activity such as access to the compartment secured by the latch 400.

Figure 106:
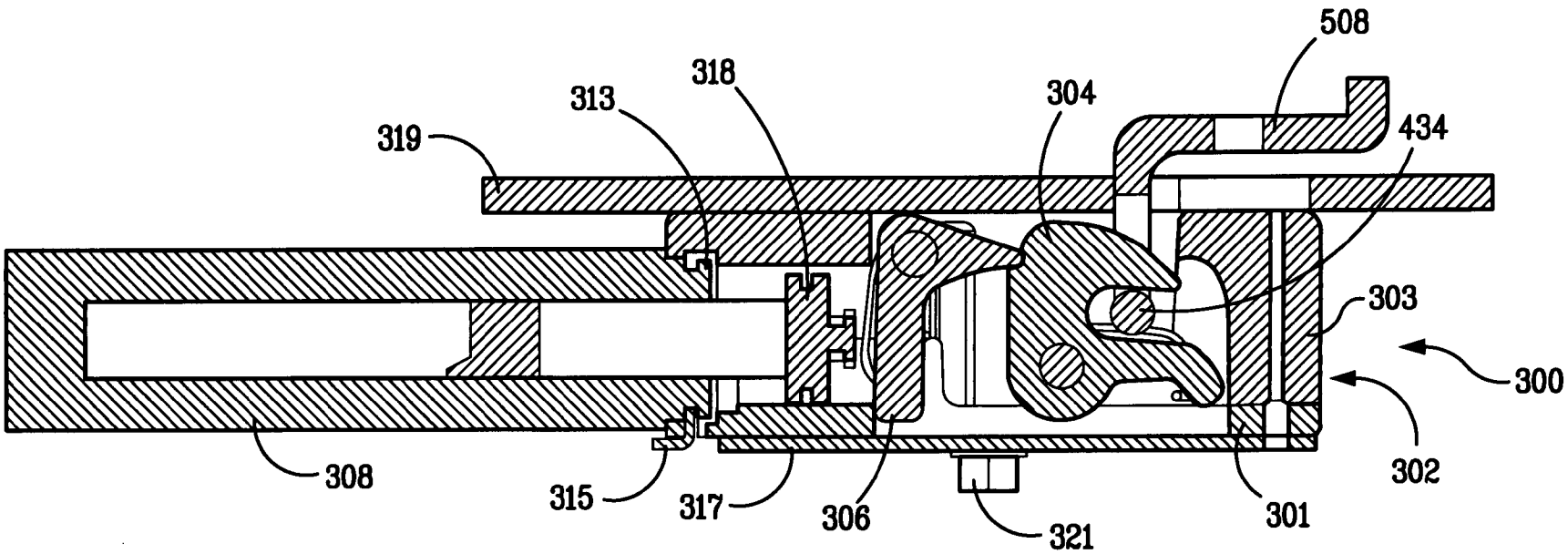
FIG. 106 is a cross sectional view of a fifth embodiment of a latch assembly according to the present invention shown in the latched configuration.
Figure 107:
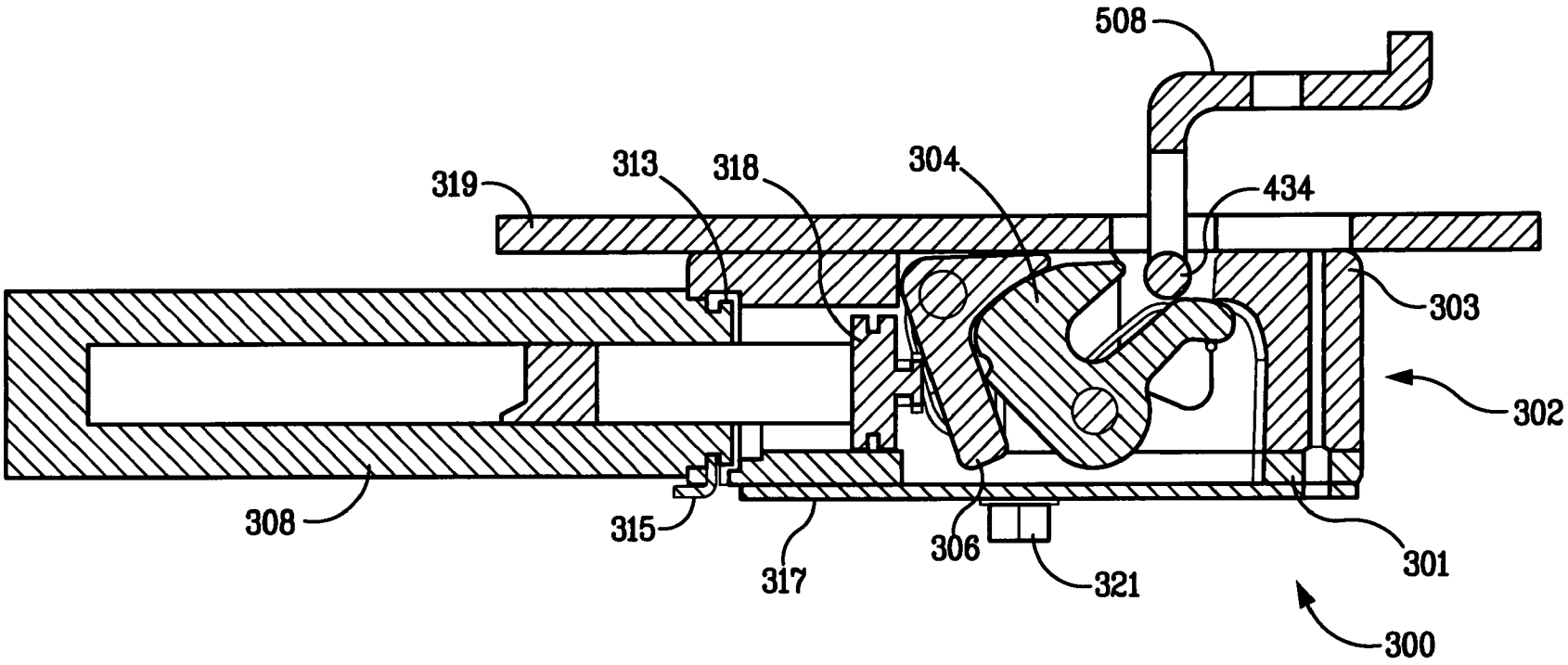
FIG. 107 is a cross sectional view of a fifth embodiment of a latch assembly according to the present invention shown in the unlatched configuration.
Figure 108:
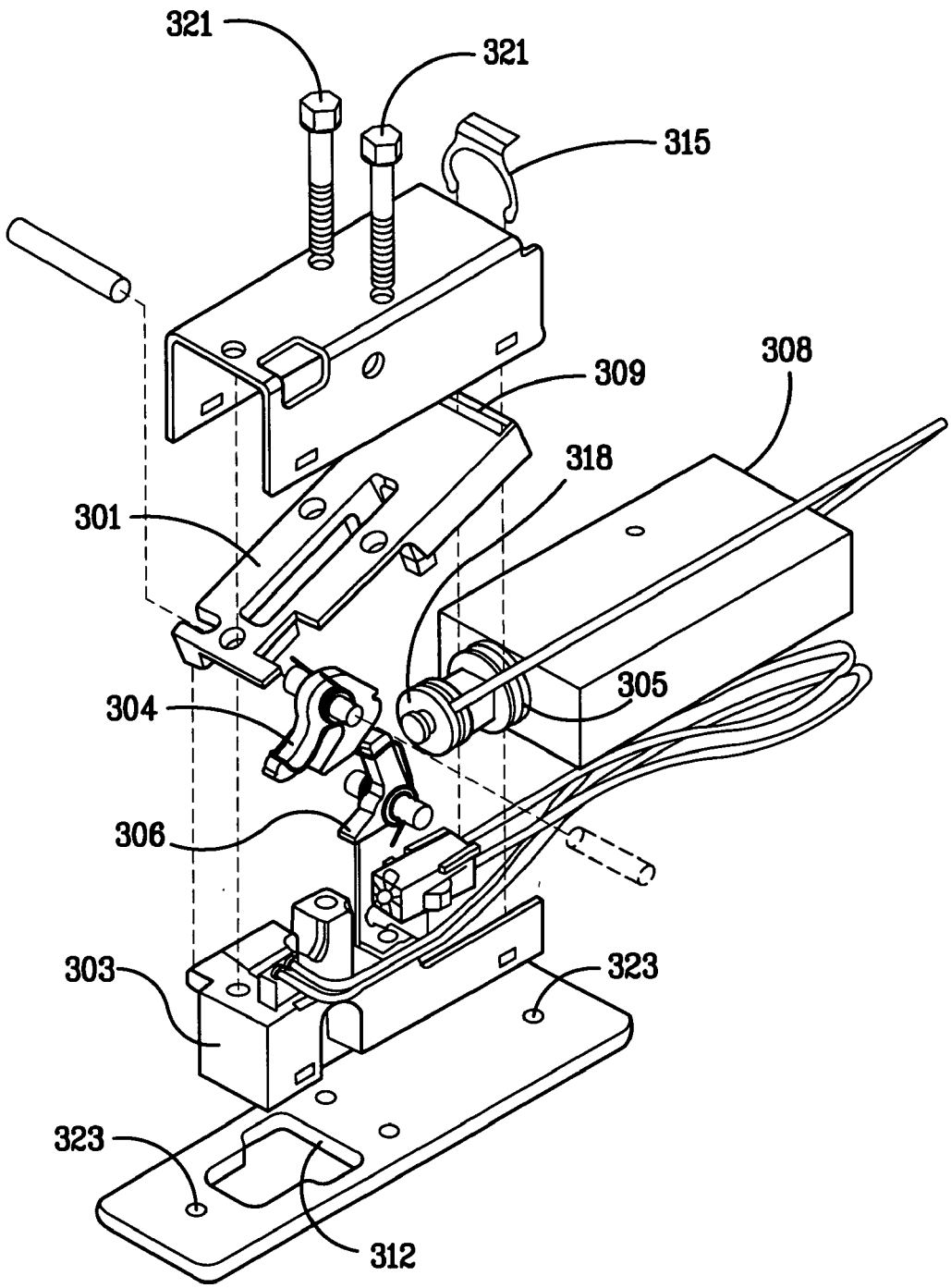
FIG. 108 is an exploded view of a fifth embodiment of a latch assembly according to the present invention.
Figure 109:
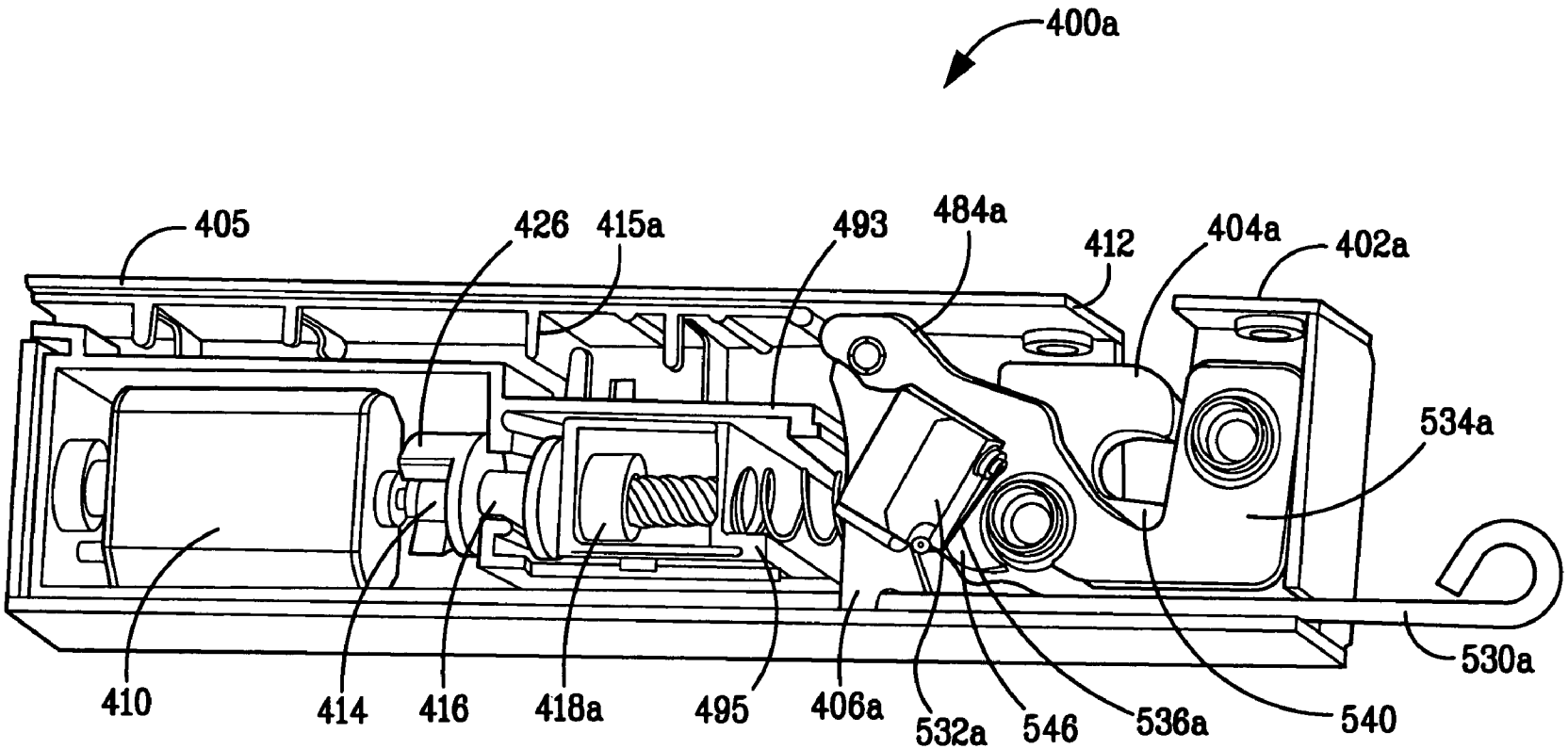
FIG. 109 is a view of yet another embodiment of the latch assembly according to the present invention with the housing cover plate removed to reveal internal details.
Figure 110:
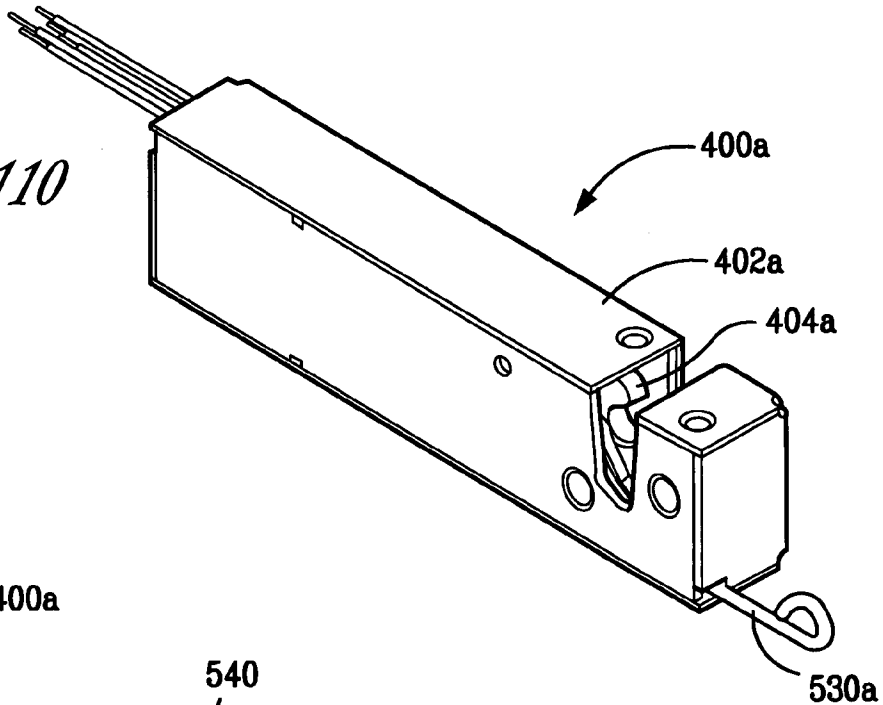
FIGS. 110 to 111 are views of the embodiment of FIG. 109 shown with the cover plate and the pawl in the unlatched position.
Figure 111:
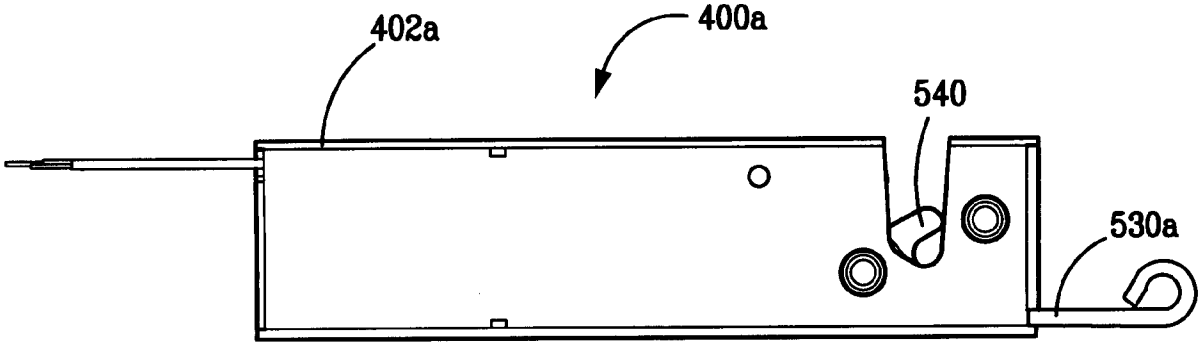
Figure 112:
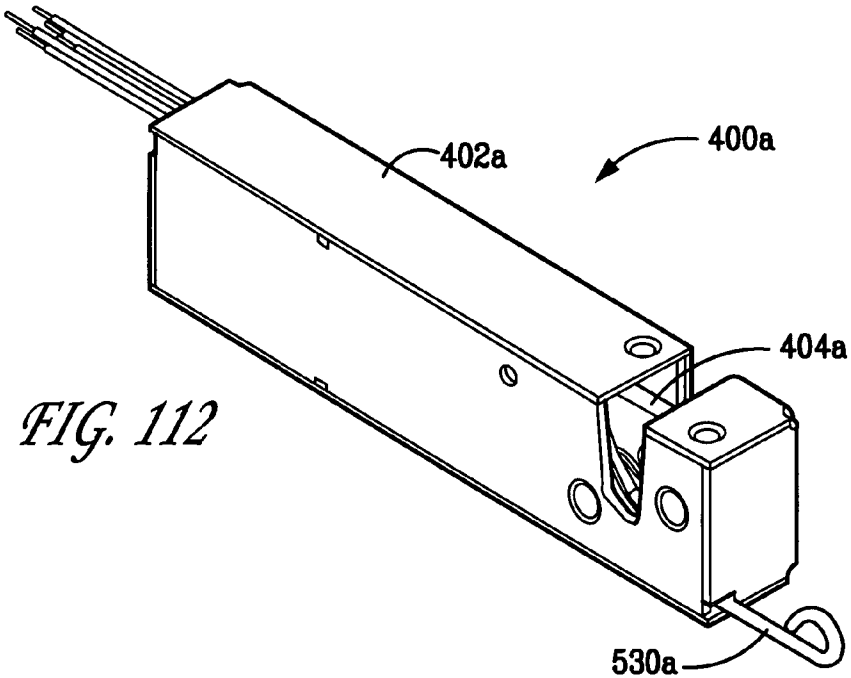
FIGS. 112 to 113 are views of the embodiment of FIG. 109 shown with the cover plate and the pawl in the latched position.
Figure 113:
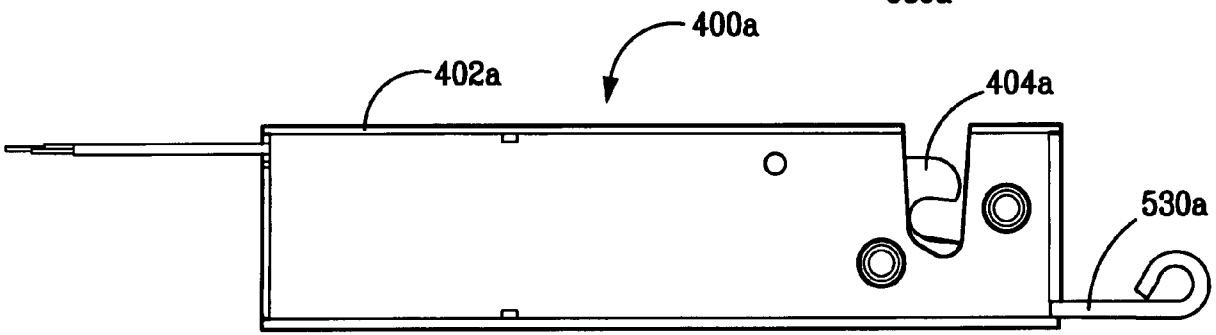
Figure 114:
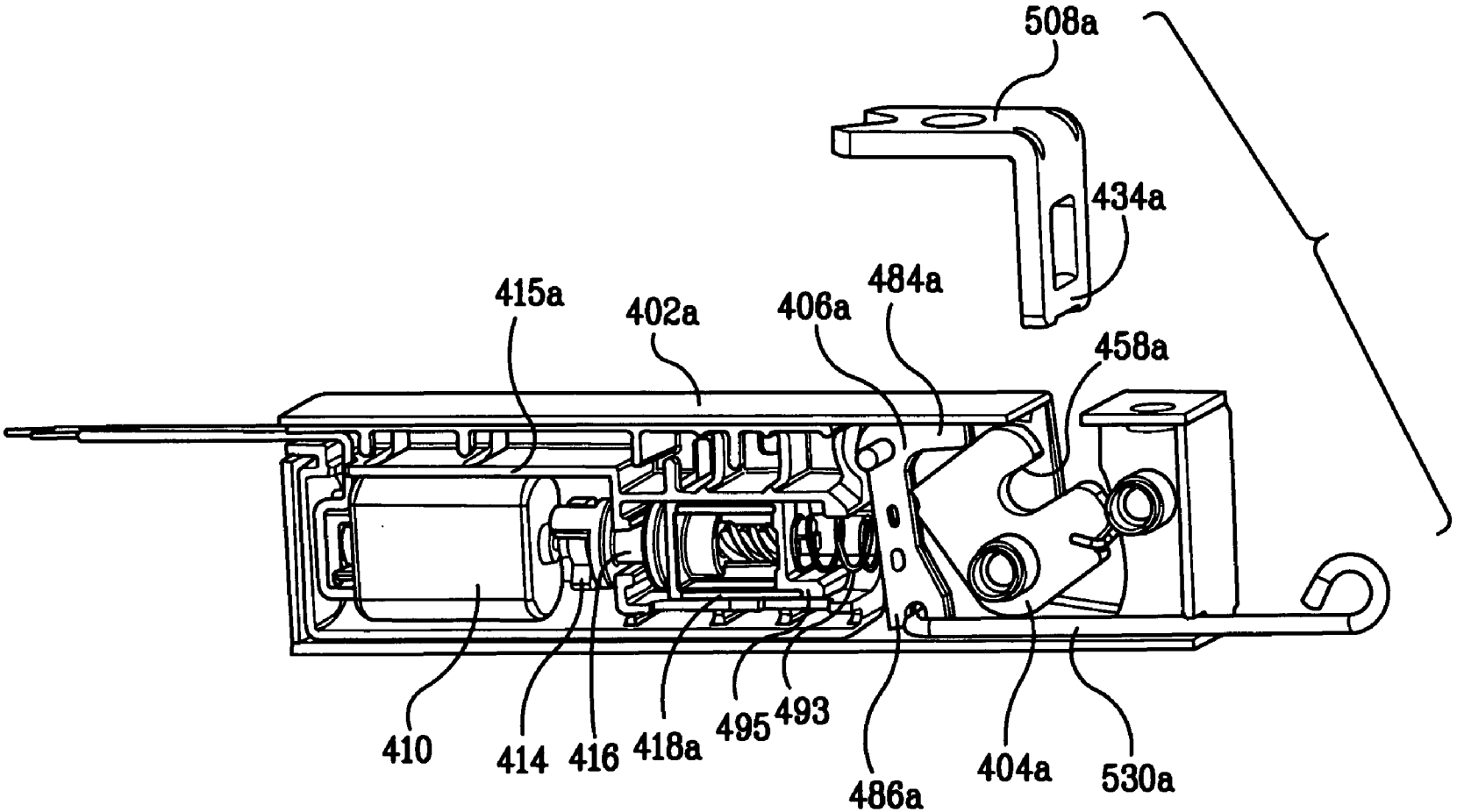
FIGS. 114 to 116 are views of the embodiment of FIG. 109 shown with the cover plate, micro switch, micro switch holder and micro switch actuator removed to illustrate the latching sequence of the operation of the latch.
Figure 115:
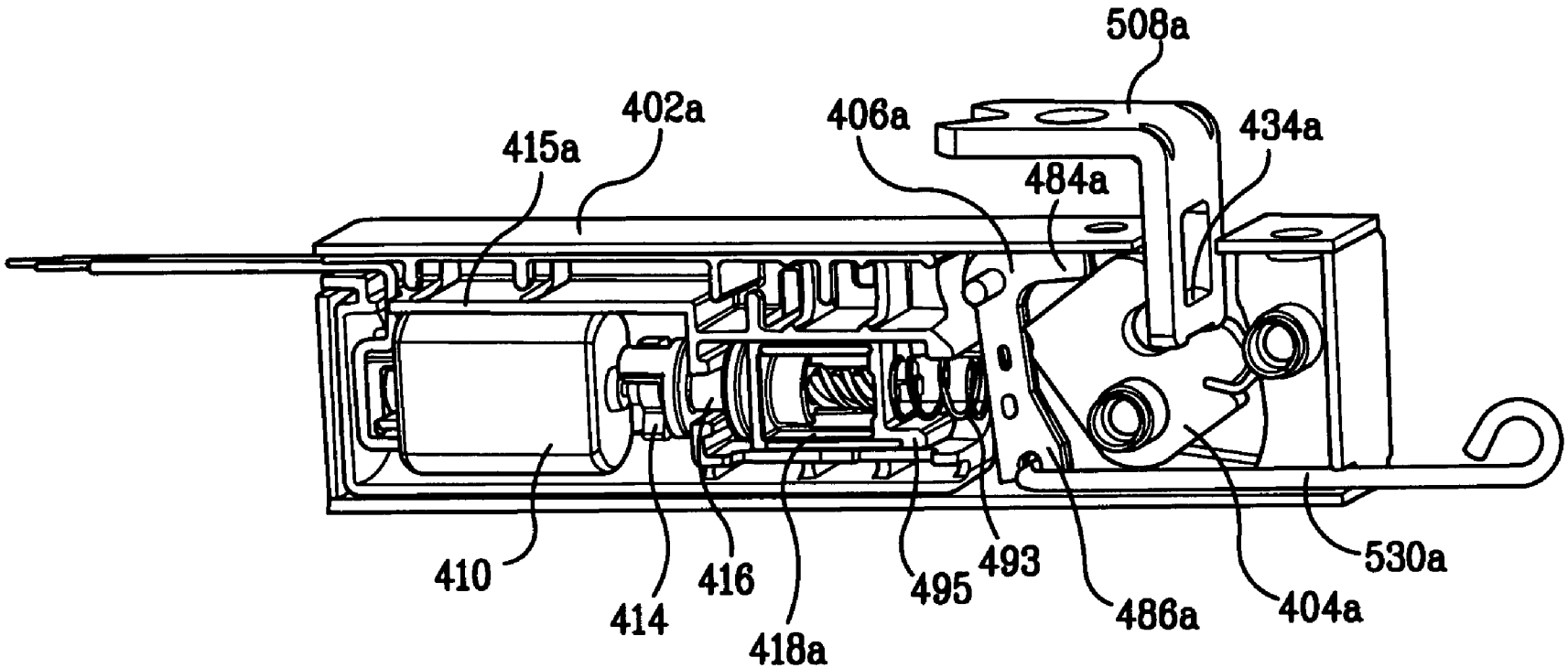
Figure 116:
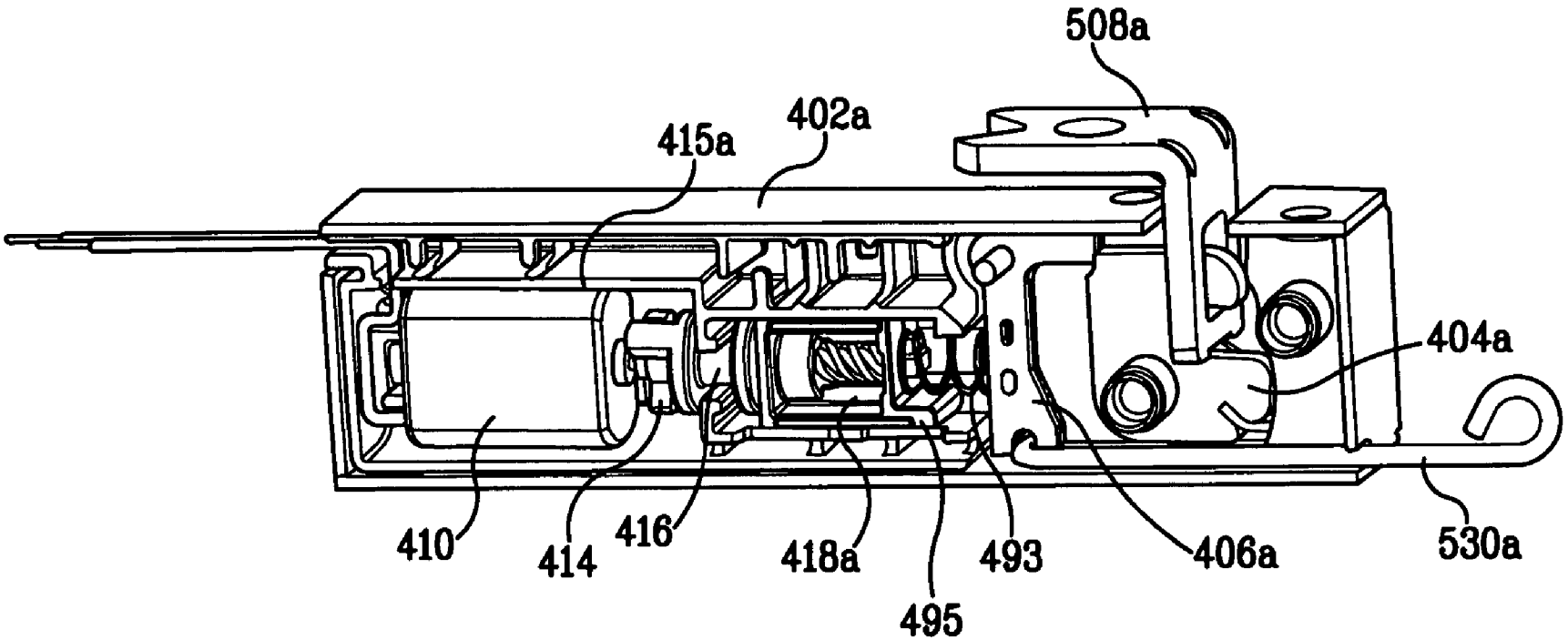
Figure 117:
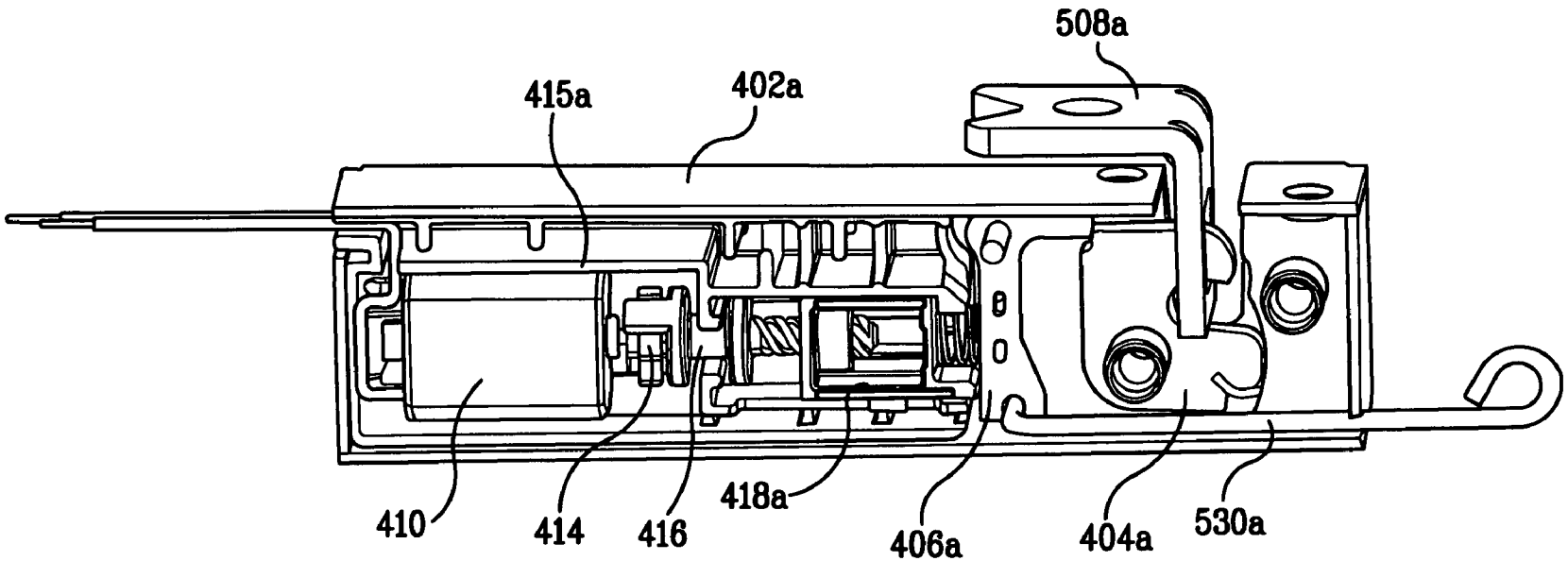
FIGS. 117 to 118 are views of the embodiment of FIG. 109 shown with the cover plate, micro switch, micro switch holder and micro switch actuator removed to illustrate the unlatching sequence of the operation of the latch.
Figure 118:
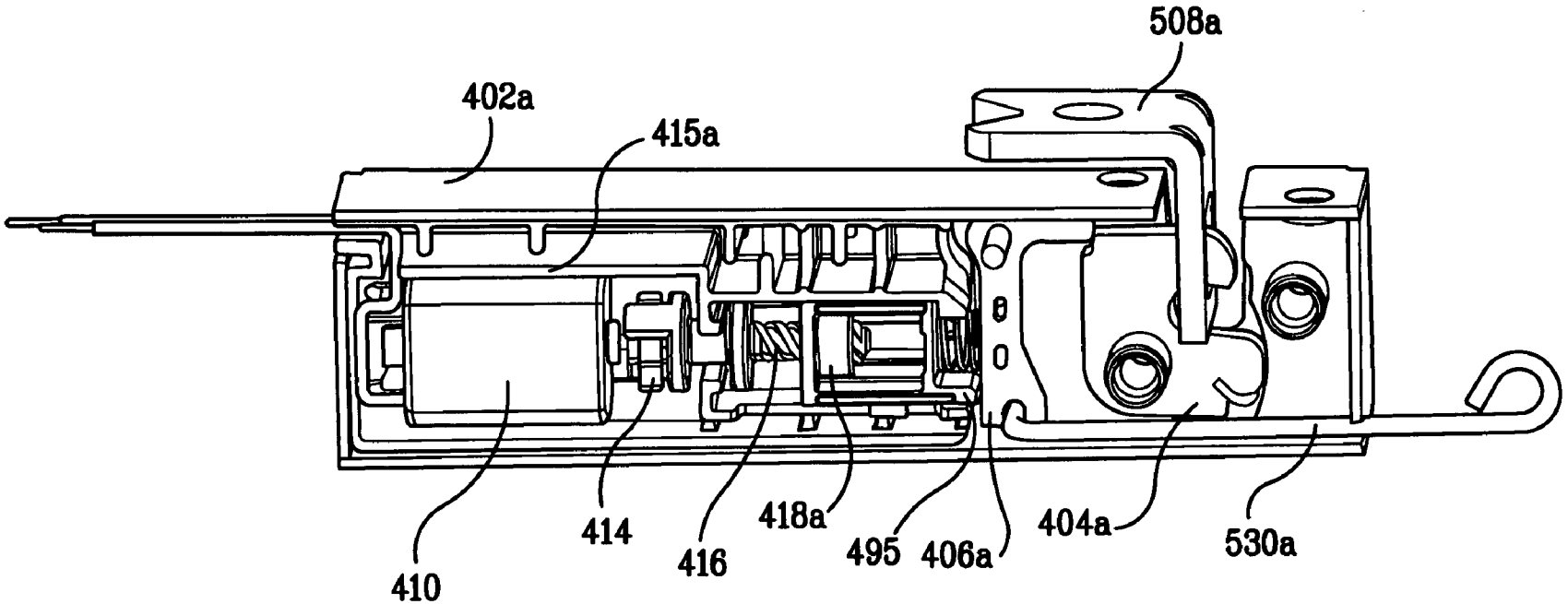
Figure 120:
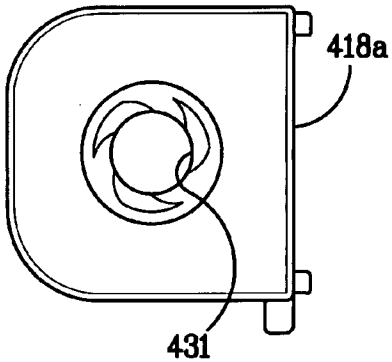
FIGS. 119 to 122 are views of the slide of the embodiment of FIG. 109.
Figure 122:
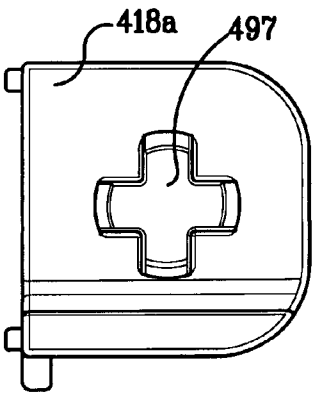
Figure 119:
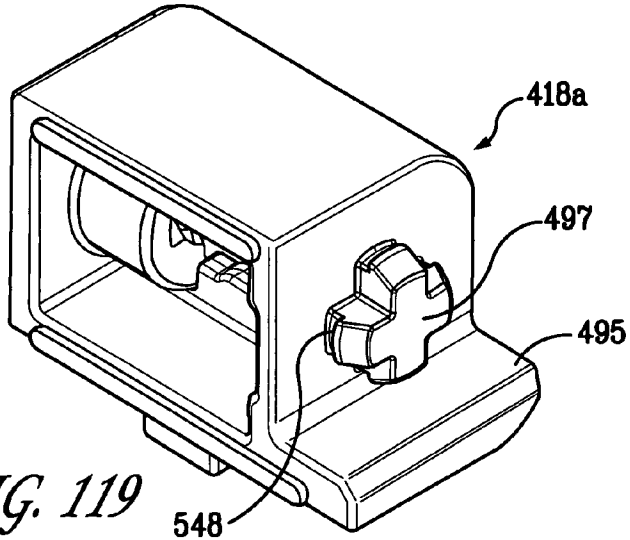
Figure 121:
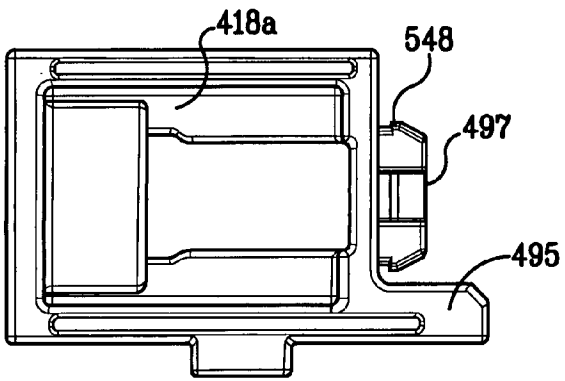
Figure 124:
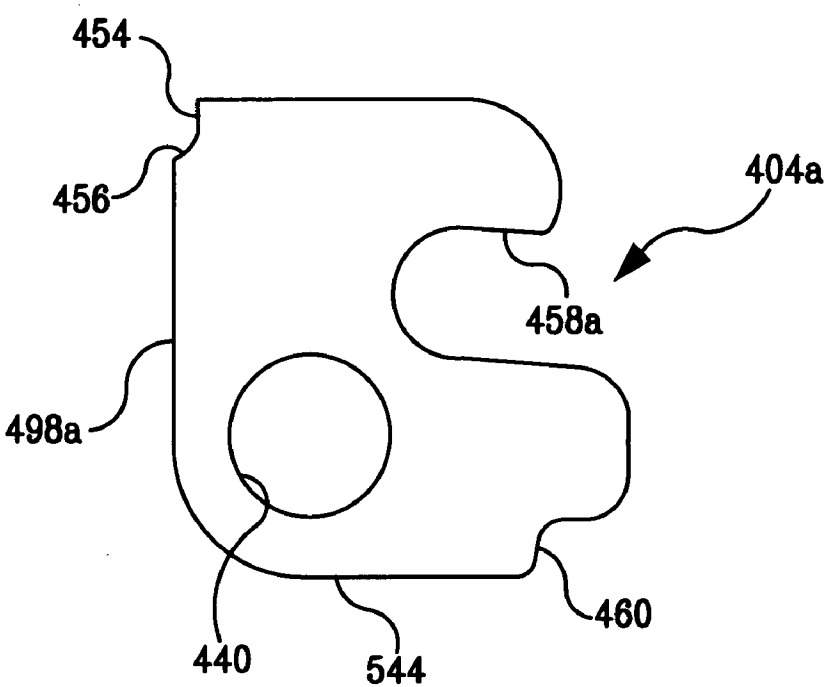
FIGS. 123 to 124 are views of the rotary pawl of the embodiment of FIG. 109.
Figure 123:
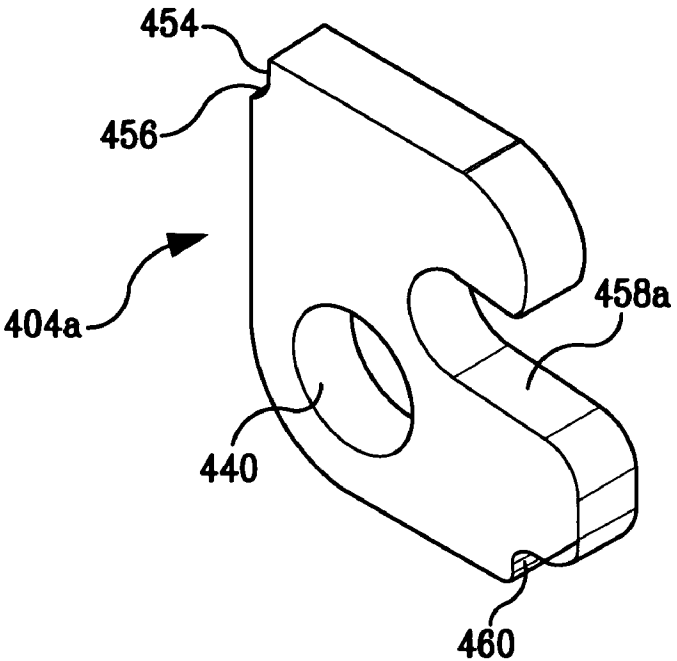
Figure 125:
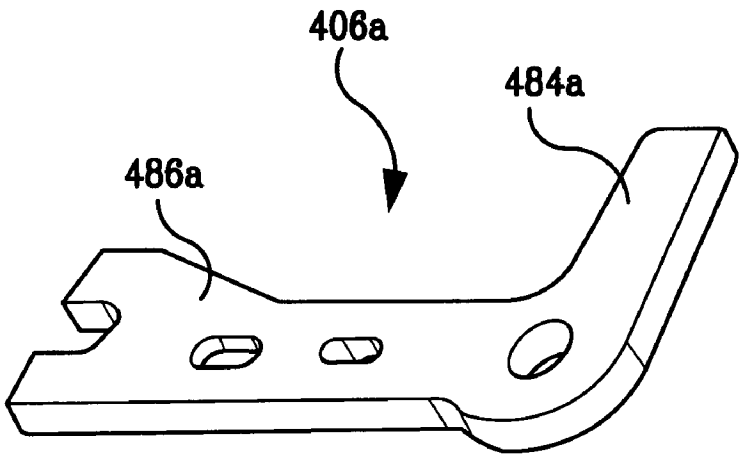
FIGS. 125 to 126 are views of the trigger of the embodiment of FIG. 109.
Figure 126:
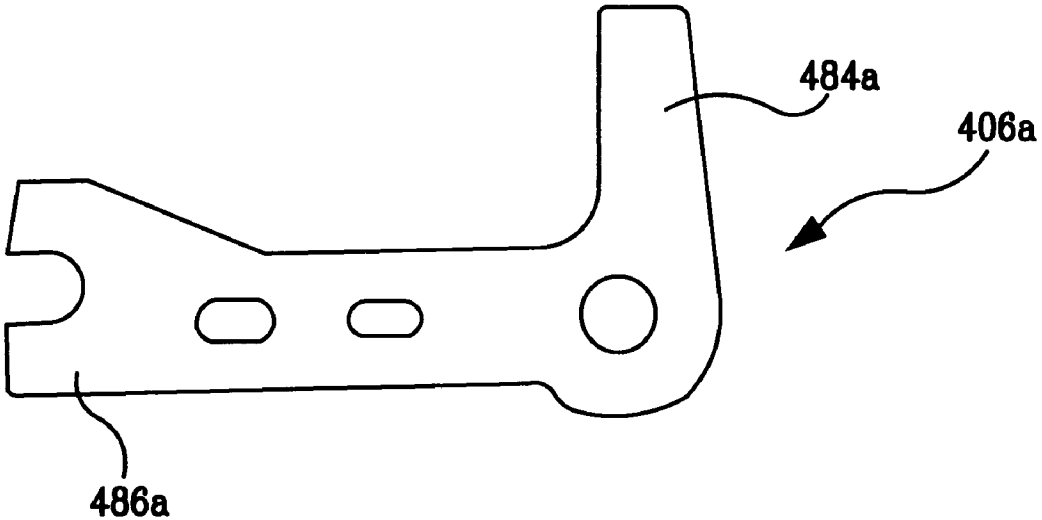
Figure 127:
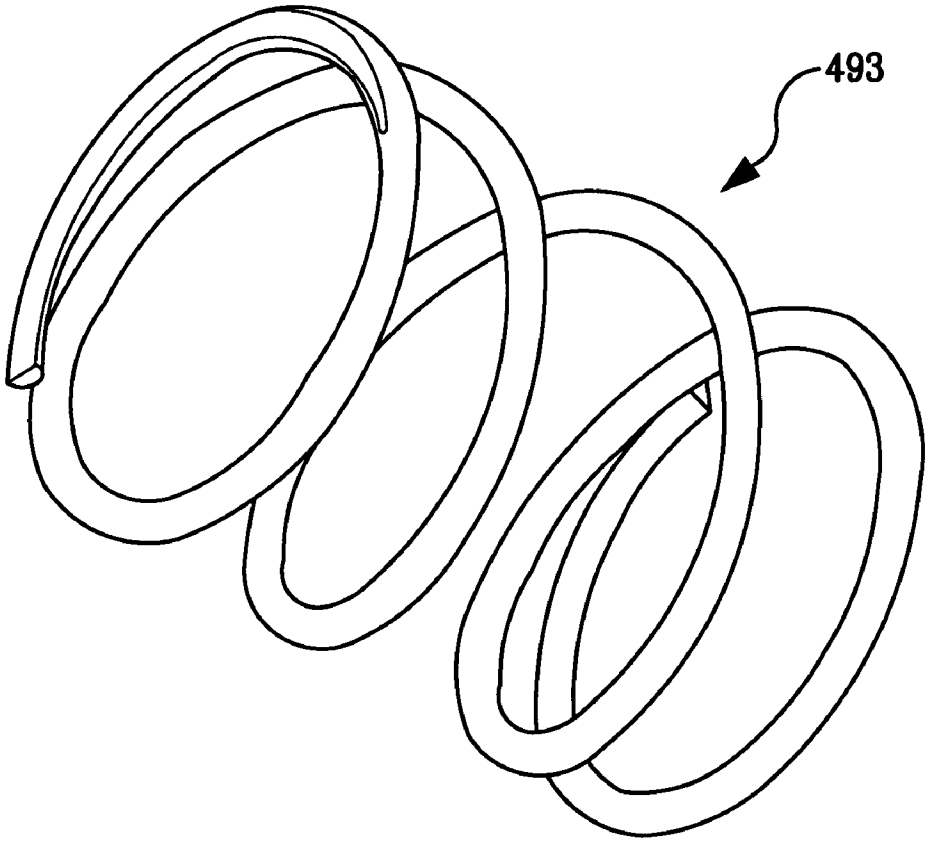
FIG. 127 is an isometric view of the compression spring for resetting the slide of the embodiment of FIG. 109.
Figure 128:
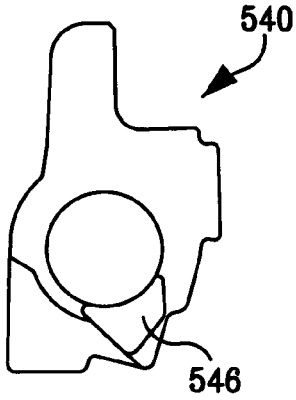
FIGS. 128 to 134 are views of the micro switch actuator of the embodiment of FIG. 109.
Figure 129:
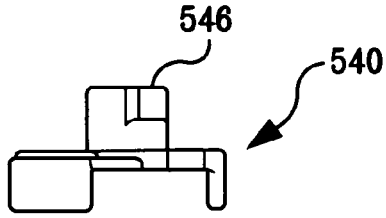
Figure 130:
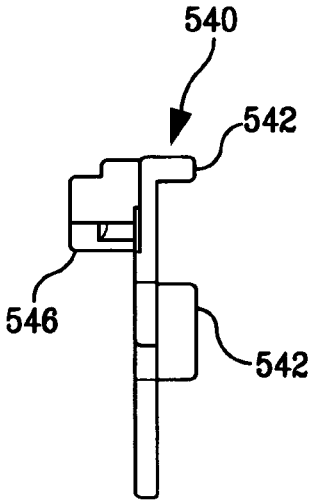
Figure 131:
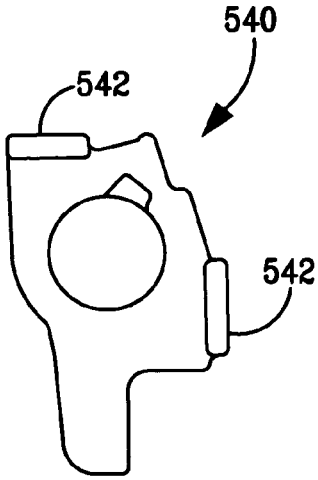
Figure 132:
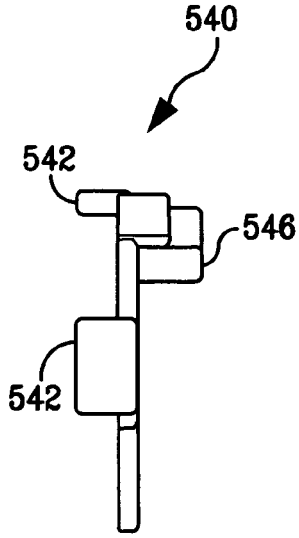
Figure 133:
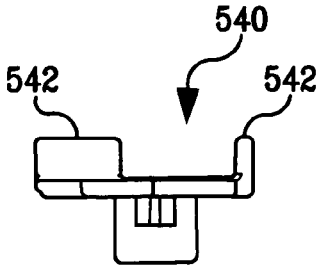
Figure 134:
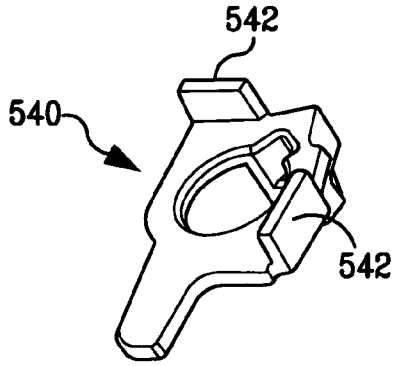
Figure 137:
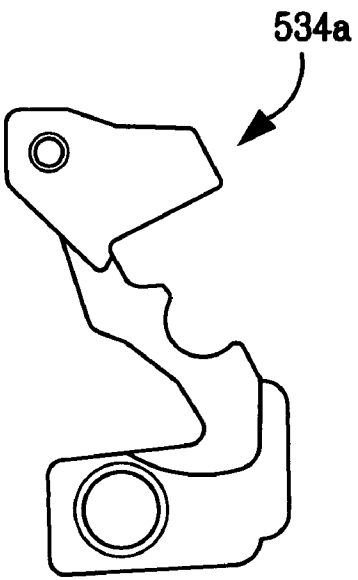
FIGS. 135 to 137 are views of the micro switch holder of the embodiment of FIG. 109.
Figure 136:
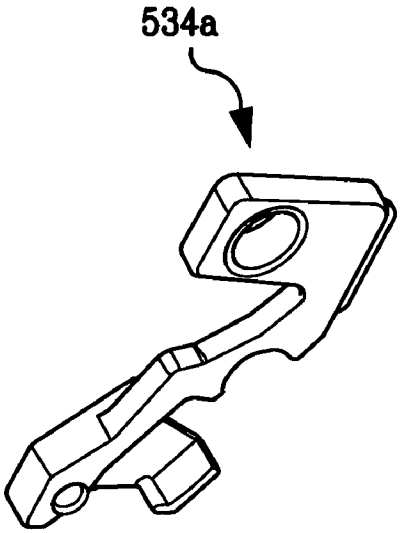
Figure 135:
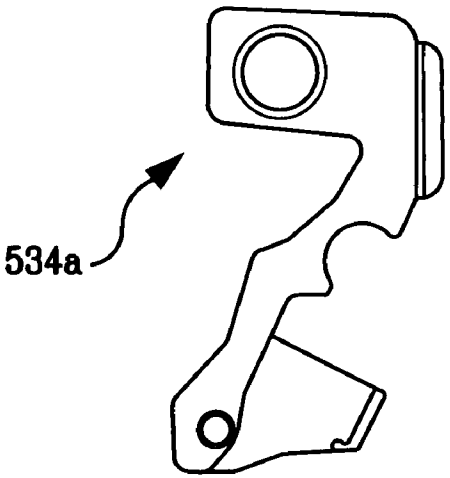
Figure 139:
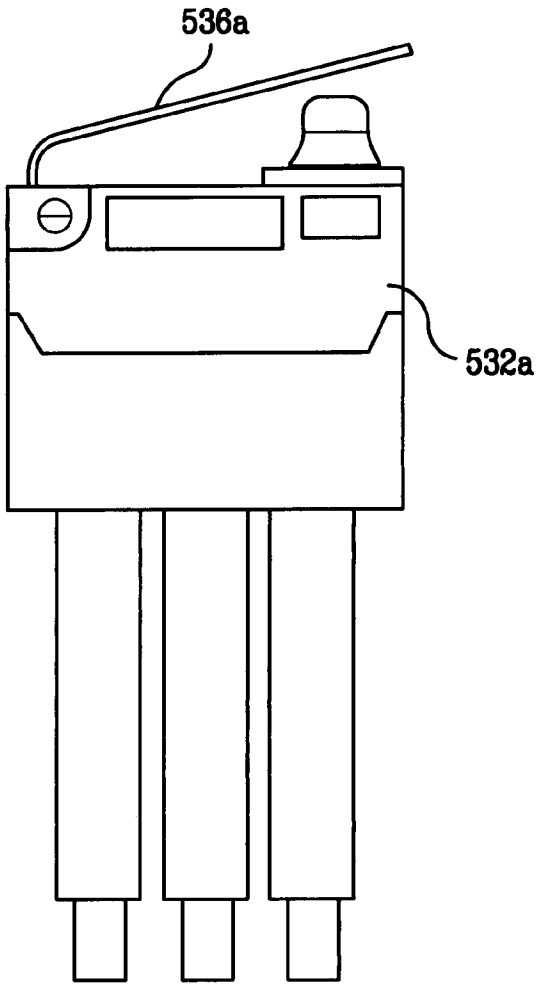
FIGS. 138 to 139 are views of the micro switch of the embodiment of FIG. 109.
Figure 138:
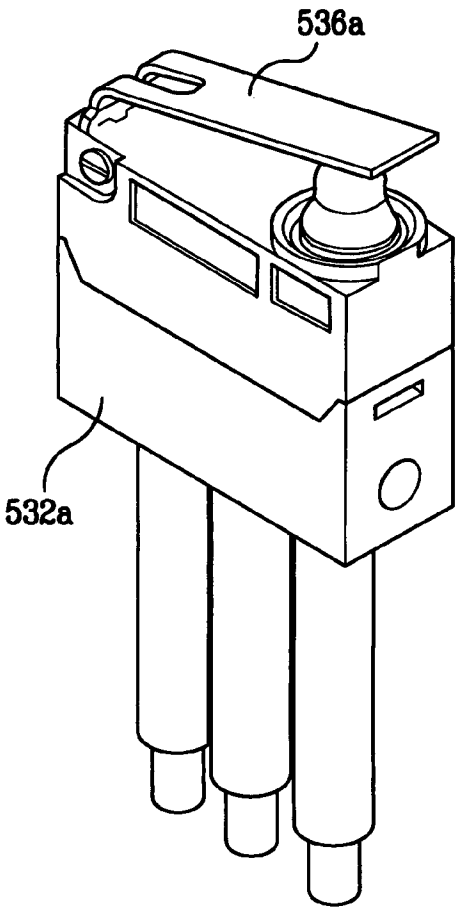

FIGS. 106-108 show another embodiment 300 of the latch of the invention that is designed to take advantage of an off-the-shelf linear actuator 308. In the latch 300 the rotary pawl mechanism of the present invention is used with the alternative type of linear actuator 308. The main difference between the latch 300 and the latch 400 is that the most of the linear actuator 308 is external to the latch housing 302. In this way, different off-the-shelf linear actuators can be used without requiring modifications to the latch 300. The modular design of the latch 300 also accommodates design changes that the manufacturers of the off-the-shelf linear actuators may make in their designs over time without requiring modifications to the latch 300. The housing 302 is in two halves 301 and 303 that come together in clamshell fashion. A portion of the bearing surfaces for the pivot shafts of the trigger and pawl are made in the half housing 301, while the remaining portion of the bearing surfaces for the pivot shafts of the trigger and pawl are made in the half housing 303. The linear actuator 308 has a plunger opening in its housing through which the plunger 318 that pushes on the trigger 306 extends outward. A flanged collar 305 surrounds the plunger opening. The two housing halves 301 and 303 come together around the collar 305 surrounding the plunger opening of the linear actuator 308. The housing half 301 has a slot 309 that registers with the collar 305 behind its flange 313. A C-shaped clip 315 is placed through the slot 309 and partially encircles the collar 305 behind its flange 313. This prevents the linear actuator 308 from being pulled apart from the housing 302.

The housing 302 is placed between a U-bracket 317 and a support plate 319 and bolts 321 are driven through the U-bracket 317 and the housing halves 301 and 303, and are then secured to threaded openings in the support plate 319. The housing halves 301 and 303 are secured together. The support plate 319 has mounting holes 323 for mounting the latch 300 to a closure member. The support plate 319 has a slot 312 for allowing the striker 508 to enter the housing 302 and engage the pawl 304.

Figure 77:
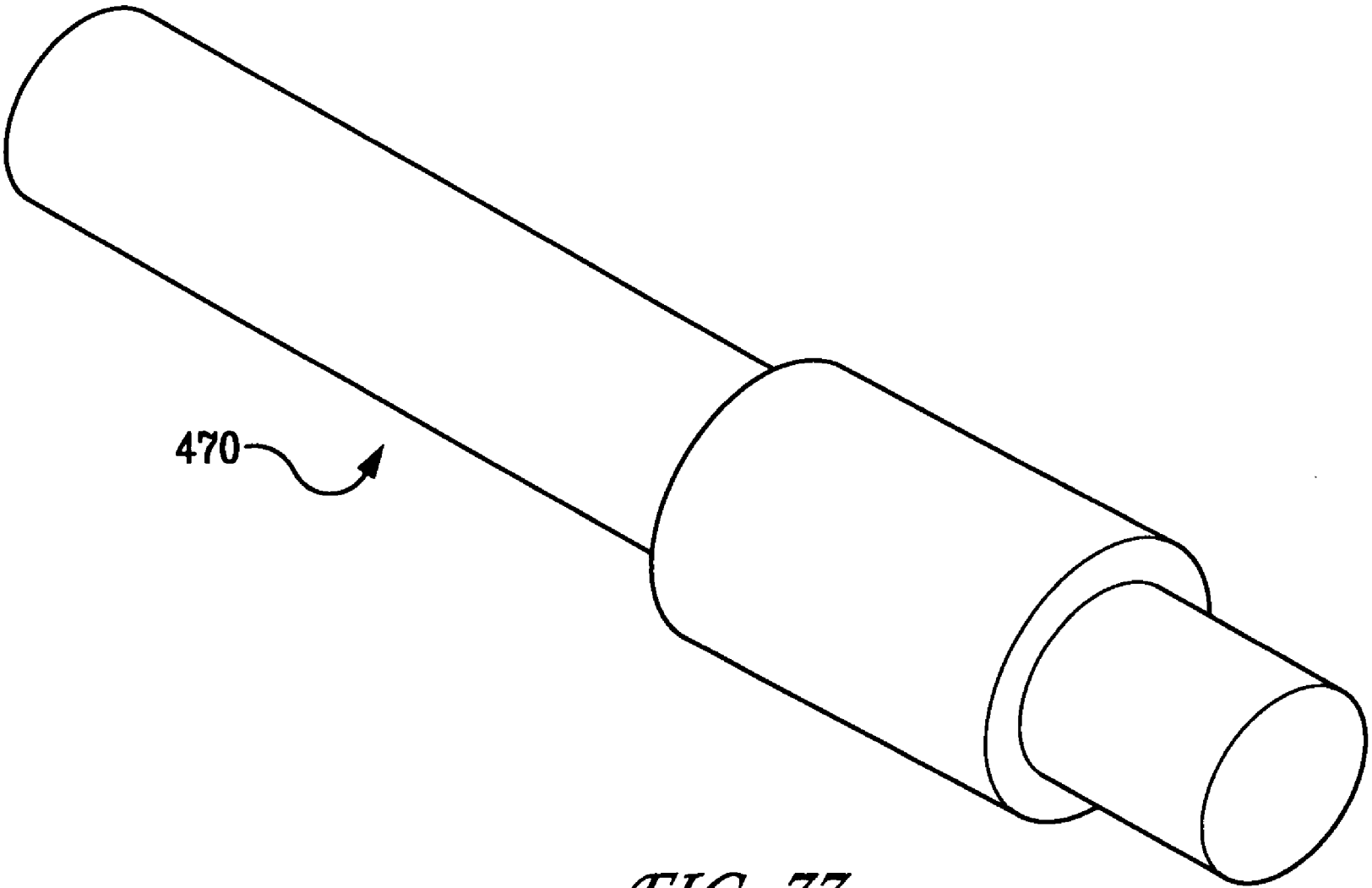
FIG. 77 is an isometric view of the trigger pivot pin of the fourth embodiment of a latch assembly according to the present invention.
Figure 79:
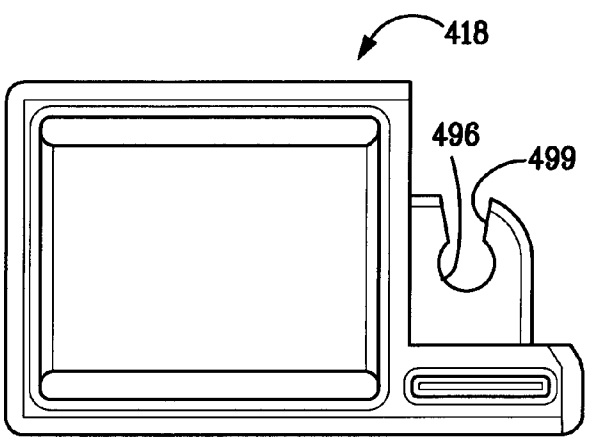
FIGS. 78-81 are views of the slide of the electrically operated actuator assembly of the fourth embodiment of a latch assembly according to the present invention.
Figure 81:
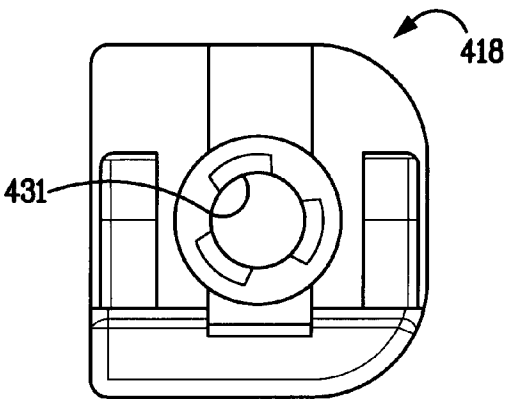
Figure 78:
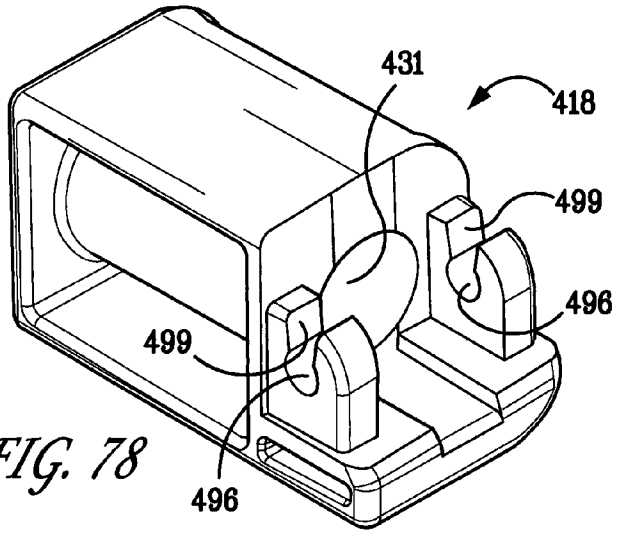
Figure 80:
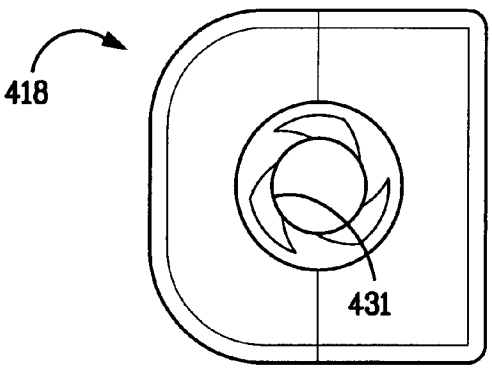
Figure 82:
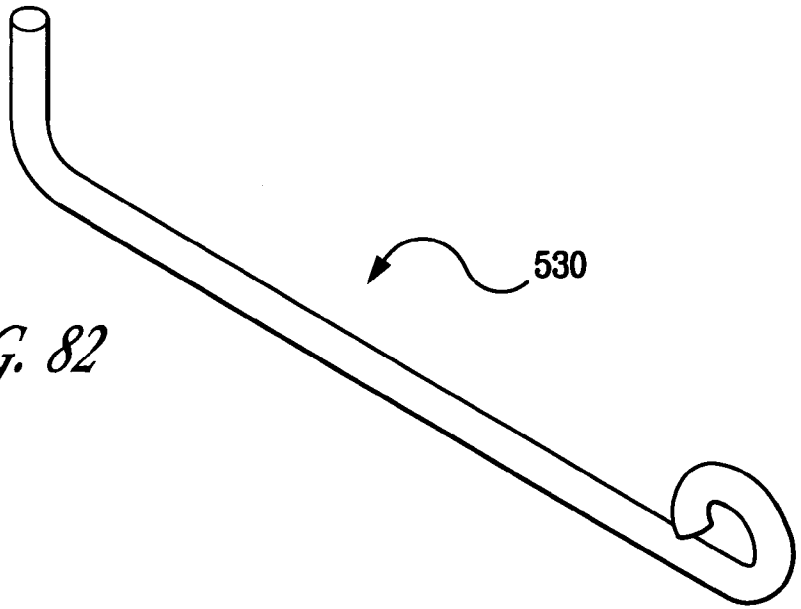
FIGS. 82-83 are views of the linkage rod of the mechanical override of the fourth embodiment of a latch assembly according to the present invention.
Figure 83:
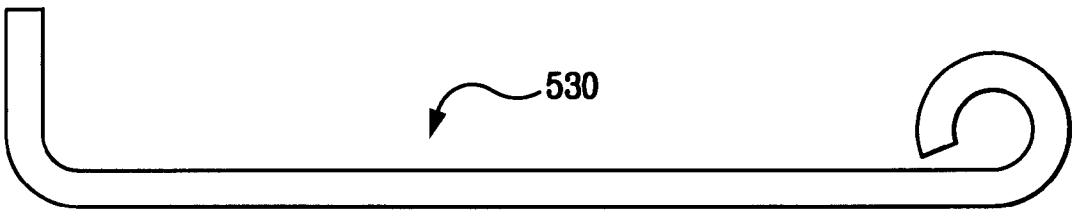
Figure 84:
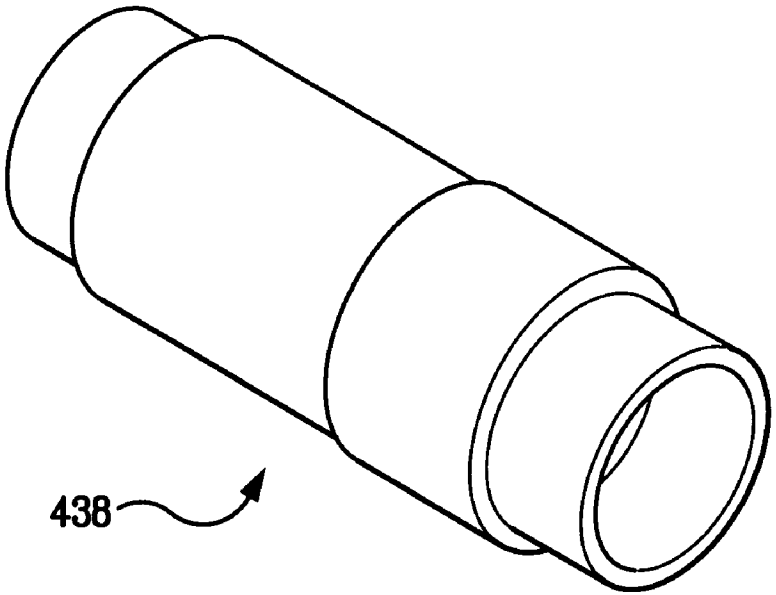
FIGS. 84-85 are views of the pawl pivot pin of the fourth embodiment of a latch assembly according to the present invention.
Figure 85:
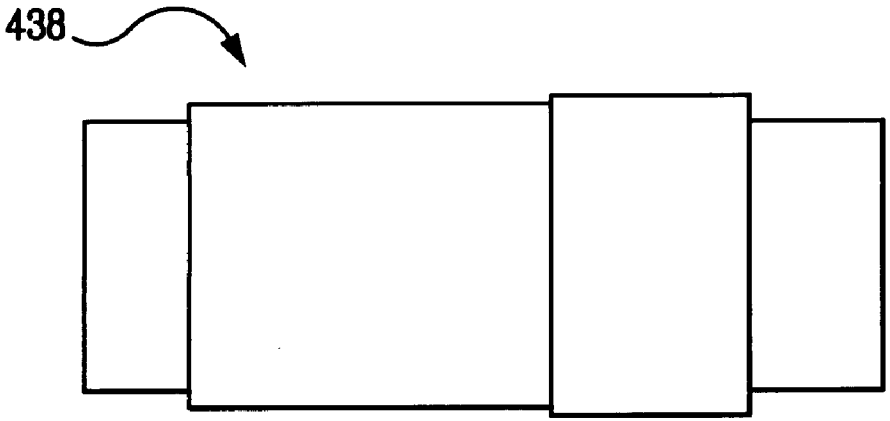
Figure 87:
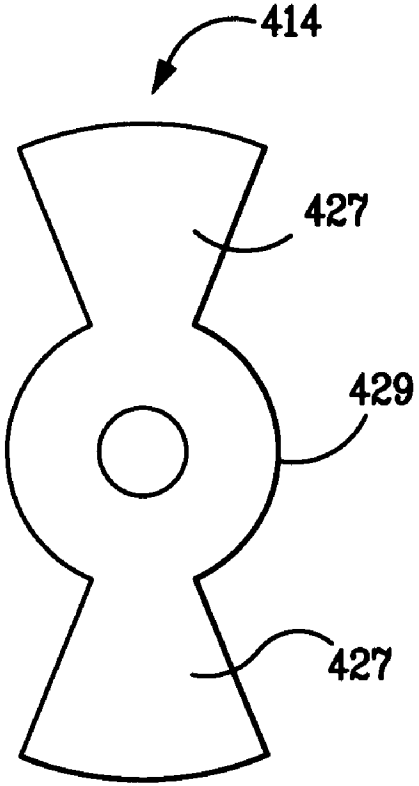
FIGS. 86-87 are views of the bow-tie coupler of the electrically operated actuator assembly of the fourth embodiment of a latch assembly according to the present invention.
Figure 86:
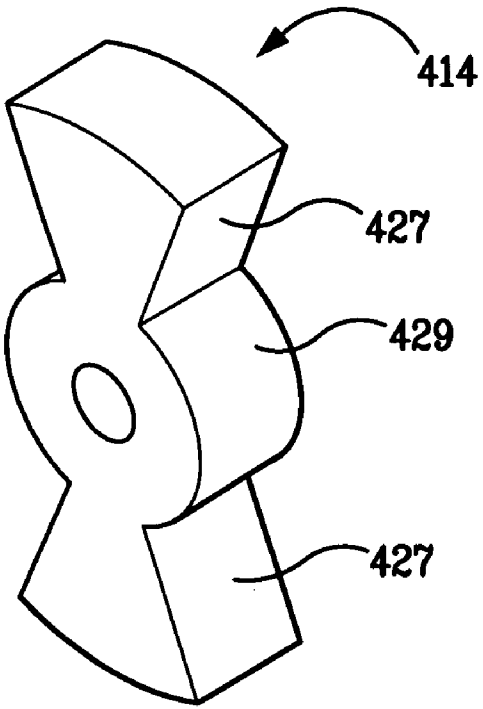
Figure 89:
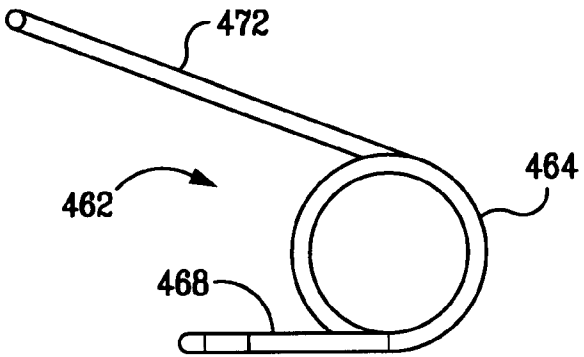
FIGS. 88-90 are views of the pawl torsion spring of the fourth embodiment of a latch assembly according to the present invention.
Figure 88:
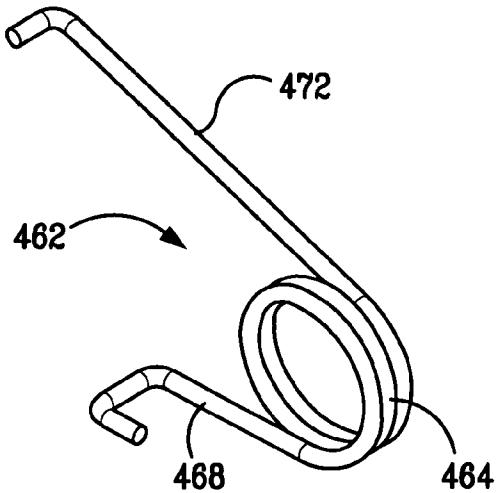
Figure 90:
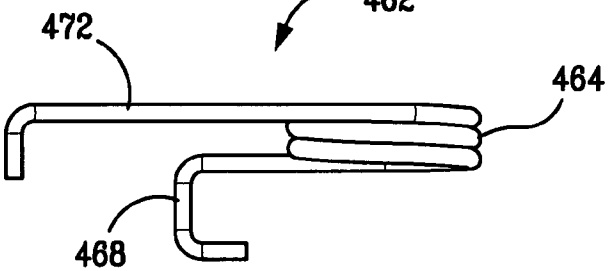
Figure 91:
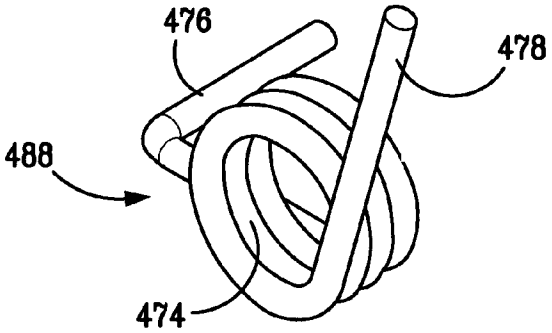
FIGS. 91-93 are views of the trigger torsion spring of the fourth embodiment of a latch assembly according to the present invention.
Figure 93:
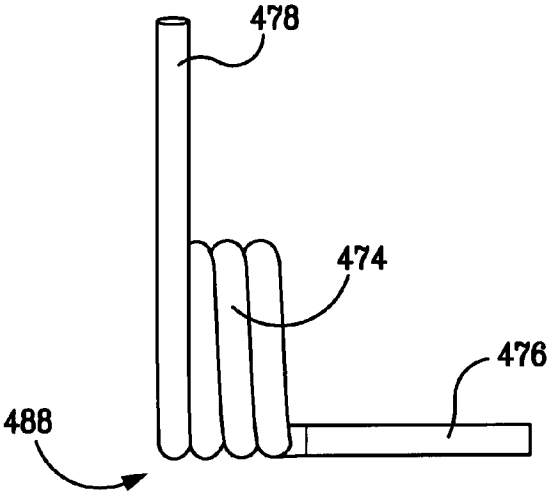
Figure 92:
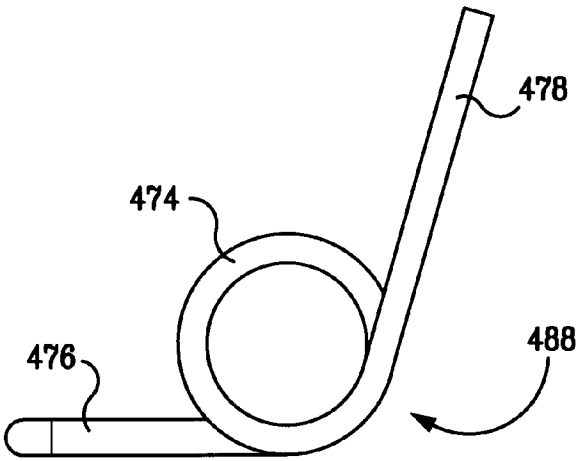
Figure 96:
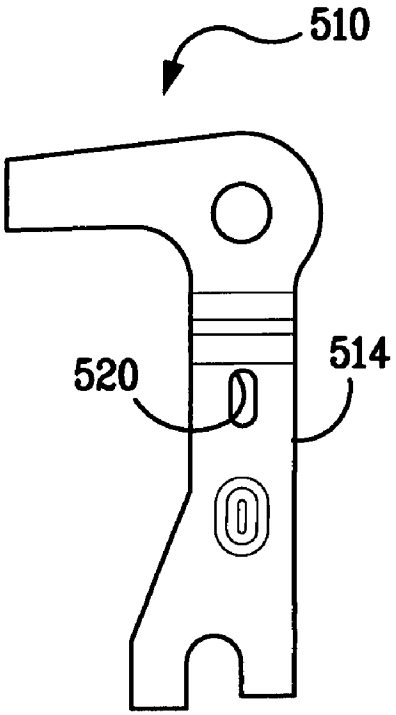
FIGS. 94-96 are views of the fourth half of the trigger of the fourth embodiment of a latch assembly according to the present invention.
Figure 95:
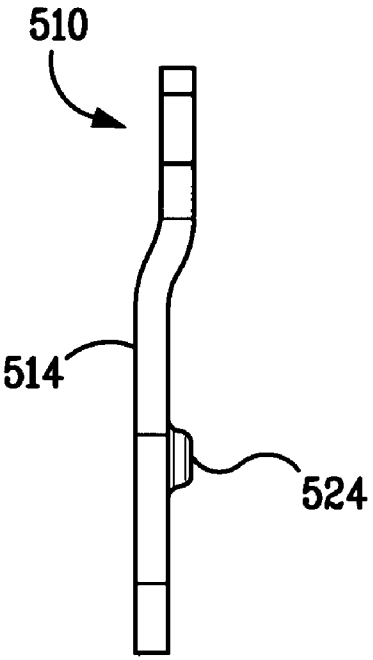
Figure 94:
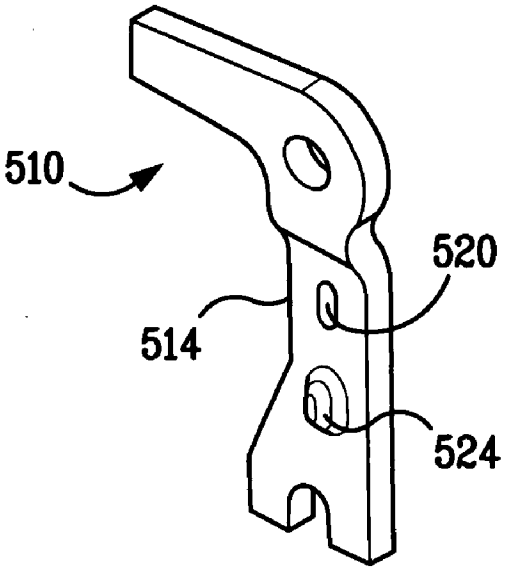
Figure 99:
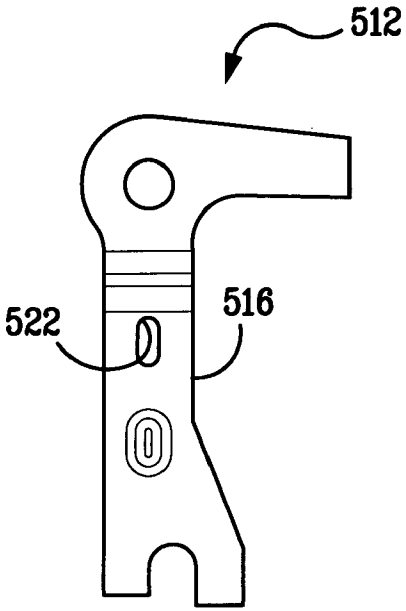
FIGS. 97-99 are views of the second half of the trigger of the fourth embodiment of a latch assembly according to the present invention.
Figure 97:
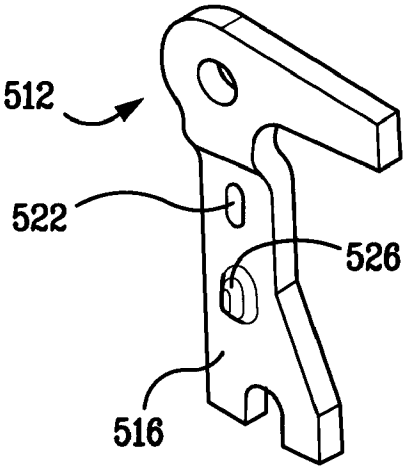
Figure 98:
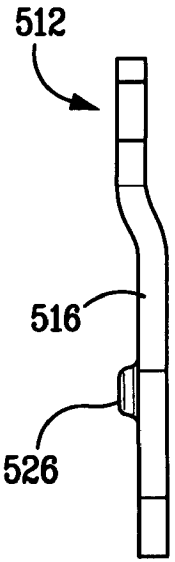

The plunger 318 of the linear actuator 308 is used to move the trigger 306 to the disengaged position in the same way that the slide 418 moves the trigger 406. In the latched configuration illustrated in FIG. 106, the pawl 304 is in the latched configuration and captures the rod-like portion 434 of the striker 508. The trigger 306 is in the engaged position and keeps the pawl 304 in the latched position. Energizing the linear actuator 308 moves the plunger 318 to the extended position illustrated in FIG. 77, which causes the trigger 306 to be moved to the disengaged position, also illustrated in FIG. 107. Once the trigger 306 is moved to the disengaged position, the pawl 304 is released and rotates under spring bias to the unlatched position illustrated in FIG. 107. The striker 508 is now released and any closure secured by the latch 300 can then be opened.

The linear actuator 308 is an off-the-shelf item and therefore its internal details are not illustrated here. The linear actuator 308 uses a rotating screw to linearly displace the plunger 318. One difference here is that the longitudinal axis of the motor of the linear actuator 308 is not inline with the longitudinal axis of the screw of the linear actuator 308 but is offset from it. This is due to the fact that in the linear actuator 308 rotation of the output shaft of the motor is imparted to the screw via a pair of meshing gears, one gear being fixed to the output shaft of the motor and one gear being fixed to the end of the screw nearest the motor. Therefore, the motor of the linear actuator 308 necessarily lies to one side of the screw of the linear actuator 308. This causes the off-the-shelf linear actuators such as the linear actuator 308 to be relatively bulky and not suitable for all applications. Otherwise the latches 400 and 300 are essentially identical.

Referring to FIGS. 109 to 139, yet another embodiment 400*a* of a latch made in accordance with the present invention can be seen. The latch 400*a* is essentially similar to the latch 400 except for the differences that are discussed below. In the interest of brevity, those features of the latch 400*a* that remain the same as the latch 400 are not described again as such a description would be merely duplication of material that has already been presented with respect to the latch 400.

As with the latch 400, the latch 400*a* has a motor 410, a bow-tie coupler 414, a screw 416, and a slide 418*a*. The slide 418*a* differs from the slide 418 in that it is not intended to be used with a kicker lever 492 and accordingly is not ordinarily provided with the bearings 496. The kicker lever 492 is replaced in the latch 400*a* by the compression spring 493. The compression spring 493 is provided between the slide 418*a* and the trigger 406*a*. The slide 418*a* is also provided with a cross-shaped projection 497 that acts as a spring retainer and guide with respect to the spring 493. At the end of each arm of the cross-shaped projection 497 is an over-hanging catch surface 548 that engages a coil near the end of the spring 493 that is in contact with the slide 418*a* in order to ensure that the spring 493 is properly positioned intermediate the slide 418*a* and the trigger 406*a*. The trigger 406*a* is of one-piece construction and lacks the opening 518 for the kicker lever 492, which is no longer necessary. The spring 493 is not strong enough to overcome the trigger spring 488 and actuate the trigger 406*a*, even when it is most compressed by virtue of the slide 418*a* being in its fully extended position. Accordingly, the trigger 406*a* will not be actuated until the projection 495 of the slide 418*a* impacts the longer arm 486*a* of the trigger 406*a*. However, once the motor is no longer energized, the spring 493 drives the slide 418*a* back to its retracted position. Alternatively, the compression spring 493 can be provided between the slide 418*a* and a portion of the housing 402*a*, a portion of the insert 415*a*, or some other structure that is fixed in position relative to the housing 402*a*. It is also possible to use a torsion spring in place of the compression spring 493.

In the latch 400*a*, the micro switch 532*a* is repositioned as compared to the micro switch 532 in the latch 400 such that the micro switch 532*a* is actuated in response to the position of the pawl 404*a* rather than in response to the position of the striker 508*a*. The latch 400*a* has a micro switch actuator 540 that is mounted on the same pivot axis as the pawl 404*a*. The micro switch actuator 540 is provided with fins 542 that engage the sides 544 and 498*a* of the pawl 404*a* such that the micro switch actuator 540 and the pawl

404*a* pivot together as a unit about the same axis of rotation. The micro switch actuator 540 is also provided with a projection 546 for engaging the micro switch lever 536*a*. The latch 400*a* is also provided with a redesigned micro switch holder 534*a* that repositions the micro switch 532*a* such that the micro switch lever 536*a* can be depressed by the projection 546 when the pawl 404*a* is in the latched position. Furthermore, the housing insert 415*a* and the housing 402*a* are redesigned slightly to route the wiring of the latch differently to thereby relieve some of the strain on the wiring for the motor and the micro switch. The pawl 404*a* used with the latch 400*a* shows a pawl slot 458*a* with a less severely reentrant side.

During the unlatching operation, the motor 410 is energized resulting in the rotation of the bowtie coupler 414. The bowtie coupler in turn rotates the screw 416 as described previously with respect to the latch 400. As the screw 416 rotates, it causes the slide 418*a* to move in rectilinear fashion toward the trigger 406*a* by means of a triple-lead thread on the shaft of the screw 416 and inside the slide 418*a*. The slide 418*a* moves toward the arm 486*a* of the trigger 406*a* and pushes the arm 486*a*, which causes the trigger 406*a* to rotate until the arm 484*a* of the trigger is disengaged from the notch 456 of the rotary pawl 404*a*. The disengagement of the trigger 406*a* from the pawl 404*a* allows the pawl to rotate to the unlatched position under the bias of the pawl spring 462 to thereby release the striker 508*a*. The slide 418*a* and screw 416 are returned to their starting positions by the compression spring 493. The latch 400*a* can also be unlatched mechanically by pulling on the linkage rod 530*a*. The linkage rod 530*a* differs from the linkage rod 530 only in the orientation of the L-shaped end of the linkage rod relative to the loop at the other end. In the linkage rod 530 the loop at one end of the linkage rod extends in the same plane as defined by the L-shaped end and the elongated middle portion of the linkage rod, while in the linkage rod 530*a* the loop at one end of the linkage rod extends in a plane perpendicular to the plane defined by the L-shaped end and the elongated middle portion of the linkage rod.

The trigger spring 488 biases the trigger 406*a* toward the engaged position, such that when the slide 418*a* is moved to the retracted position, the trigger 406*a* will tend to reengage the pawl 404*a* if the pawl 404*a* is rotated to the latched position. During latching, the rod-shaped portion 434*a* of the striker 508*a* engages the pawl slot 458*a* with the pawl 404*a* initially in the unlatched position, and then pushes the pawl 404*a* to the latched position as the striker 508*a* reaches the latched position relative to the housing 402*a*. Once the pawl 404*a* is in the latched position, the pawl can again be engaged by the trigger 406*a* to thereby retain the pawl 404*a* in the latched position and secure the striker 508*a* in its closed or latched position relative to the housing 402*a*.

As the striker 508*a* rotates the pawl 404*a* to the latched position, the micro switch actuator 540 rotates with the pawl 404*a* to its latched position where the micro switch actuator 540 depresses the micro switch lever 536*a*, which signals that the pawl 404*a* is in the latched position.

A purely mechanical version of the latches 400 and 400*a* is also contemplated as part of the present invention. The motor 410, the bowtie coupler 414, the screw 416, the slide 418*a*, and the spring 493 are eliminated from the purely mechanical version of the latch. The purely mechanical version has a shortened housing that houses the trigger and pawl and their associated springs, and also support the linkage rod 530*a*. As is the case with the housing 402, 402*a*, the shortened housing has an opening allow for engagement between the striker 508*a* and the pawl 404*a*. In the purely mechanical version, the trigger is rotated to the disengaged position primarily by pulling on the linkage rod 530*a*. It should also be noted that either of the disclosed micro switch configurations may be used with either one of the latches 400 and 400*a*. Furthermore, a micro switch may also be incorporated into the purely mechanical version of the latches for remote monitoring of the condition of the latch.

It will be apparent to those skilled in the art that various modifications can be made to the latch of the present invention without departing from the scope and spirit of the invention, and it is intended that the present invention cover modifications and variations of the latch which are within the scope of the appended claims and their equivalents.

The invention claimed is:

1. A latch assembly for releasably securing a first member in a closed position relative to a second member, one of said first member and said second member having a striker in a fixed positional relationship therewith, the latch assembly comprising:

a housing;

a pawl pivotally supported by said housing and being movable between a latched position and an unlatched position by pivotal movement about a pawl pivot axis, said pawl being provided with a torsion spring that biases said pawl toward the unlatched position;

actuation means;

a micro-switch securely positioned within said housing proximate said pawl pivot axis such that said micro-switch is engaged by the striker when the striker has moved said pawl to said latched position of said pawl, said micro-switch generating a signal corresponding to one of said latched position and said unlatched position of said pawl; and a trigger pivotally supported by said housing, said trigger being movable between an engaged position and a disengaged position, said trigger having a first lever arm adapted to engage said pawl and maintain said pawl in said latched position when said pawl is in said latched position and said trigger is in said engaged position, said trigger having a second lever arm capable of engagement by said actuation means, said actuation means selectively engaging said second lever arm to move said trigger to said disengaged position to thereby allow said pawl to move to said unlatched position, said second lever arm pivoting toward said pawl as said trigger is moved from said engaged position to said disengaged position, and said trigger is pivotally movable about a trigger pivot axis that is parallel to and spaced apart from said pawl pivot axis.

2. The latch assembly according to claim 1, wherein said actuation means compnses:

a screw;

a slide engaged by said screw such that rotation of said screw causes linear displacement of said slide between retracted and extended positions, said slide moving said trigger from said engaged position to said disengaged position as said slide moves from said retracted position to said extended position; and a motor having an output shaft that is coupled to said screw such that said screw rotates in response to rotation of said output shaft of said motor.

3. The latch assembly according to claim 2, wherein said screw, said slide, and said motor each have a longitudinal axis and wherein said longitudinal axes of said screw, said slide, and said motor are all in line with one another.

4. The latch assembly according to claim 3, wherein said screw has a pair of finger-like projections projecting from one end thereof and the latch assembly further comprises:

a bow-tie coupler attached to said output shaft of said motor so as to rotate therewith, said bow-tie coupler having wings that are positioned at angular positions about said longitudinal axis of said motor that are intermediate said finger-like projections to thereby rotationally couple said output shaft of said motor to said screw.

5. The latch assembly according to claim 1, wherein said housing is provided with a slot to permit engagement of the striker with said pawl, wherein the latch further comprises a micro-switch holder secured within said housing proximate said slot of said housing.

6. The latch assembly according to claim 5, further comprising a pawl pivot pin pivotally supporting said pawl within said housing, wherein said pawl pivot pin extends through an opening in said micro-switch holder.

7. The latch assembly according to claim 1, further comprising:

a micro-switch actuator mounted for pivotal movement about said pawl pivot axis, such that said micro switch actuator and said pawl pivot together as a unit about said pawl pivot axis, said micro switch actuator being provided with a projection for engaging said micro-switch;

wherein said micro-switch is positioned such that said micro-switch is engaged by said micro-switch actuator when said pawl has moved to said latched position of said pawl.

8. The latch assembly according to claim 7, wherein said housing is provided with a slot to permit engagement of the striker with said pawl, wherein the latch further comprises a micro-switch holder secured within said housing proximate said slot of said housing.

9. A latch assembly for releasably securing a first member in a closed position relative to a second member, one of said first member and said second member having a striker in a fixed positional relationship therewith, the latch assembly comprising:

a housing;

a pawl pivotally supported by said housing and being movable between a latched position and an unlatched position by pivotal movement about a pawl pivot axis, said pawl being provided with a torsion spring that biases said pawl toward the unlatched position;

actuation means, said actuation means comprising a screw, a slide engaged by said screw such that rotation of said screw causes linear displacement of said slide between retracted and extended positions, said slide moving said trigger from said engaged position to said disengaged position as said slide moves from said retracted position to said extended position, a motor having an output shaft that is coupled to said screw such that said screw rotates in response to rotation of said output shaft of said motor; and a compression spring in engagement with said slide such that said compression spring drives said slide to said retracted position when the motor is not energized, wherein said compression spring is comprised of a first end and a second end, wherein said first end engages said slide and said second end engages said second lever arm; and a trigger pivotally supported by said housing, said trigger being movable between an engaged position and a disengaged position, said trigger having a first lever arm adapted to engage said pawl and maintain said pawl in said latched position when said pawl is in said latched position and said trigger is in said engaged position, said trigger having a second lever arm capable of engagement by said actuation means, said actuation means selectively engaging said second lever arm to move said trigger to said disengaged position to thereby allow said pawl to move to said unlatched position, said second lever arm pivoting toward said pawl as said trigger is moved from said engaged position to said disengaged position, and said trigger is pivotally movable about a trigger pivot axis that is parallel to and spaced apart from said pawl pivot axis, wherein said screw, said slide, and said motor each have a longitudinal axis and wherein said longitudinal axes of said screw, said slide, and said motor are all in line with one another.

10. The latch assembly according to claim 9, wherein said screw has a pair of finger-like projections projecting from one end thereof and the latch assembly further comprises a bow-tie coupler attached to said output shaft of said motor so as to rotate therewith, said bow-tie coupler having wings that are positioned at angular positions about said longitudinal axis of said motor that are intermediate said finger-like projections to thereby rotationally couple said output shaft of said motor to said screw.

11. The latch assembly according to claim 9, wherein said slide comprises a retainer, wherein said retainer engages said first end of said compression spring to position said compression spring intermediate said slide and said second lever arm.

* * * * *

UNITED STATES PATENT AND TRADEMARK OFFICE

CERTIFICATE OF CORRECTION

PATENT NO. : 7,296,830 B2
APPLICATION NO. : 10/888168
DATED : November 20, 2007
INVENTOR(S) : Stefan M. Koveal et al.

It is certified that error appears in the above-identified patent and that said Letters Patent is hereby corrected as shown below:

Column 3, line 37, after -- assembly -- and before -- according -- delete the word "Is"

Column 12, line 23, after -- of -- and before -- the -- delete the word "IS"

Column 18, line 53, the word "compnses" should be -- comprises --.

Signed and Sealed this

Sixth Day of May, 2008

JON W. DUDAS
*Director of the United States Patent and Trademark Office*